US011459687B2

(12) United States Patent
Kim et al.

(10) Patent No.: US 11,459,687 B2
(45) Date of Patent: Oct. 4, 2022

(54) WASHING APPARATUS AND METHOD OF CONTROLLING THE SAME

(71) Applicant: Samsung Electronics Co., Ltd., Suwon-si (KR)

(72) Inventors: Hyun Oh Kim, Suwon-si (KR); Seung Hun Lee, Suwon-si (KR); Jun Hyun Park, Osan-si (KR); Sung Mo Lee, Gunpo-si (KR); So Dam Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/133,539

(22) Filed: Dec. 23, 2020

(65) Prior Publication Data

US 2021/0180231 A1 Jun. 17, 2021

Related U.S. Application Data

(63) Continuation of application No. 15/563,550, filed as application No. PCT/KR2016/002561 on Mar. 15, 2016, now Pat. No. 10,876,242.

(30) Foreign Application Priority Data

Apr. 1, 2015 (KR) ..... 10-2015-0046033
Nov. 18, 2015 (KR) ..... 10-2015-0161803

(51) Int. Cl.
*D06F 34/18* (2020.01)
*D06F 1/04* (2006.01)
(Continued)

(52) U.S. Cl.
CPC ..... *D06F 34/18* (2020.02); *D06F 1/04* (2013.01); *D06F 17/10* (2013.01); *D06F 23/04* (2013.01);
(Continued)

(58) Field of Classification Search
None
See application file for complete search history.

(56) References Cited

U.S. PATENT DOCUMENTS 5,671,493 A 9/1997 Moon
2004/0163183 A1 8/2004 Kim
(Continued)

FOREIGN PATENT DOCUMENTS

CN 1120665 A 4/1996
EP 2568070 A1 3/2013
(Continued)

OTHER PUBLICATIONS

IP Australia Examination report No. 1 for standard patent application regarding Application No. 2016241172, dated Feb. 19, 2018, 3 pages.
(Continued)

*Primary Examiner* — Cristi J Tate-Sims

(57) ABSTRACT

Provided is a washing apparatus and a method of controlling the same. The washing apparatus includes a washing tub; and a controller configured to determine whether laundry put into the washing tub is wet laundry or dry laundry, and to determine a weight of the laundry in the washing tub through a detection of wet laundry weight or a detection of dry laundry weight, based on a result of the determination. The washing apparatus includes a washing tub; and a controller configured to detect a water level of washing water in the washing tub, configured to perform at least one of detecting a weight of wet laundry weight and dry laundry according to the water level, and configured to allow washing to be performed according to at least one result of the detection of the wet laundry weight and the dry laundry weight.

13 Claims, 50 Drawing Sheets

(51) Int. Cl.

| | |
|---|---|
| *D06F 29/00* | (2006.01) |
| *D06F 103/04* | (2020.01) |
| *D06F 103/18* | (2020.01) |
| *D06F 103/46* | (2020.01) |
| *D06F 105/02* | (2020.01) |
| *D06F 105/58* | (2020.01) |
| *D06F 105/60* | (2020.01) |
| *D06F 101/00* | (2020.01) |
| *D06F 33/36* | (2020.01) |
| *D06F 17/10* | (2006.01) |
| *D06F 23/04* | (2006.01) |
| *D06F 37/38* | (2006.01) |
| *D06F 37/40* | (2006.01) |

(52) U.S. Cl.

CPC ..... *D06F 29/00* (2013.01); *D06F 33/36* (2020.02); *D06F 37/38* (2013.01); *D06F 37/40* (2013.01); *D06F 2101/00* (2020.02); *D06F 2103/04* (2020.02); *D06F 2103/18* (2020.02); *D06F 2103/46* (2020.02); *D06F 2105/02* (2020.02); *D06F 2105/58* (2020.02); *D06F 2105/60* (2020.02)

(56) References Cited

U.S. PATENT DOCUMENTS

| | | | | |
|---|---|---|---|---|
| 2009/0145175 | A1* | 6/2009 | Kim | D06F 31/00 68/27 |
| 2012/0060299 | A1* | 3/2012 | Kim | D06F 34/18 68/12.04 |
| 2014/0033449 | A1 | 2/2014 | Im | |
| 2014/0096327 | A1* | 4/2014 | Lee | D06F 34/18 68/12.05 |
| 2015/0113740 | A1 | 4/2015 | Lee | |
| 2015/0299927 | A1 | 10/2015 | Kim | |

FOREIGN PATENT DOCUMENTS

| | | | |
|---|---|---|---|
| JP | H07289776 | A | 11/1995 |
| JP | H07323195 | A | 12/1995 |
| KR | 10-1999-0016037 | A | 3/1999 |
| KR | 10-2007-0081879 | A | 8/2007 |
| KR | 10-2010-0006028 | A | 1/2010 |
| KR | 10-2013-0014058 | A | 2/2013 |
| KR | 10-2014-0045713 | A | 4/2014 |
| KR | 10-2014-0084952 | A | 7/2014 |
| KR | 10-1466338 | B1 | 11/2014 |
| KR | 10-1504686 | B1 | 3/2015 |

OTHER PUBLICATIONS

Extended European Search Report regarding Application No. 16773320.3, dated Mar. 19, 2018, 8 pages.

Notice of acceptance for patent application dated Jun. 4, 2018 in connection with Australian Patent Application No. 2016241172.

Office Action dated Mar. 27, 2019 in connection with Chinese Patent Application No. 201680019565.1, 13 pages.

Office Action dated Nov. 15, 2019 in connection with Chinese Patent Application No. 201680019565.1, 18 pages.

Examination Report in connection with Indian Application No. 201717038602 dated Apr. 24, 2020, 5 pages.

European Patent Office, "Communication pursuant to Article 94(3) EPC," Application No. EP 16773320.3, dated Oct. 9, 2018, 4 pages.

Korean Intellectual Property Office, "Notice of Preliminary Rejection" dated Nov. 28, 2021, in connection with Korean Patent Application No. 10-2015-0161803, 20 pages.

* cited by examiner

WASHING APPARATUS AND METHOD OF CONTROLLING THE SAME

CROSS-REFERENCE TO RELATED APPLICATIONS

This application is a continuation of U.S. patent application Ser. No. 15/563,550 filed on Sep. 29, 2017, which is a 371 of International Application No. PCT/KR2016/002561 filed on Mar. 15, 2016, which claims priority to Korean Patent Application No. 10-2015-0046033 filed on Apr. 1, 2015 and Korean Patent Application No. 10-2015-0161803 filed on Nov. 18, 2015, the disclosures of which are herein incorporated by reference in their entirety.

TECHNICAL FIELD

Embodiments disclosed herein relate to a washing apparatus and a method of controlling the same.

BACKGROUND

A washing apparatus is electronics capable of washing laundry, e.g., clothes, bedding, towels, or other textile products. In the washing apparatus, a washing tub is provided to accommodate laundry and washing water, and the washing apparatus performs washing according to an operation of a variety of components installed in the washing tub.

A washing apparatus is electronics capable of washing laundry, e.g., clothes, bedding, towels, or other textile products. In the washing apparatus, a washing tub is provided to accommodate laundry and washing water, and the washing apparatus performs washing according to an operation of a variety of components installed in the washing tub.

A pulsator or an agitator may be provided in the washing tub, wherein the pulsator is rotatably installed in the bottom of the washing tub and the agitator having blades is installed in the center of the washing tub. The washing apparatus can wash laundry by rotating the pulsator or the agitator.

When the pulsator is provided, the washing apparatus may wash laundry in the washing tub by using vortex by rotating the pulsator installed in the bottom of the washing tub at high speed, and by alternating the laundry by rotating the pulsator in different directions in a certain range with a certain period.

The washing apparatus may include a drum provided with an inlet installed in the front surface of the washing apparatus and rotated while inclined with a certain angle about a vertical line on the ground and thus the laundry may be washed by using the difference in elevation in the drum.

The washing apparatus may perform a washing cycle using a variety of methods as mentioned above, and as needed the washing apparatus may wash the laundry by sequentially performing a rinsing cycle and a spin-dry cycle.

SUMMARY

It is an aspect of the present disclosure to provide a washing apparatus capable of providing improved washing performance to a user by performing washing in an appropriate manner by more precisely determining the amount or the weight of laundry put into a washing tub, and a method of controlling the same It is another aspect of the present disclosure to provide a washing apparatus capable of washing laundry in an appropriate manner depending on whether the laundry put into the washing tub is dry or wet and a method of controlling the same.

It is another aspect of the present disclosure to provide a washing apparatus capable of washing laundry put into a washing tub in an appropriate manner depending on whether washing is performed by using a container in an auxiliary washing unit or not, wherein the washing apparatus is further provided with the auxiliary washing unit having the container configured to wash laundry other than the washing tub, and a method of controlling the same.

It is another aspect of the present disclosure to provide a washing apparatus capable of washing laundry in an appropriate manner according to the weight of the laundry which is detected by determining a water level in the washing tub and then by detecting the weight of the laundry according to the determined water level, and a method of controlling the same.

A washing machine and a method of controlling the same is provided to solve the above-described technical problems.

In accordance with one aspect of the present disclosure, a washing apparatus includes a washing tub; and a controller configured to determine whether laundry put into the washing tub is wet laundry or dry laundry, and to determine a weight of the laundry in the washing tub through a detection of wet laundry weight or a detection of dry laundry weight, based on a result of the determination.

The washing apparatus may further include an auxiliary door configured to perform washing separately from the washing tub, wherein the controller may determine that the laundry put into the washing tub is wet laundry when washing water is supplied to the auxiliary door, and determine the weight of the laundry through the detection of wet laundry weight.

The washing apparatus may further include a water supply portion configured to supply washing water to the washing tub, wherein, when the laundry put into the washing tub is determined to be wet laundry, the water supply portion supplies the washing water to the washing tub to a predetermined water level in response to a result of the determination.

The washing apparatus may further include a pulsator installed on the bottom of the washing tub; and a motor configured to rotate the pulsator, wherein the motor may rotate the pulsator in at least one direction, when the washing water is supplied to the washing tub to the predetermined water level.

The controller may determine the weight of the laundry using the friction load of the laundry about the rotating pulsator.

The controller may determine the weight of the laundry using at least one of the current applied to the motor connected to the pulsator or a rotating tub, a rotational speed of the pulsator, and a water level of washing water in the washing tub.

The controller may detect the current applied to the motor, determines a load corresponding to the magnitude of the detected current, and determine the weight of the laundry using a result of the determination.

The washing apparatus may further include a memory configured to store information related to whether washing water is supplied to the auxiliary door, wherein the controller may determine whether washing water is supplied to the auxiliary door based on information stored in the memory.

The washing apparatus may further include an auxiliary input configured to receive a washing water supply command about the auxiliary door, by an operation thereof, wherein the memory may store information related to whether the auxiliary input is operated or not, and the controller may determine whether washing water is supplied to the auxiliary door based on the information related to whether the auxiliary input is operated or not.

When washing water is not supplied to the auxiliary door, the controller may determine that the laundry put into the washing tub is dry laundry and determine the weight of the laundry through the detection of dry laundry weight.

The controller may determine the weight of the laundry using the friction load of the laundry about the pulsator by rotating the pulsator installed on the bottom of the washing tub, or using the rotational inertia caused by the rotation of the rotating tub or the current output during the rotating tub is rotated by rotating the rotating tub.

After the weight of the laundry is determined and a washing cycle is performed based on the determined weight, the controller may determine that the laundry in the washing tub is wet laundry and determine the weight of the laundry through the detection of wet laundry weight, again.

The controller may determine at least one setting related to the washing cycle, according to the determined weight of the laundry.

The at least one setting related to the washing cycle may include at least one of an amount of washing water supplied to the washing tub, the power applied to the motor connected to the washing tub or the pulsator installed in the washing tub, a rotational speed of the motor, and a washing time.

In accordance with another aspect of the present disclosure, a washing apparatus includes a washing tub provided with an opening; an auxiliary washing unit configured to perform auxiliary washing separately from the washing tub; a first water supply portion configured to supply washing water to a container of the auxiliary washing unit; and a controller configured to determine whether laundry put into the washing tub is wet laundry or dry laundry, and to determine a weight of the laundry using different methods based on the determination, wherein when the first water supply portion supplies washing water to the container of the auxiliary washing unit, the controller determines that the laundry put into the washing tub is wet laundry and determines a weight of the laundry in the washing tub.

The washing apparatus may further include a user interface configured to receive a washing operation command of the laundry, wherein when washing water is supplied by the first water supply portion before the washing operation command is performed, the controller may determine a weight of the laundry in the washing tub by determining that the laundry put into the washing tub is wet laundry.

In accordance with another aspect of the present disclosure, a method of controlling a washing apparatus provided with a washing tub into which laundry is put includes determining whether the laundry is wet laundry or dry laundry; and determining a weight of the laundry in the washing tub using different methods depending on whether the laundry is wet laundry or dry laundry.

The washing apparatus may further include an auxiliary door configured to perform washing separately from the washing tub, wherein the determination of whether the laundry is wet laundry or dry laundry may include determining whether washing water is supplied to the auxiliary door and determining that the laundry put into the washing tub is wet laundry when washing water is supplied to the auxiliary door, and the determination of the weight of the laundry in the washing tub may include determining the weight of the laundry in the washing tub through the detection of wet laundry weight.

The determination of the weight of the laundry in the washing tub through the detection of wet laundry weight may include when the laundry put into the washing tub is determined to be wet laundry, supplying washing water to the washing tub to a predetermined water level in response to a result of the determination.

The determination of the weight of the laundry in the washing tub through the detection of wet laundry weight may further include rotating a pulsator installed in the bottom of the washing tub in at least one direction, when the washing water is supplied to the washing tub to the predetermined water level.

The determination of the weight of the laundry in the washing tub through the detection of wet laundry weight may further include determining a weight of the laundry using a friction load of the laundry about the pulsator.

The determination of the weight of the laundry in the washing tub through the detection of wet laundry weight may include determining a weight of the laundry using at least one of the current applied to a motor connected to the pulsator or a rotating tub, a rotational speed of the pulsator, and a water level of washing water in the washing tub.

The determination of the weight of the laundry in the washing tub through the detection of wet laundry weight may include detecting the current applied to the motor, determining a load corresponding to the magnitude of the detected current and determining the weight of the laundry based on a result of the determination.

The control method may further include storing information related to whether the washing water is supplied to the auxiliary door, and the determination of whether the laundry is wet laundry or dry laundry may further include determining whether the washing water is supplied to the auxiliary door based on the information stored in a memory.

The washing apparatus may further include an auxiliary input configured to receive a washing water supply command about the auxiliary door, by an operation thereof, wherein the storage of the information related to whether the washing water is supplied to the auxiliary door may include storing information related to whether the auxiliary input is operated, and the determination of whether the washing water is supplied to the auxiliary door based on the information stored in the memory may include determining whether the washing water is supplied to the auxiliary door based on the information related to whether the auxiliary input is operated.

The control method may further include when the washing water is supplied to the auxiliary door, inputting a washing operation command prior to determining whether the laundry is wet laundry.

The determination of the weight of the laundry in the washing tub using different methods depending on whether the laundry is wet laundry or dry laundry, may include determining whether the washing water is supplied to the auxiliary door and determining that the laundry put into the washing tub is dry laundry when the washing water is not supplied to the auxiliary door, and the determination of the weight of the laundry in the washing tub may include determining the weight of the laundry through the detection of dry laundry weight.

The determination of the weight of the laundry in the washing tub through the detection of dry laundry weight may include at least one of determining the weight using a friction load of the laundry about the pulsator by rotating the pulsator installed in the bottom of the washing tub and determining the weight of the laundry tub using rotational inertia according to the rotation of the rotating tub or the current output during the rotation of the rotating tub by rotating the rotating tub of the washing.

The control method may further include performing a washing cycle based on the weight of the laundry after the weight of the laundry is determined and re-determining a weight of the laundry using the detection of the wet laundry weight when the laundry in the washing tub is determined to be wet laundry.

The control method may further include determining at least one setting related to the washing cycle based on the determined weight of the laundry.

The determination of the at least one setting related to the washing cycle may include at least one of an amount of washing water supplied to the washing tub, a load of the motor connected to the pulsator installed in or in the inside of the washing tub, and the rotational speed of the motor and the washing time.

In accordance with another aspect of the present disclosure, a washing apparatus includes a washing tub; a water level detector configured to detect a water level of washing water in the washing tub; and a controller configured to perform at least one of detecting a weight of wet laundry weight and dry laundry according to the water level detected by the water level detector and configured to allow washing to be performed according to at least one result of the detection of the wet laundry weight and the dry laundry weight.

The controller may perform the detection of the dry laundry weight when the water level of the washing water is lower than a first reference water level.

The controller may supply washing water to a first target water level when the weight of the laundry determined by the detection of the dry laundry weight is greater than a first reference weight, and perform the detection of the wet laundry weight.

The controller may allow washing to be performed based on a result of the detection of the dry laundry weight when the weight of the laundry determined by the detection of the wet laundry weight is greater than a second reference weight.

The controller may allow washing to be performed based on a result of the detection of the wet laundry weight when the weight of the laundry determined by the detection of the wet laundry weight is less than the second reference weight.

The controller may allow washing to be performed based on a result of the detection of the dry laundry weight when the weight of the laundry determined by the detection of the dry laundry weight is less than the first reference weight.

When the water level of the washing water is higher than the first reference water level and lower than a second reference water level, the controller may perform the detection of the wet laundry weight after supplying washing water to the washing tub to a second target water level, and allow washing to be perform according to a result of the detection of the wet laundry weight.

The second target water level may be the same as the second reference water level.

When the water level of the washing water is higher than the second reference water level and lower than a third reference water level, the controller may perform the detection of the wet laundry weight after supplying washing water to the washing tub to a third target water level and allow washing to be perform according to a result of the detection of the wet laundry weight.

The third target water level may be the same as the third reference water level.

The controller may allow washing to be performed regardless of a result of the detection of the weight when the water level of the washing water is higher than the third reference water level.

When the water level of the washing water is higher than the third reference water level, the controller may allow washing to be perform after supplying washing water to the washing tub to a fourth target water level.

The washing apparatus may further include a pulsator rotatably installed on the bottom of the washing tub and a motor configured to rotate the pulsator according to the applied power.

The controller may calculate an average value of power applied to the motor, determine a load applied to the motor based on the calculated average value, and determine a weight of the laundry based on the determined load, thereby performing the detection of the wet laundry weight.

The washing apparatus may further include an information provider configured to display at least one result of the detection of the wet laundry weight and the dry laundry weight.

In accordance with another aspect of the present disclosure, a method of controlling a washing apparatus includes determining a water level of washing water in a washing tub into which laundry is put; performing at least one of determining a weight of wet laundry and determining a weight of dry laundry according to the water level of the washing water; and performing washing according to at least one result of the detection of the wet laundry weight and the dry laundry weight.

The performance of the at least one of determining a weight of wet laundry and determining a weight of dry laundry according to the water level of the washing water may include performing the detection of the dry laundry weight when a water level of the washing water is lower than a first reference water level.

The performance of the at least one of determining a weight of wet laundry and determining a weight of dry laundry according to the water level of the washing water may further include when the weight of the laundry determined by the detection of the dry laundry weight is greater than a first reference weight, performing the detection of the wet laundry weight after supplying washing water to a first target water level.

The performance of the at least one of determining a weight of wet laundry and determining a weight of dry laundry according to the water level of the washing water may further include determining a weight of the laundry according to a result of the detection of the dry laundry weight when the weight of the laundry determined by the detection of the wet laundry weight is greater than a second reference weight.

The performance of the at least one of determining a weight of wet laundry and determining a weight of dry laundry according to the water level of the washing water may further include determining a weight of the laundry according to a result of the detection of the wet laundry weight when the weight of the laundry determined by the detection of the wet laundry weight is less than the second reference weight The performance of the at least one of determining a weight of wet laundry and determining a weight of dry laundry according to the water level of the washing water may further include determining a weight of the laundry according to a result of the detection of the dry laundry weight when the weight of the laundry determined by the detection of the dry laundry weight is less than the first reference weight.

The performance of the at least one of determining a weight of wet laundry and determining a weight of dry laundry according to the water level of the washing water may further include, when the water level of the washing water is higher than the first reference water level and lower than the second reference water level, supplying the washing water to the washing tub to the second target water level, performing the detection of the wet laundry weight, and determining the weight of the laundry according to a result of the detection of the wet laundry weight.

The performance of the at least one of determining a weight of wet laundry and determining a weight of dry laundry according to the water level of the washing water may further include, when the water level of the washing water is higher than the second reference water level and lower than a third reference water level, supplying the washing water to the washing tub to a third target water level, performing the detection of the wet laundry weight, and determining the weight of the laundry according to a result of the detection of the wet laundry weight.

The performance of the at least one of determining a weight of wet laundry and determining a weight of dry laundry according to the water level of the washing water may further include performing washing regardless of a result of the detection of the weight when the water level of the washing water is higher than the third reference water level.

The performance of washing regardless of a result of the detection of the weight when the water level of the washing water is higher than the third reference water level may include when the water level of the washing water is higher than the third reference water level, supplying the washing water to the washing tub to a fourth target water level and performing washing when supplying washing water to the fourth target water level is completed.

The detection of the wet laundry weight may include applying the power to the motor configured to rotate the pulsator rotatably installed on the bottom of the washing tub, calculating an average value of the power applied to the motor, determining a load applied to the motor based on the calculated average value; and determining the weight of the laundry based on the determined load.

The control method may further include displaying at least one result of the detection of the wet laundry weight and the dry laundry weight.

In accordance with one aspect of the present disclosure, it may be possible to perform washing in an appropriate manner by more precisely determining the amount or the weight of laundry put into a washing tub, thereby obtaining an improved washing performance.

It may be possible to perform washing in an appropriate manner depending on whether the laundry put into the washing tub is dry or wet, more particularly to perform washing by supplying appropriate amount of washing water and by performing the washing for an appropriate time depending on whether the laundry put into a washing tub is dry or wet.

It may be possible to wash laundry put into the washing tub in an appropriate manner depending on whether washing is performed by using a container provided in an auxiliary washing unit, or not.

It may be possible to precisely measure a weight of laundry through different methods depending on whether washing is performed by using the container provided in the auxiliary washing unit or not, or whether the laundry is dry or wet.

It may be possible to precisely measure a weight of laundry put into the washing tub, to supply washing water to the washing tub based on the measured weight of the laundry, or to control an operation of a motor for a washing cycle, thereby driving the washing apparatus appropriately by considering the laundry put into the washing tub.

It may be possible to appropriately control an amount of washing water supply or an operation of the motor of the washing apparatus depending on whether pre-washing is performed on laundry put into the washing tub or not, and thus it may be possible to prevent the waste of the washing water and the power, thereby obtaining the economic effects.

It may be possible to measure a weight of laundry put into the washing tub with a high resolution so as to measure the weight of laundry precisely, thereby washing the laundry in an appropriate manner.

DETAILED DESCRIPTION

Hereinafter, exemplary embodiments according to the present disclosure will be described in detail with reference to FIGS. 1 to 19.

For convenience of description, a washing apparatus 1 and components of the washing apparatus 1 will be described using a variety of direction and positions, e.g., a front side, a rear side, an upper side, a lower side, or a lateral side of the washing apparatus 1. The direction and position is defined with respect to a state in which the washing apparatus 1 is used or installed in a normal manner. Particularly, "front side" represents a direction facing a user interface of the washing apparatus 1, and "rear side" represents a direction opposite to the front side. "Lower side" represents a direction facing the ground where a washing apparatus is installed, and "upper side" represents a direction opposite to the lower side. The directions and positions are defined for convenience of description, and may be defined differently in actual implementation, manufacture, installation, or use.

Figure 1:
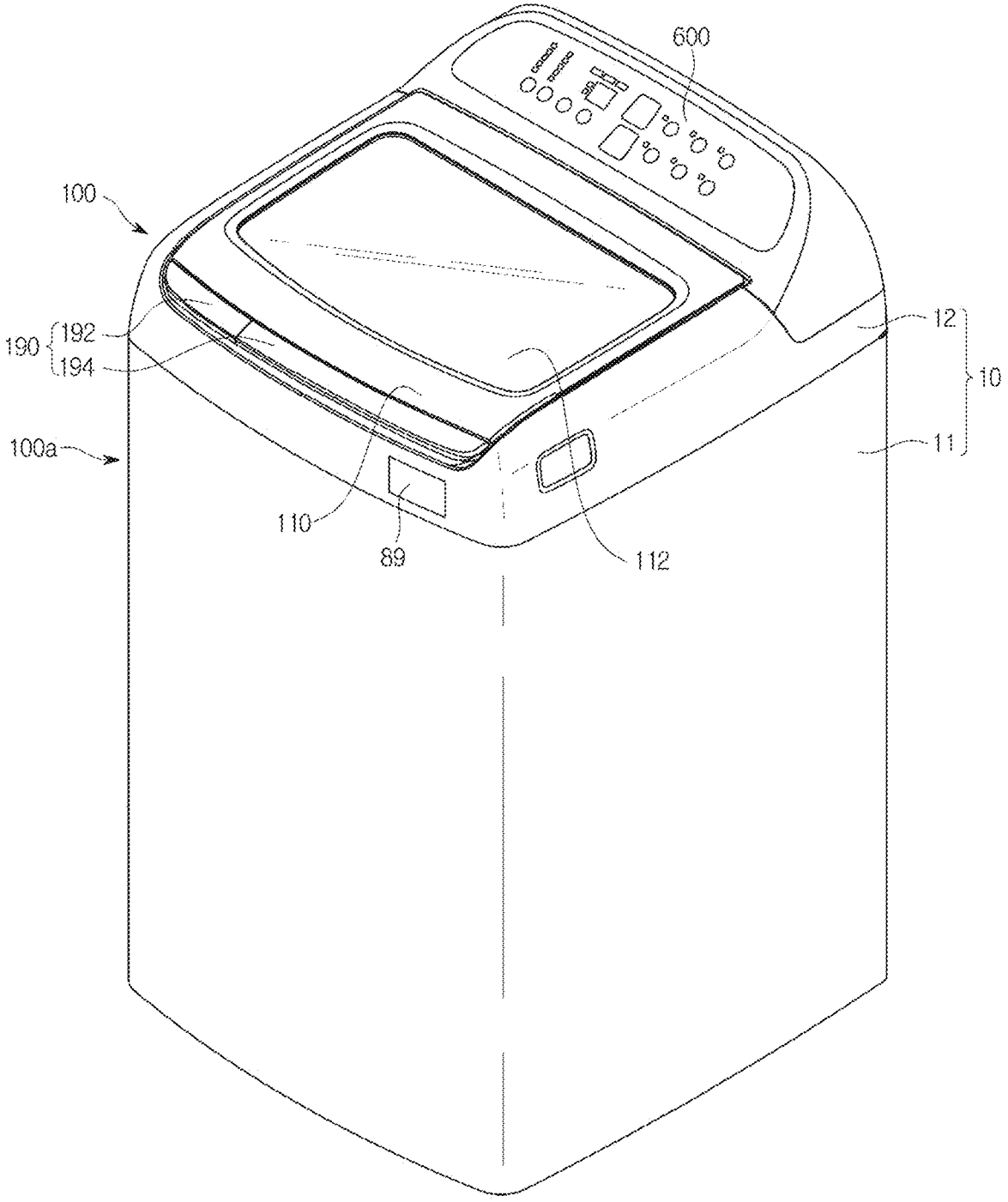
FIG. 1 is a perspective view of a washing apparatus according to one embodiment of the present disclosure.
Figure 2:
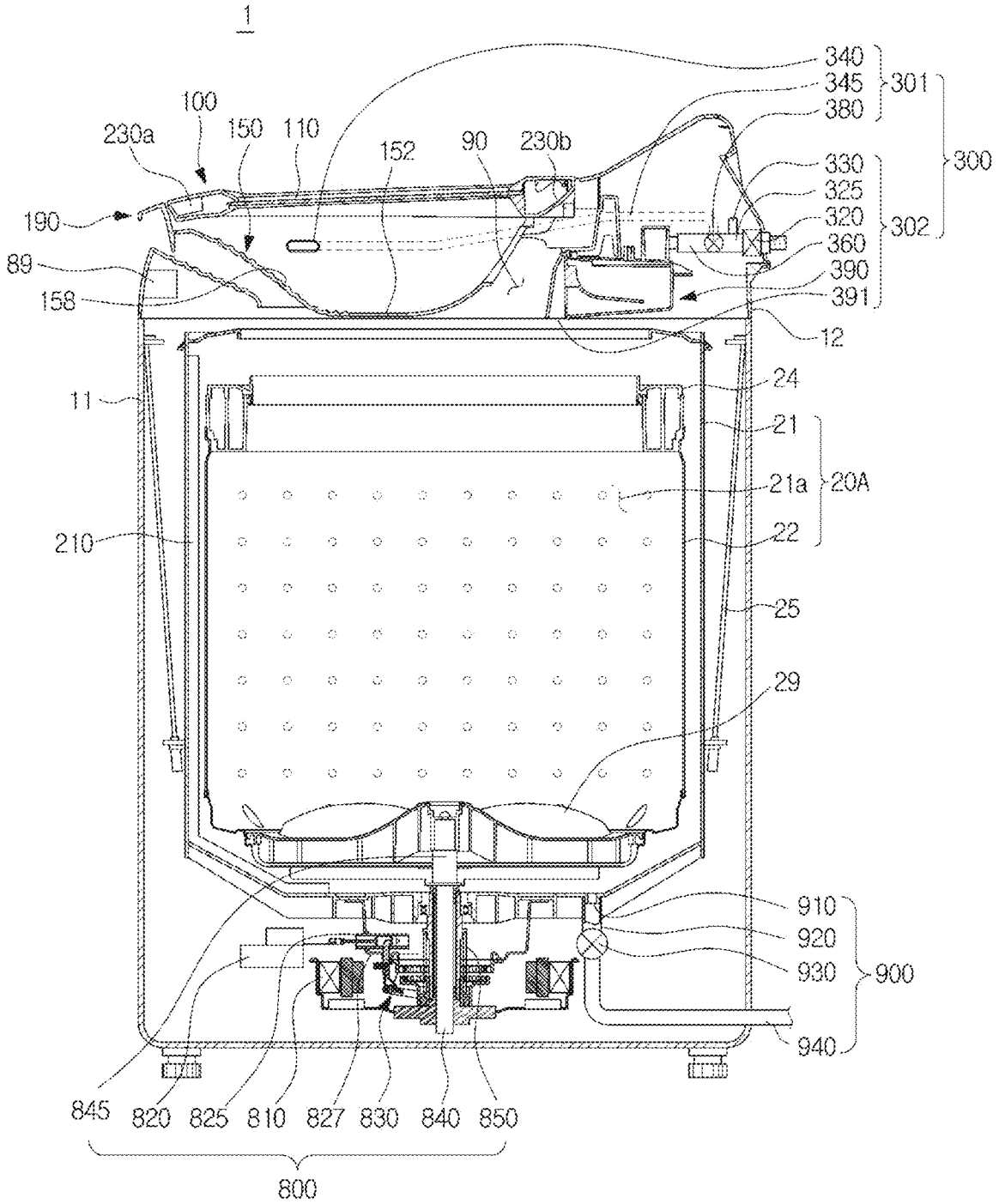
FIG. 2 is a side-sectional view of the washing apparatus according to one embodiment of the present disclosure.

FIG. 1 is a perspective view of a washing apparatus according to one embodiment of the present disclosure, and FIG. 2 is a side-sectional view of the washing apparatus according to one embodiment of the present disclosure.

As illustrated in FIG. 1, the washing apparatus 1 may include a door assembly 100 preventing washing water from being leaked to the outside during main washing and allowing auxiliary washing to be performed, and a body assembly 100*a* coupled to the door assembly 100 and in which a washing unit 20 including a washing tub 20*a* is installed.

The body assembly 100*a* may include a body assembly housing 11 forming an appearance of the body assembly 100*a* and the door assembly 100 may include a door assembly housing 12 forming an appearance of the door assembly 100. The body assembly housing 11 and the door assembly housing 12 form an overall appearance of the washing apparatus 1.

According to one embodiment, the body assembly housing 11 and the door assembly housing 12 are integrally formed to form the appearance of the washing apparatus 1. According to another embodiment, the door assembly 100 and the body assembly 100*a* are separately formed and then assembled by an adhesive and a variety of coupling methods, thereby forming an overall appearance of the washing apparatus 1.

In the door assembly 100, an opening 90 allowing laundry to put into the inside of the washing tub 20*a* and a main door 110 closing the opening 90 are provided.

In the door assembly 100, an auxiliary washing unit allowing auxiliary washing, e.g., hand laundry and prewashing, other than main washing may be installed and the auxiliary washing unit may be implemented as an auxiliary door 150. Hereinafter a case in which the auxiliary door 150 is employed as the auxiliary washing unit will be described, but is not limited thereto. Alternatively, the auxiliary washing unit may be implemented as a certain shaped container which is seated on a seating portion 90*a* provided inside of the door assembly 100 and detachably installed from the door assembly 100.

The auxiliary door 150 may be installed in the opening 90 to open and close the opening 90.

The main door 110 and the auxiliary door 150 may rotate to open and close the opening 90. The inside of a rotating tub 22 may be exposed to the outside or closed from the outside according to the open and close of the main door 110 and the auxiliary door 150.

The main door 110 is provided in an upper end of the door assembly 100 and rotatably coupled to the door assembly housing 12. A transparent window 112 may be provided in the main door 110 so that the inside of the rotating tub 22 is shown in a state in which the main door 110 closes the opening 90. A reed switch 230*a* and a checker switch 230*b* may be provided in the main door 110 to detect whether the main door 110 is opened or closed.

The auxiliary door 150 may be installed in a lower side of the main door 110, and configured to be exposed to the outside when the main door 110 is opened. In the auxiliary door 150, a container 152 recessed in a direction of the rotating tub 22, which is opposite to a direction of the main door 110, is formed, and the container 152 provides an auxiliary washing space 150*a* in which washing is performed, separately from a main washing space 21*a* in the washing tub 20*a*. The auxiliary washing space 150*a* may be used for at least one of the hand laundry or the pre-washing. The main washing space 21*a* in the rotating tub 22 and the auxiliary washing space 150*a* are separated from each other and thus washing may be separately performed in each space.

A handle portion 190 may be provided in the door assembly 100 to open and close the main door 110 or the auxiliary door 150, wherein the handle portion 190 may include a door handle portion 192 opening and closing the main door 110, and an auxiliary handle portion 194 opening and closing the auxiliary door 150 or opening and closing the main door 110 and the auxiliary door 150 at the same time. The door handle portion 192 may be integrally formed with the main door 110 and the auxiliary handle portion 194 may be integrally formed with the auxiliary door 150.

The main door 110 and the auxiliary door 150 will be described later in detail.

A part of a washing water supply portion 300 supplying at least one of washing water and detergent may be further provided in the door assembly 100.

The water supply portion 300 may include a water supply valve 320, a water supply pipe 325, a switch unit 380, a first washing water supply portion 301, and a second washing water supply portion 302. The first washing water supply portion 301 may include an auxiliary water supply port 340 and an auxiliary water supply pipe 345. The second washing water supply portion 302 may include a main water supply pipe 360 and a main water supply port 391.

The water supply pipe 325 supplies washing water to the washing tub 20*a*. The washing water supplied through the water supply pipe 325 may be directly supplied to at least one of the a fixed tub 21 and the rotating tub 22 of the washing tub 20*a* or may be supplied to at least one of the fixed tub 21 and the rotating tub 22 of the washing tub 20*a* together with detergent by passing through a detergent supply device 390. One end of the water supply pipe 325 may be directly or indirectly connected to an external water source to receive water from the outside and the other end of the water supply pipe 325 may be connected to the switch unit 380.

The water supply valve 320 may be installed between the water supply pipe 325 and the external water source. The water supply valve 320 may be connected to the external water source and configured to be openable and closable so that the water supply valve 320 may control whether to supply washing water to the water supply pipe 325 or control the amount of washing water to be supplied.

The switch unit 380 may be connected to the water supply pipe 325 and supply washing water delivered from the water supply pipe 325 to at least one of the first washing water supply portion 301 and the second washing water supply portion 302. The switch unit 380 is configured to selectively supply washing water delivered from the water supply pipe 325 to any one of the main water supply pipe 360 of the second washing water supply portion 302 and the auxiliary water supply pipe 345 of the first washing water supply portion 301. Particularly, since the washing water flows to at least one of the main water supply pipe 360 and the auxiliary water supply pipe 345 by the control of the switch unit 380, the washing water may be supplied to the container 152 or the main washing space 21*a*. For example, the switch unit 380 may include a three way valve. According to embodiments, the switch unit 380 may be omitted.

The main water supply pipe 360 may be configured to supply water to the main washing space 21*a*. One end of the main water supply pipe 360 may be directly connected to the main water supply port 391 or the detergent supply device 390 and the other end of the main water supply pipe 360 may be connected to the switch unit 380.

The main water supply port 391 may be configured to allow washing water supplied through the main water supply pipe 360 to discharge to the main washing space 21*a*. For example, as illustrated in FIG. 2, the main water supply port 391 is directed to the lower side. The main water supply port 391 may be formed on an end portion of the main water supply pipe 360. Alternatively, the main water supply port 391 may be connected to the detergent supply device 390 and when the main water supply port 391 is provided in the detergent supply device 390, the main water supply port 391 may discharge washing water in which detergent is dissolved, to the main washing space 21*a*.

The auxiliary water supply pipe 345 may be configured to allow water to be supplied to the auxiliary washing space 150*a* of the auxiliary door 150. One end of the auxiliary water supply pipe 345 may be connected to the auxiliary water supply port 340 and the other end of the auxiliary water supply pipe 345 may be connected to the switch unit 380.

The auxiliary water supply port 340 may discharge washing water supplied through the auxiliary water supply pipe 345 to the inside of the container 152. The auxiliary water supply port 340 may be communicated with the auxiliary water supply pipe 345. The auxiliary water supply port 340 may be provided on one side of the auxiliary door 150 to supply washing water to the container 152.

As mentioned above, the main water supply pipe 360 and the auxiliary water supply pipe 345 may be diverged from the water supply pipe 325 with respect to the switch unit 380, but according to embodiments, the main water supply pipe 360 and the auxiliary water supply pipe 345 may be directly connected to the water supply valve 320, respectively. In other words, the other end of the main water supply pipe 360 in which one end of the main water supply pipe 360 is connected to the detergent supply device 390, and the other end of the auxiliary water supply pipe 345 in which one end of the auxiliary water supply pipe 345 is connected to the auxiliary water supply port 340 may be connected to the water supply valve 320, respectively. In this case, the washing water may be supplied to the container 152 or the main washing space 21*a* by the control of the water supply valve 320.

It may be possible to supply washing water to any one of the main water supply pipe 360 and the auxiliary water supply pipe 345 by the switch unit 380. Alternatively it may be possible to supply washing water to both of the main water supply pipe 360 and the auxiliary water supply pipe 345 and in this case, a water supply valve configured to selectively control the main water supply pipe 360 and the auxiliary water supply pipe 345 may be provided in the washing apparatus 1.

The detergent supply device 390 may be connected to the main water supply pipe 360 to add detergent to washing water supplied from the main water supply pipe 360. The washing water in which the detergent is dissolved by the detergent supply device 390 may be supplied to the main washing space 21*a* through the main water supply port 391. According to embodiments, the detergent supply device 390 may be connected to the auxiliary water supply pipe 345 and in this case, the washing water in which the detergent is dissolved may be supplied to the auxiliary door 150.

A water temperature controller 330 may control the temperature of washing water supplied through at least one of the main water supply pipe 360 and the auxiliary water supply pipe 345. For example, the water temperature controller 330 may control the temperature of washing water by using refrigerant flowing through a compressor, a condenser, an expansion valve and an evaporator. Alternatively, the water temperature controller 330 may control the temperature of washing water by an additional heater supplying heat to washing water.

As illustrated in FIG. 2, the water supply valve 320, the water supply pipe 325, the switch unit 380, the first washing water supply portion 301 and the second washing water supply portion 302 may be provided in the door assembly 100.

A user interface 600 may be further provided in the door assembly 100 to allow a user to control an operation of the washing apparatus 1 or to provide a variety of information related to the washing apparatus 1 to a user. A description of the user interface 600 will be described later.

Other than the user interface 600, an auxiliary water supply input 89 may be further provided in the door assembly 100 to input a washing water supply command for the container 152. When the auxiliary water supply input 89 is operated, the water supply valve 320 may be opened and washing water may be supplied from the outside. The switch unit 380 of the washing apparatus 1 may open the auxiliary water supply pipe 345 and close the main water supply pipe 360 to allow the washing water to be supplied to only the auxiliary water supply pipe 345.

The auxiliary water supply input 89 may be implemented as a physical button inserted into the inside of the door assembly housing 12 according to the pressure, or a lever rotated on the outside of the door assembly housing 12. When the physical button or the lever is operated, the corresponding electrical signal may be output and then transmitted to a controller 400 (refer to FIG. 22). The controller 400 may allow washing water to be discharged from the auxiliary water supply port 340 by controlling the switch unit 380. According to embodiments, the auxiliary water supply input 89 may be implemented as a touch pad and a touch screen which output an electrical signal by detecting a user's touch, or implemented as a variety of input means capable of receiving a user's command.

Hereinafter a door assembly according to one embodiment will be described in detail with reference to FIGS. 3 to 5.

Figure 3:
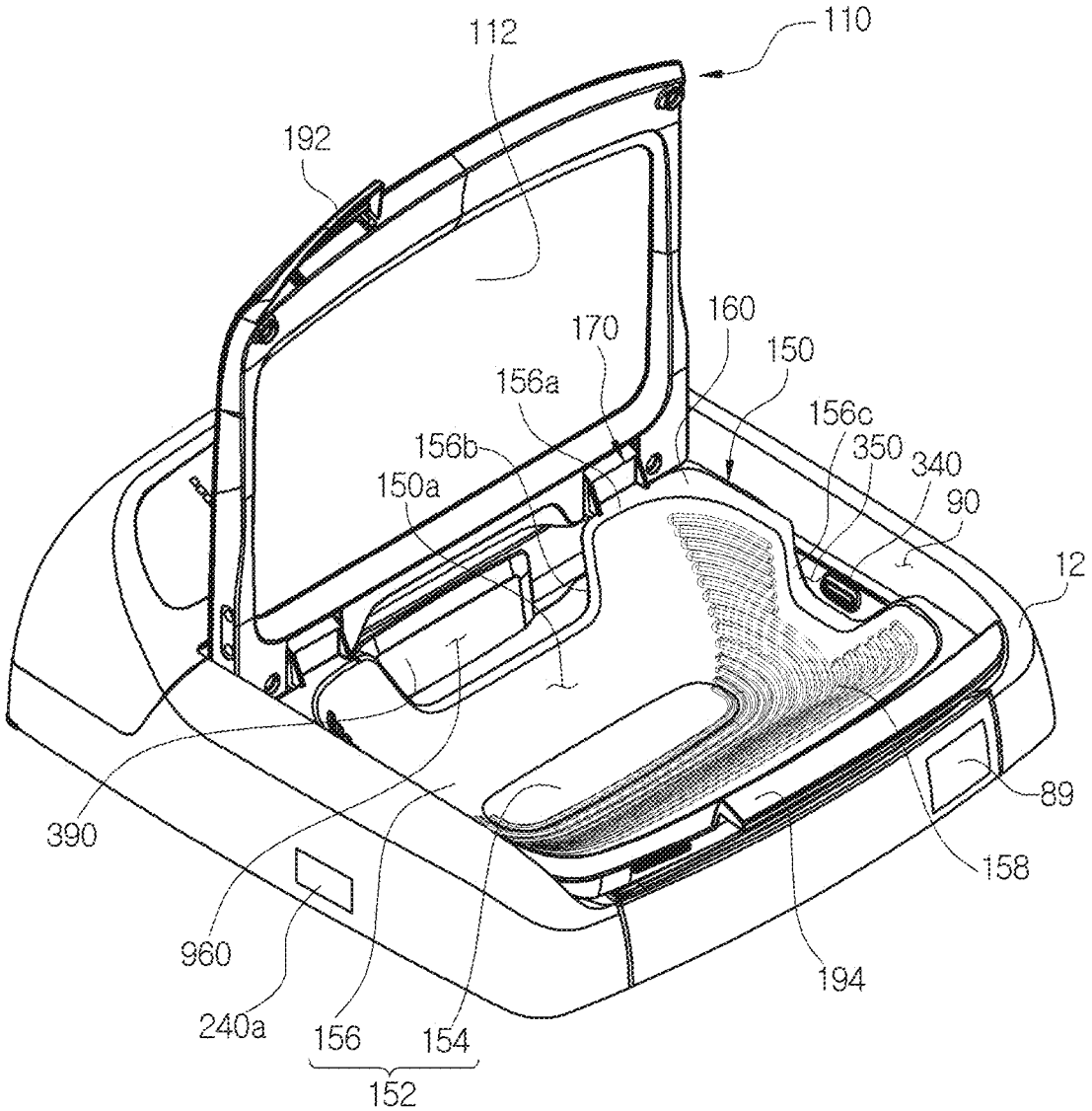
FIG. 3 is a perspective view of a door assembly of the washing apparatus according to one embodiment of the present disclosure.
Figure 4:
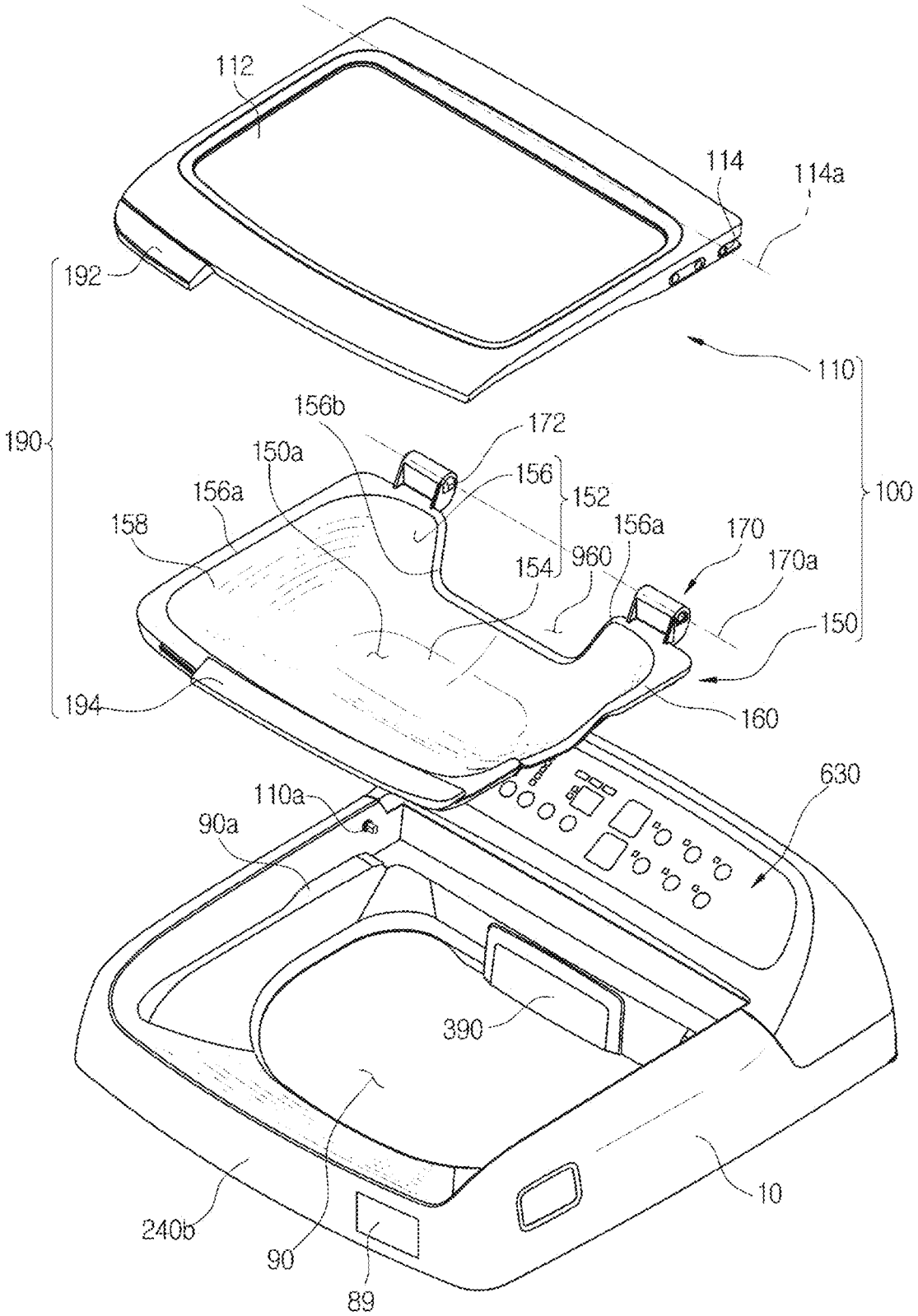
FIG. 4 is an exploded-perspective view of the door assembly of the washing apparatus according to one embodiment of the present disclosure.

FIG. 3 is a perspective view of a door assembly of the washing apparatus according to one embodiment of the present disclosure and FIG. 4 is an exploded-perspective view of the door assembly of the washing apparatus according to one embodiment of the present disclosure. FIG. 5 is a perspective view of a coupling between a door and an auxiliary door in the door assembly according to one embodiment of the present disclosure.

As illustrated in FIG. 3, the door assembly 100 formed in the upper side of the body assembly 100*a* may include the door assembly housing 12, the main door 110, the auxiliary door 150 and the handle portion 190.

The opening 90 penetrating from the upper portion to the lower portion of the door assembly housing 12 may be formed in the door assembly housing 12, wherein the opening 90 may be formed in the center of the door assembly housing 12 or the periphery of the center of the door assembly housing 12. According to embodiments, for the user's convenience, the opening 90 may be formed inclined toward the front of the door assembly housing 12.

The seating portion 90*a* protruding along a circumference of the opening 90 may be formed inward of the opening 90 of the door assembly housing 12. The seating portion 90*a* may be provided to allow an auxiliary door extension portion 160 of the auxiliary door 150 to be placed therein. The auxiliary door extension portion 160 is seated on the seating portion 90*a* and thus the auxiliary door 150 is seated on the door assembly housing 12.

The auxiliary water supply port 340 discharging the washing water may be provided inward of the opening 90 of the door assembly housing 12. The auxiliary water supply port 340 may be communicated with the auxiliary water supply pipe 345 and allow the washing water supplied through the auxiliary water supply pipe 345 to be supplied to the inside of the container 152 of the auxiliary door 150. The washing water discharged from the auxiliary water supply port 340 may be supplied to the inside of the container 152 by passing through a washing water inlet 350 provided in the auxiliary door 150.

Figure 5:
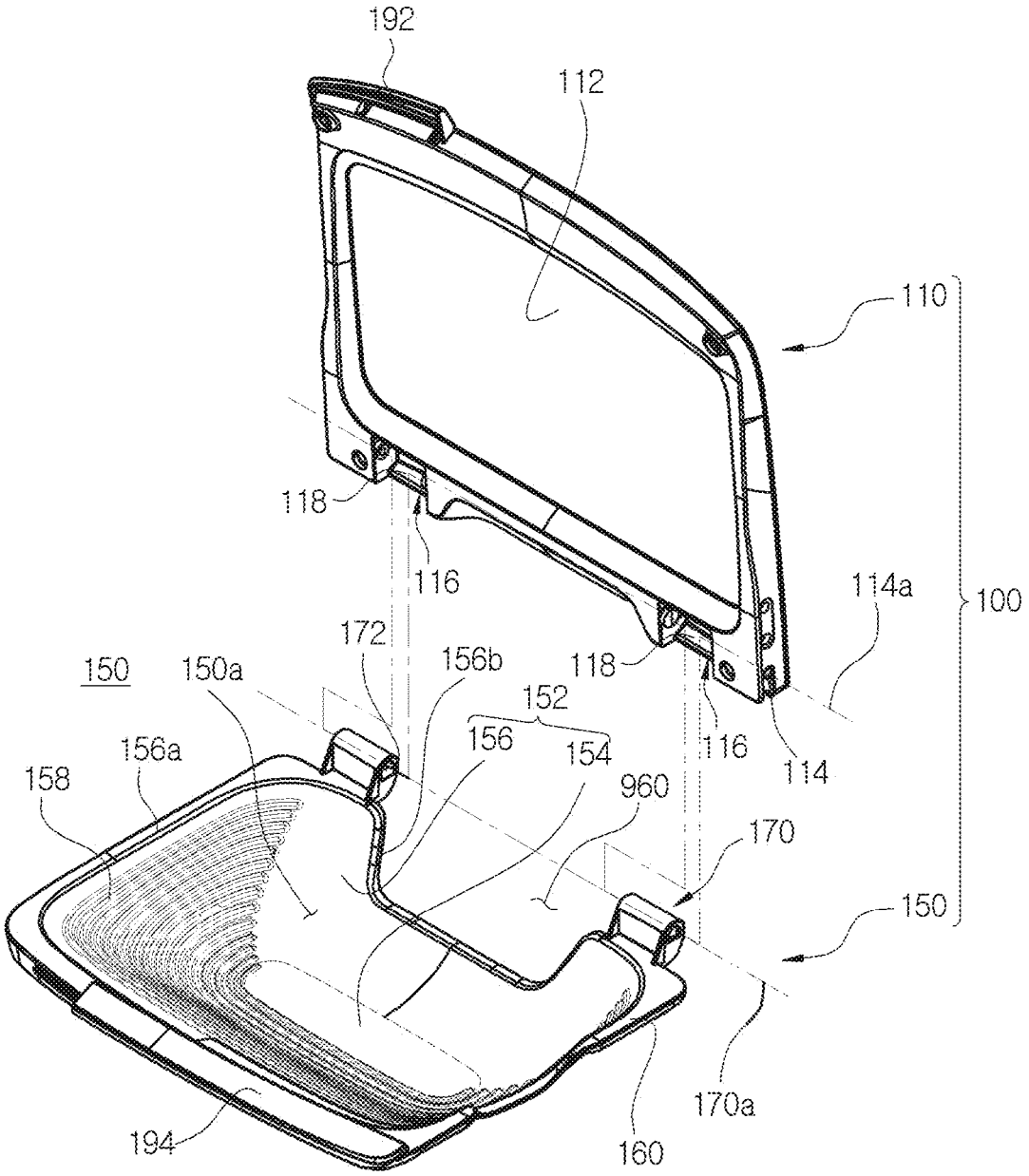
FIG. 5 is a perspective view of a coupling between a door and an auxiliary door in the door assembly according to one embodiment of the present disclosure.

Reference to FIGS. 4 and 5, the main door 110 may be openable and closable by rotating about a door rotational axis 114*a* on an upper surface of the door assembly housing 12, and the auxiliary door 150 may be openable and closable by rotating about an auxiliary rotational axis 170*a* inside of the main door 110. The rotational axis 114*a* and 170*a* of the main door 110 and the auxiliary door 150 may be identical to each other.

For example, since the rotational axis 114*a* and the auxiliary rotational axis 170*a* are disposed on the same side about the main door 110 and the auxiliary door 150, the main door 110 and the auxiliary door 150 may be opened and closed in the same direction. That is, since the rotational axis 114*a* and the auxiliary rotational axis 170*a* are disposed on the same axis, the rotational axis 114*a* and the auxiliary rotational axis 170*a* may be identical to each other.

For this, the main door 110 may be rotatably coupled to the door assembly housing 12 using a door rotation portion 110*a* provided in the door assembly housing 12 in the rotational axis 114*a*, and the auxiliary door 150 may be rotatably coupled to the main door 110 by an auxiliary rotation portion 170.

As illustrated in FIG. 4, the door rotation portion 110*a* may be implemented as a protrusion protruding in the direction of the opening 90 in the door assembly housing 12 so that the main door 110 is rotated with respect to the rotational axis 114*a* in the door assembly housing 12. In this case, an insertion groove 114 may be provided in the main door 110 and the door rotation portion 110*a* may be inserted into the body assembly housing 114 so that the main door 110 may be rotatably supported by the door assembly housing 12.

According to embodiments, a protrusion protruding in the direction of the rotational axis 114*a* may be provided in the side of the main door 110 and a groove shaped space may be provided in the door assembly housing 12. The protrusion provided in the side of the main door 110 may be inserted in to the space so that the main door 110 may be rotatably supported by the door assembly housing 12.

Hereinbefore a case in which the main door 110 is coupled to the door assembly housing 12 has been described, but the coupling structure is not limited thereto. In the main door 110 and the door assembly housing 12, other structure other than the above mentioned structure may be provided and thus the main door 110 may be rotatable about the door assembly housing 12.

One or more auxiliary door coupling portion 116 recessed to the inside on one side of the main door 110 may be formed in the main door 110, and one or more rotation protrusion 118 protruding in the direction of the auxiliary rotational axis 170*a* may be formed in the auxiliary door coupling portion 116.

In the auxiliary door 150, an auxiliary rotation portion 170 corresponding to the auxiliary door coupling portion 116 may be provided. According to one embodiment, the auxiliary rotation portion 170 may be protruded from the container 152 so that the auxiliary rotational axis 170*a* is separated from the container 152 by a certain distance. When the auxiliary rotation portion 170 has a protrusion shape, a radius of rotation of the auxiliary door 150 may be enlarged and thus the container 152 may be not interrupted by the main door 110 or the door assembly housing 12 when the auxiliary door 150 is rotated.

The auxiliary rotation portion 170 may be inserted into the auxiliary door coupling portion 116 so that the rotational axis 114*a* and the auxiliary rotational axis 170*a* are identical to each other. In this case, since the body assembly housing 118 is inserted into a rotation hole 172, the auxiliary door 150 may be rotatably coupled with respect to the auxiliary rotational axis 170*a*.

Hereinbefore a case in which the main door 110 and the auxiliary door 150 are rotatably coupled to each other by the auxiliary door coupling portion 116 and the auxiliary rotation portion 170 has been described but the shape and the arrangement of the coupling between the main door 110 and the auxiliary door 150 is not limited thereto. Therefore, the shape and the arrangement may be determined by a designer's selection. For example, a structure corresponding to the auxiliary door coupling portion 116 may be installed in the auxiliary door 150 and a structure corresponding to the auxiliary rotation portion 170 may be installed in the main door 110 so that the main door 110 and the auxiliary door 150 are rotatably coupled to each other.

Hereinbefore a case in which the main door 110 and the auxiliary door 150 are rotatably coupled to open and close the opening 90 has been described, but a structure of opening and closing the opening 90 by the main door 110 and the auxiliary door 150 is not limited thereto. For example, the main door 110 and the auxiliary door 150 are not coupled to each other but the main door 110 and the auxiliary door 150 may be rotatably installed in the door assembly housing 12, respectively. Alternatively, the main door 110 and the auxiliary door 150 may be configured to open and close the opening 90 using a variety of structures considered by a designer.

Hereinafter a door will be described in details.

Figure 6:
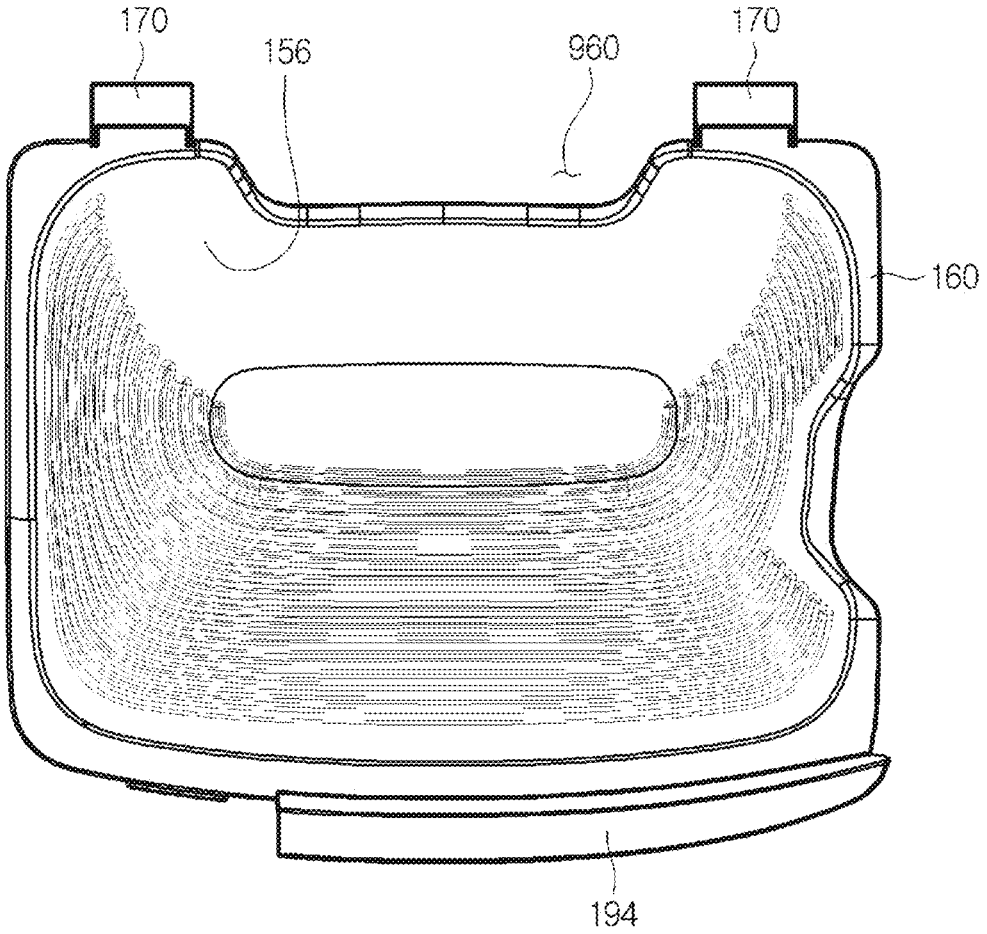
FIG. 6 is a plan view of the auxiliary door according to one embodiment of the present disclosure.
Figure 7:
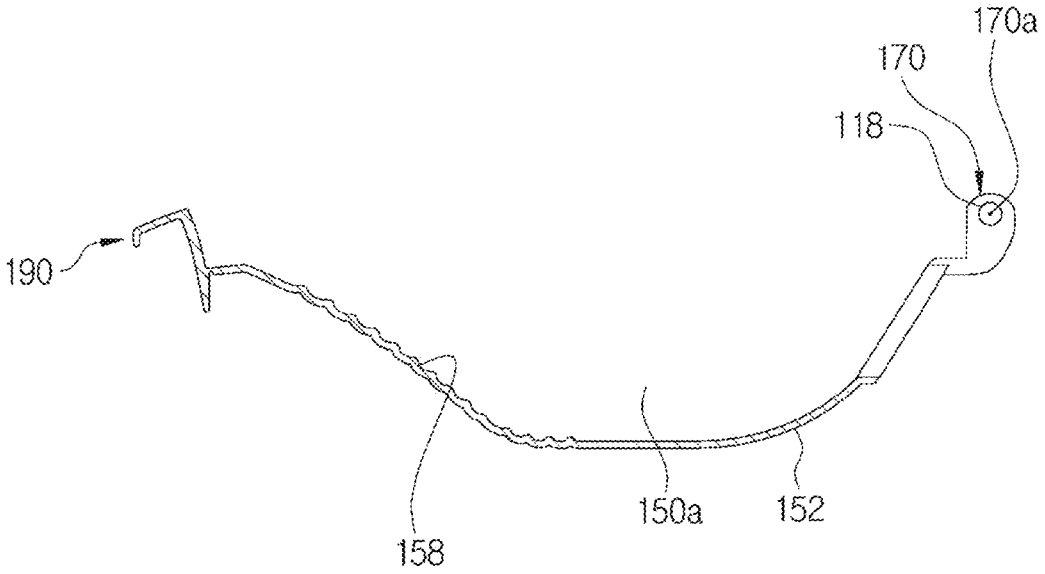
FIG. 7 is a side-sectional view of the auxiliary door according to one embodiment of the present disclosure.
Figure 8:
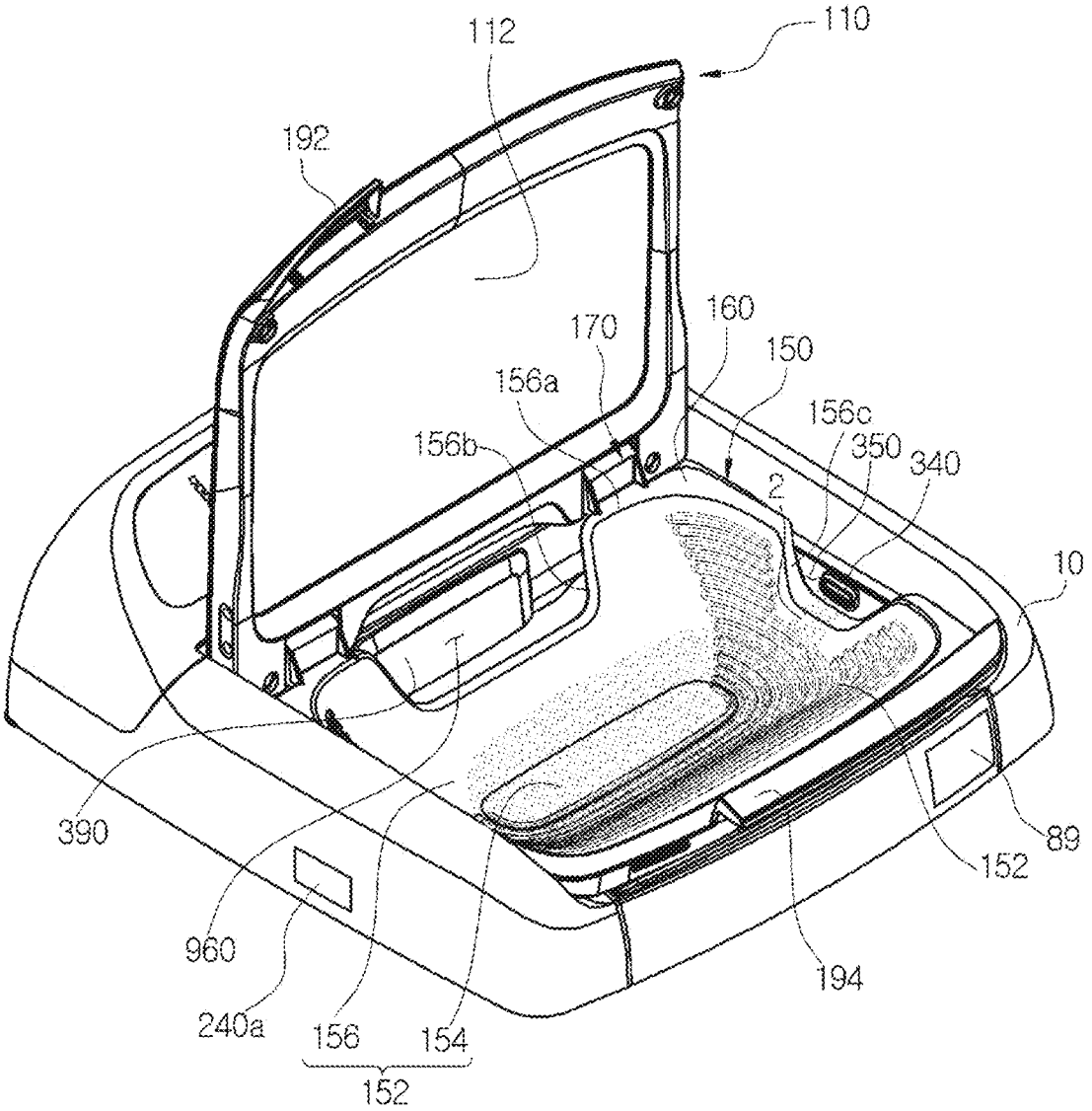
FIG. 8 is view of an example in which washing water is supplied to a container provided in the auxiliary door.

FIG. 6 is a plan view of the auxiliary door according to one embodiment of the present disclosure, and FIG. 7 is a side-sectional view of the auxiliary door according to one embodiment of the present disclosure. FIG. 8 is view of an example in which washing water is supplied to a container provided in the auxiliary door.

Referring to FIGS. 6 and 7, the auxiliary door 150 may include the container 152 and the auxiliary door extension portion 160.

The container 152 may form the auxiliary washing space 150*a* of the auxiliary door 150 and particularly, the container 152 may include a bottom 154 and a side surface 156 to form the auxiliary washing space 150*a*. The bottom 154 is a factor to determine a depth of the auxiliary washing space 150*a* and the bottom 154 may have a flat surface or a curved surface. The side surface 156 may be curved toward the bottom 154. The bottom 154 and the side surface 156 are provided to form a recessed auxiliary washing space 150*a* and to allow an additional washing to be performed by receiving washing water in the auxiliary washing space 150*a*

A friction protrusion 158 may be formed on at least one of the bottom 154 and the side surface 156 of the container 152, particularly the friction protrusion 158 may be formed convex upward in the side surface 156 of the auxiliary door 150. The friction protrusion 158 may improve the frictional force with the laundry at the time of hand laundry to help with removing contaminants in the laundry, thereby improving the user's convenience in hand laundry.

FIGS. 6 and 7 illustrate that the friction protrusion 158 is provided in the side surface 156 of the container 152, but the position of the friction protrusion 158 is not limited thereto. Therefore, the friction protrusion 158 may be provided in a variety of positions according to a designer's selection. The shape of the friction protrusion 158 is not limited to FIGS. 6 and 7, and thus the friction protrusion 158 may be formed in a variety of shapes.

According to embodiments, in the container 152, a friction groove may be provided instead of the friction protrusion 158 or a friction groove may be provided together with the friction protrusion 158. The friction groove may improve the frictional force with the laundry at the time of hand laundry, thereby improving the user's convenience in hand laundry.

On one side of the container 152, an auxiliary discharge port 960 may be provided. The auxiliary discharge port 960 may discharge the washing water used in the auxiliary washing space 150*a*. For example, when a large amount of washing water is supplied to the container 152 and thus a washing water level excesses a certain level, the auxiliary discharge port 960 may allow the excess washing water to be discharged. The discharged washing water may be put into the fixed tub 21 and the rotating tub 22. When the auxiliary door 150 is rotated and then inclined, the auxiliary discharge port 960 may be provided to allow washing water stored in the container 152 to be discharged to the fixed tub 21 and the rotating tub 22. When the auxiliary door 150 is rotated and then inclined, the auxiliary discharge port 960 may be provided to allow laundry as well as washing water stored in the container 152 to be discharged to the fixed tub 21 and the rotating tub 22.

The auxiliary discharge port 960 may be provided with a separate opening and closing member and then disposed on the bottom 154 of the auxiliary washing space 150*a* or on the side surface 156 of the container 152.

When the auxiliary discharge port 960 is provided in the side surface 156 of the container 152, the auxiliary discharge port 960 may be formed by concavely cutting a part of the side surface of the container 152 toward the bottom 154, as illustrated in FIGS. 6 and 7. In this case, in the container 152, the auxiliary discharge port 960 may be formed by a cut surface 156*b* of the auxiliary discharge port 960 lower than an upper end portion 156*a* of the container 152. The auxiliary discharge port 960 may have a variety of shapes according to a designer's selection.

The auxiliary discharge port 960 may have a variety of shapes as long as the auxiliary discharge port 960 allows washing water stored in the auxiliary washing space 150*a* to be discharged when the auxiliary door 150 is rotated and then inclined.

As illustrated in FIG. 8, the washing water inlet 350 may be installed in one side of the auxiliary door 150 to allow washing water 2 supplied from the auxiliary water supply port 340 to be introduced into the container 152 of the auxiliary door 150. In this case, in the auxiliary door 150, the washing water inlet 350 may be placed to correspond to the auxiliary water supply port 340.

As illustrated in FIGS. 6 and 7, the washing water inlet 350 may be formed by concavely cutting a part of the side surface of the container 152 toward the bottom 154. For example, the washing water inlet 350 may be implemented by an inlet periphery 156*c* lower than the upper end portion 156*a* of the container 152. FIGS. 6 and 7 illustrate an example of the washing water inlet 350 but the shape and position of the washing water inlet 350 is not limited thereto. The washing water inlet 350 may have a variety of shapes and be formed in a variety of positions as long as the washing water discharged from the auxiliary water supply port 340 is introduced into the auxiliary washing space 150*a* without interrupting by the container 152.

The auxiliary door extension portion 160 may be seated in the seating portion 90*a* of the door assembly housing 12. For example, the auxiliary door extension portion 160 may include a flat plate formed along a periphery in an upper end of the auxiliary door 150. An upper surface of the flat plate may be exposed in the upper and lower side and a bottom of the flat plate may be in contact with the upper end of the seating portion 90*a* so that the auxiliary door 150 may be stably mounted on the door assembly housing 12.

According to one embodiment, the auxiliary door 150 may be formed of synthetic resin, e.g., thermoplastic resin. In addition, the auxiliary door 150 may be formed of a variety of materials having impact resistance and rigidity required for the hand laundry.

The auxiliary handle portion 194 may be provided in the auxiliary door 150.

As illustrated in FIGS. 3 to 5, the door assembly 100 may include the handle portion 190. The handle portion 190 may include the door handle portion 192 provided in the main door 110 and the auxiliary handle portion 194 provided in the auxiliary door 150.

The door handle portion 192 may be provided on the other side of the main door 110 corresponding to the rotational axis 114*a* provided in one side of the main door 110, and the auxiliary handle portion 194 may be provided on the other side of the auxiliary door 150 corresponding to the auxiliary rotational axis 170*a* provided in one side of the auxiliary door 150.

The door handle portion 192 and the auxiliary handle portion 194 may be provided in parallel with each other in a width direction. The door handle portion 192 and the auxiliary handle portion 194 may be provided on a front portion of the main door 110 and the auxiliary door 150, respectively so as to rotate the main door 110 and the auxiliary door 150. By a movement of the door handle portion 192, the main door 110 may be rotated and by a movement of the auxiliary door 150, only the auxiliary door 150 may be rotated or the auxiliary door 150 and the main door 110 may be rotated.

When the door handle portion 192 is moved, the main door 110 may be rotated. In a state in which the main door 110 is opened when the auxiliary handle portion 194 is moved, the auxiliary door 150 may be rotated. In a state in which the main door 110 is closed, when the auxiliary handle portion 194 is moved, the main door 110 and the auxiliary door 150 may be rotated. In consideration with the weight of the main door 110 and the auxiliary door 150, a length of the auxiliary handle portion 194 may be longer than a length of the door handle portion 192.

Hereinafter a movement of the door assembly of the washing apparatus according to the above mentioned configuration will be described.

Hereinafter adjusting a position of the door assembly according to one embodiment will be described with reference to FIGS. 9 to 15.

Figure 9:
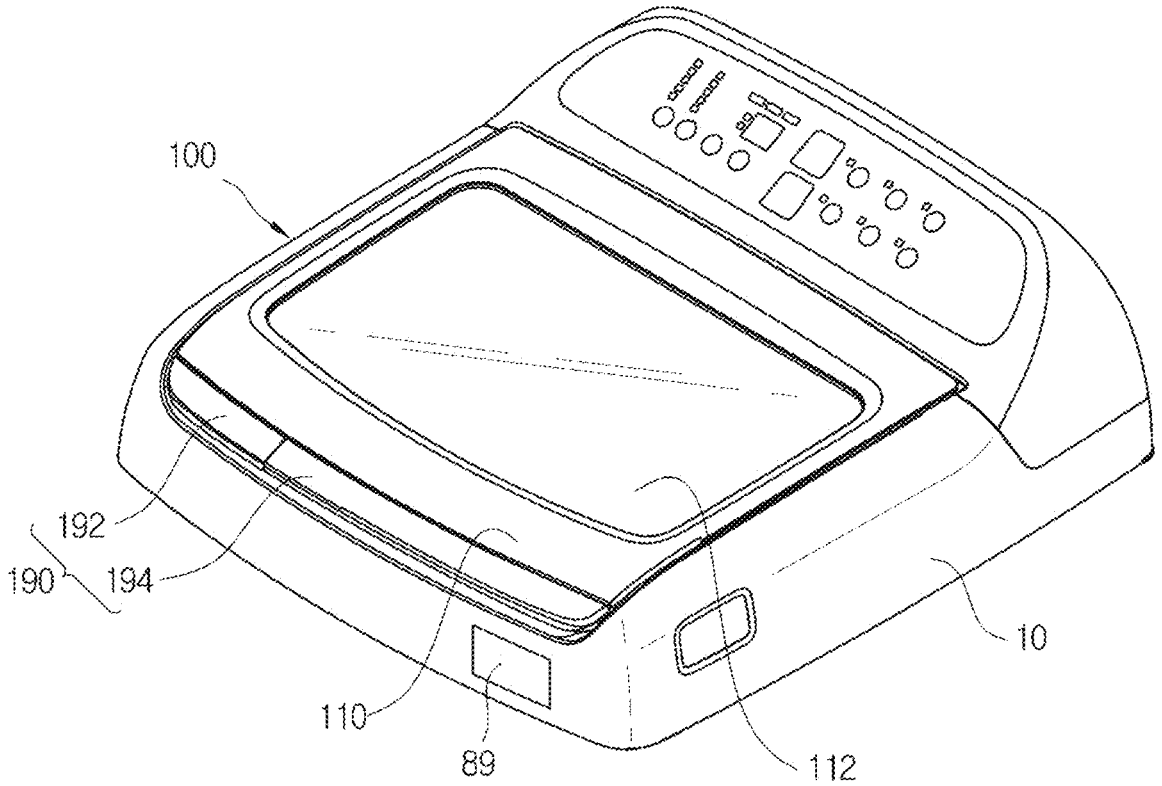
FIG. 9 is a perspective view of a state in which all doors in the door assembly are closed.
Figure 10:
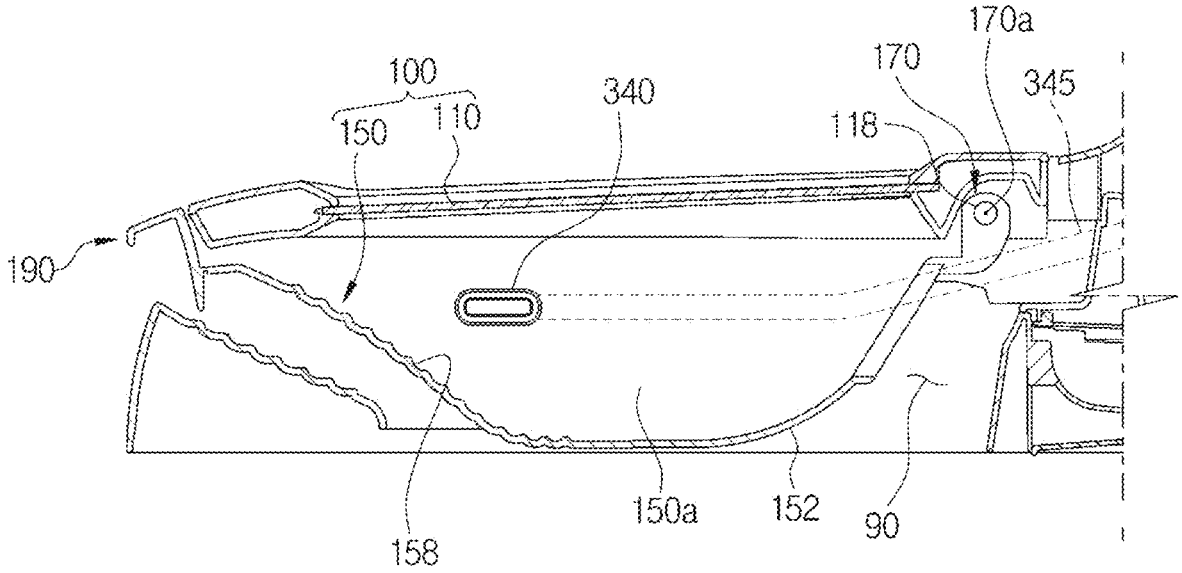
FIG. 10 is a side-sectional view of a state in which all doors are closed.

FIG. 9 is a perspective view of a state in which all doors in the door assembly are closed and FIG. 10 is a side-sectional view of a state in which all doors are closed.

The door assembly 100 may be operated in three states; a closed state, an auxiliary washing state and an open state, according to the movement of the handle portion 190.

As illustrated in FIGS. 9 and 10, the closed state represents a state of closing the opening 90 in which the main door 110 and the auxiliary door 150 may be disposed on the opening 90 so that the door assembly 100 closes the opening 90. In this case, the main door 110 and the auxiliary door 150 are disposed adjacent to each other while a normal line of an upper surface of the main door 110 and the auxiliary door 150 is toward the upper and lower side of the washing apparatus 1. In the closed state, a user may not perform the handy laundry in the auxiliary door 150 or may not put laundry into the inside of the rotating tub 22.

Figure 11:
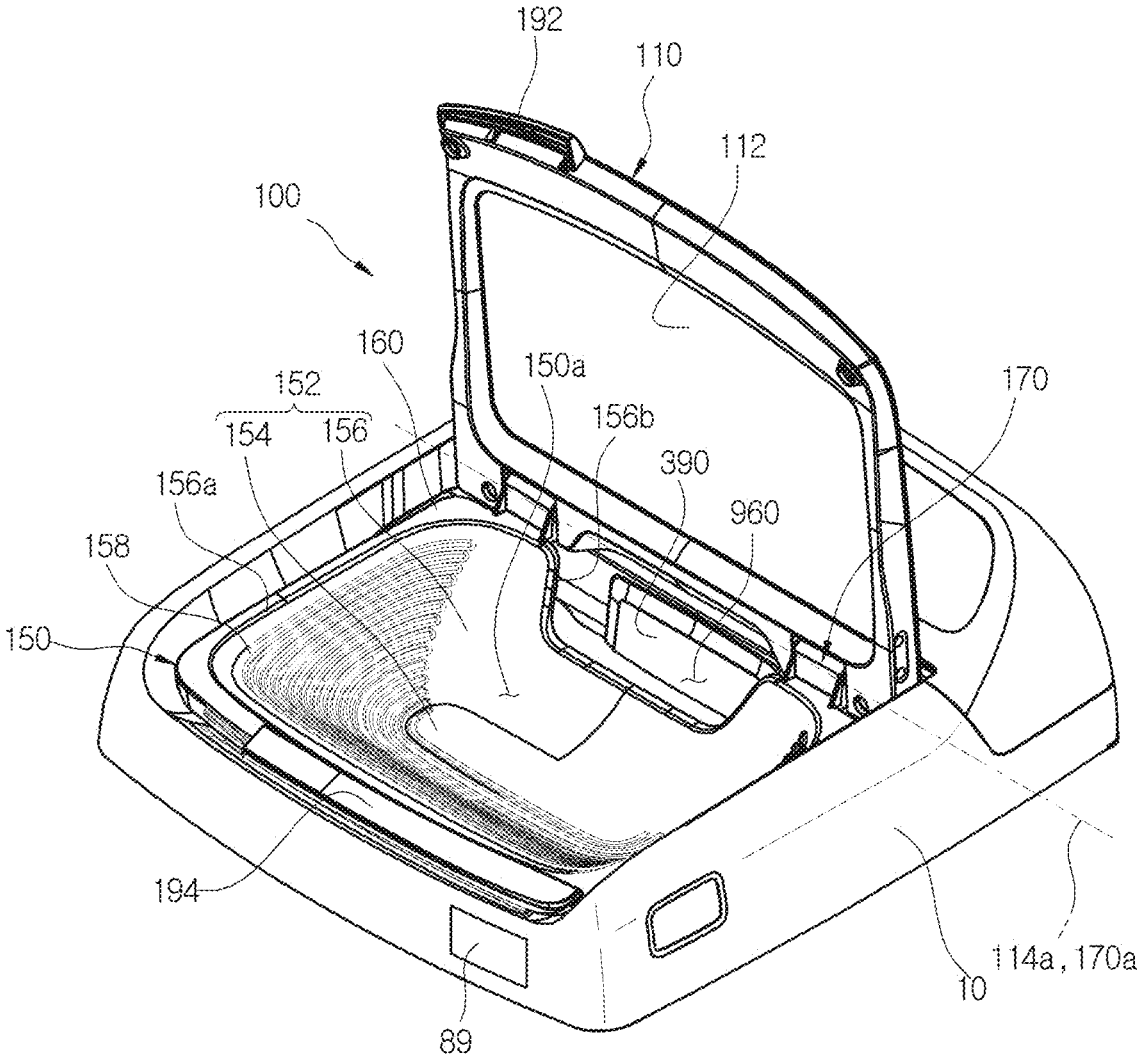
FIG. 11 is a perspective view of a state in which a door of the door assembly is open.
Figure 12:
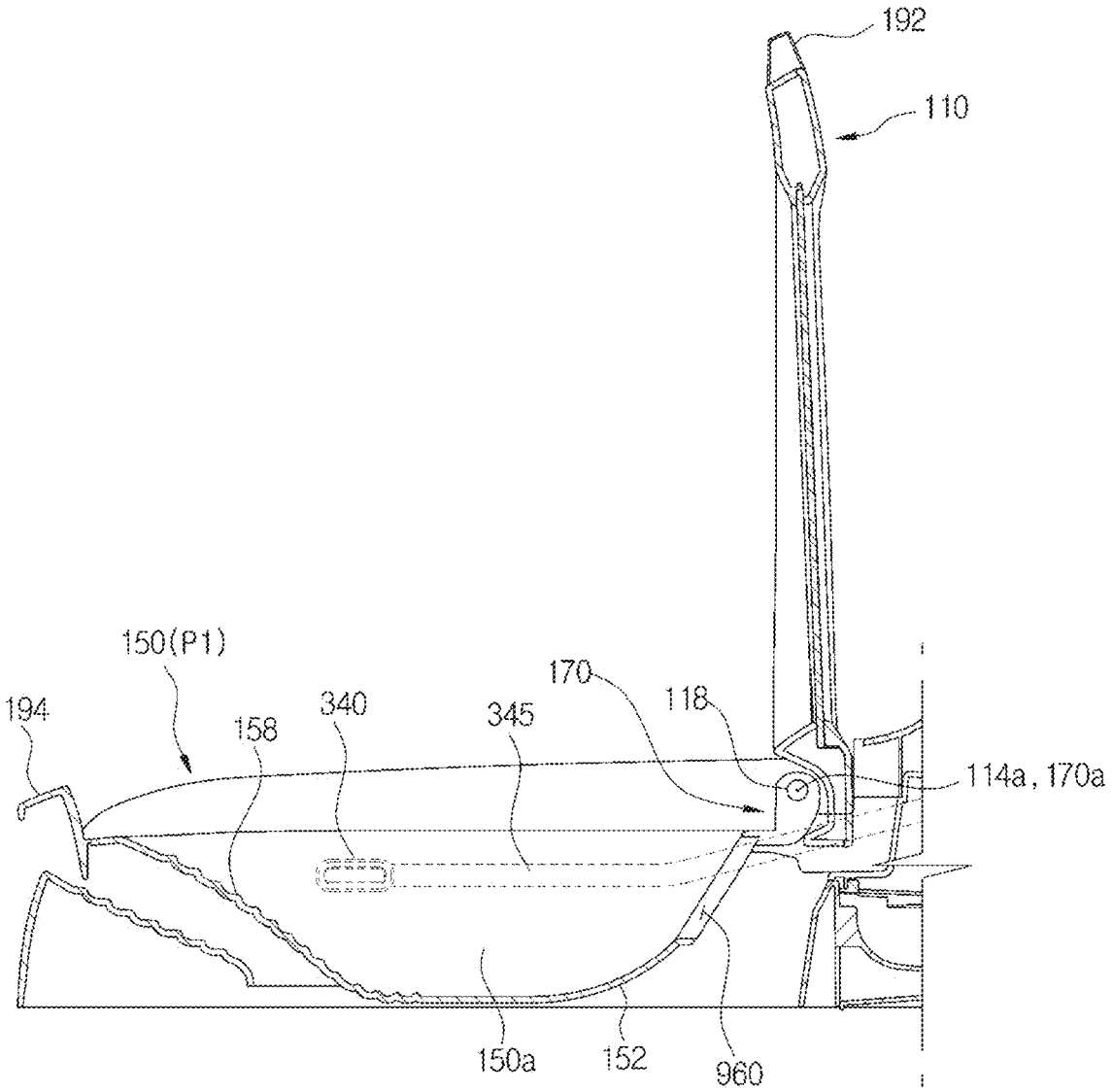
FIG. 12 is a side-sectional view of a state in which a door of the door assembly is open.
Figure 13:
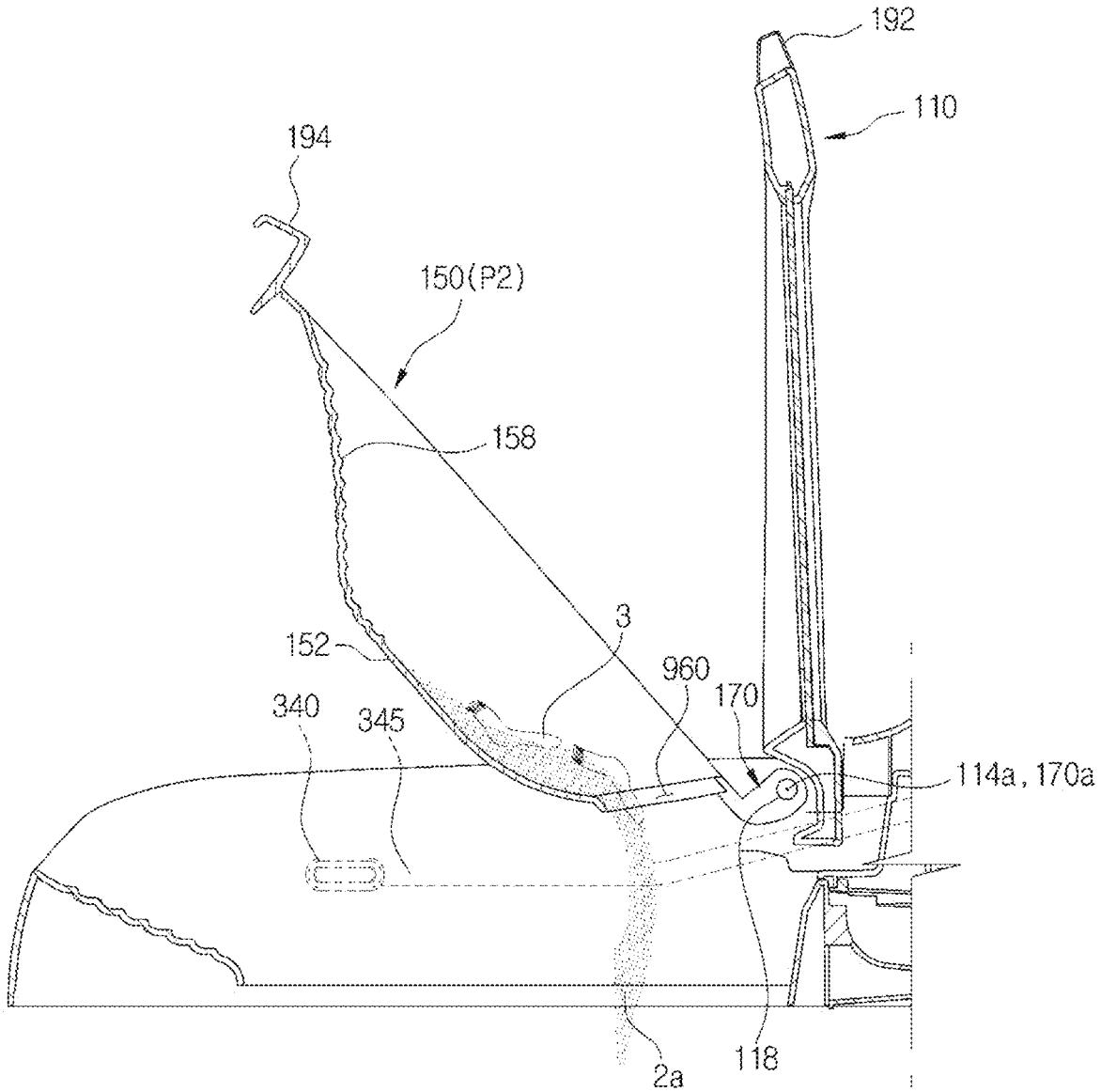
FIG. 13 is a side-sectional view of a state in which the auxiliary door of the door assembly is partially open.

FIG. 11 is a perspective view of a state in which a door of the door assembly is open and FIG. 12 is a side-sectional view of a state in which a door of the door assembly is open. FIG. 13 is a side-sectional view of a state in which the auxiliary door of the door assembly is partially open.

As illustrated in FIGS. 11 and 12, the auxiliary washing state represents a state of exposing the auxiliary door 150 to the outside by rotating the main door 110 from the closed state of the door assembly 100. In this case, the main door 110 and the auxiliary door 150 may be separated from each other.

In the auxiliary washing state, since the auxiliary door 150 having the container 152 is exposed to the outside, a user may perform the auxiliary washing, e.g., the hand laundry, in the container 152. In the auxiliary washing state, the auxiliary door 150 is seated in the seating portion 90*a* of the door assembly housing 12 without rotating, and thus the opening 90 may be almost closed except for an open portion by the auxiliary discharge port 960.

In the auxiliary washing state, when a user operates the auxiliary water supply input 89, washing water may be discharged from the auxiliary water supply port 340 and the user may perform the hand laundry by using the friction protrusion 158.

As illustrated in FIG. 13, in the auxiliary washing state, the auxiliary door 150 may be rotated in a certain angle range, and thus a part of the auxiliary door 150 may be opened. In this case, the washing water 2*a* in the container 152 may be moved to the auxiliary discharge port 960 due to the rotation of the auxiliary door 150 and the gravity and then put into the direction of the rotating tub 22, i.e., the lower direction, through the auxiliary discharge port 960. When the laundry 3 is present in the container 152, the laundry 3 may be put into the direction of the rotating tub 22, together with the washing water 2*a*.

Figure 14:
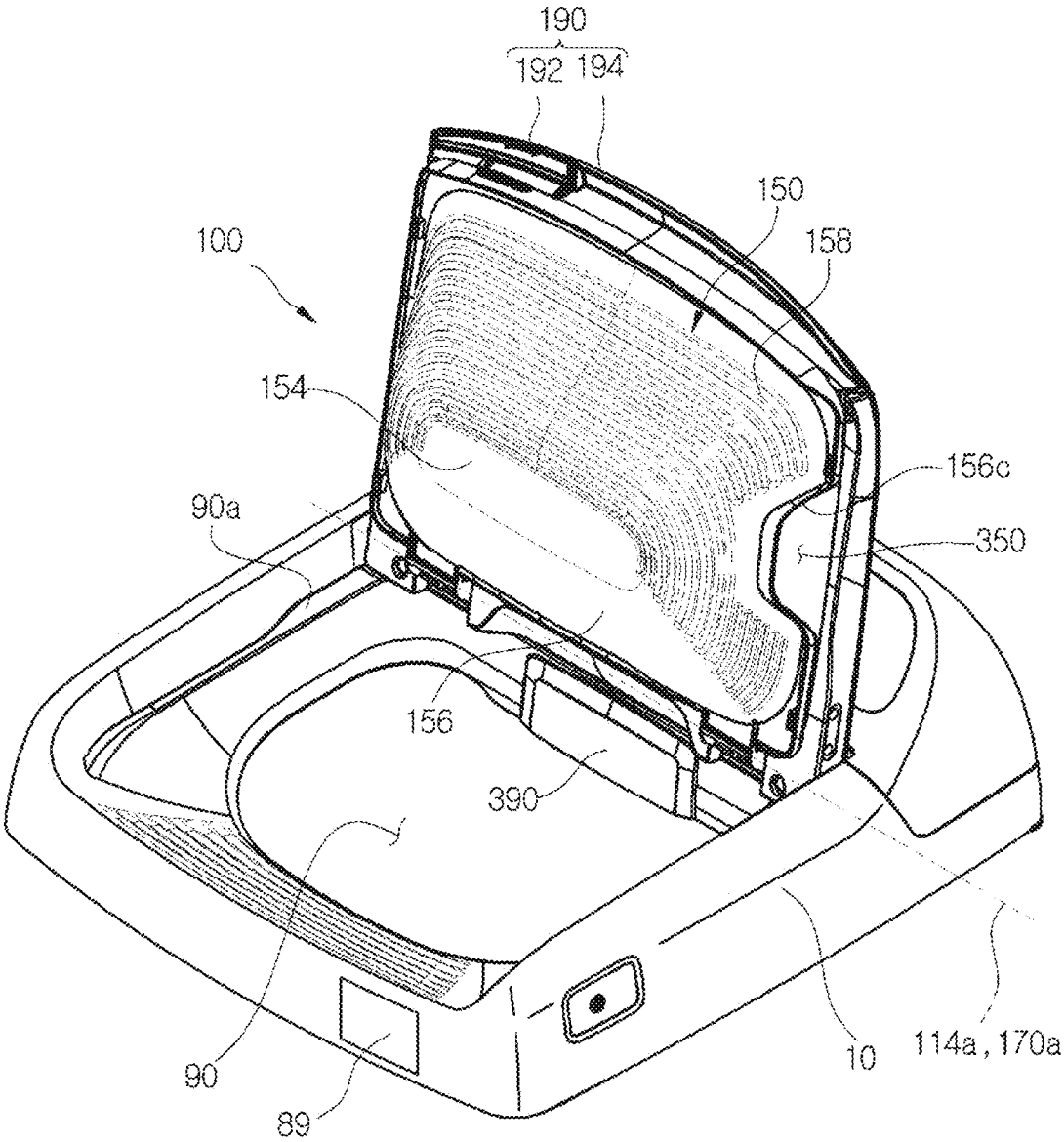
FIG. 14 is a perspective view of a state in which the door of the door assembly and the auxiliary door are open.
Figure 15:
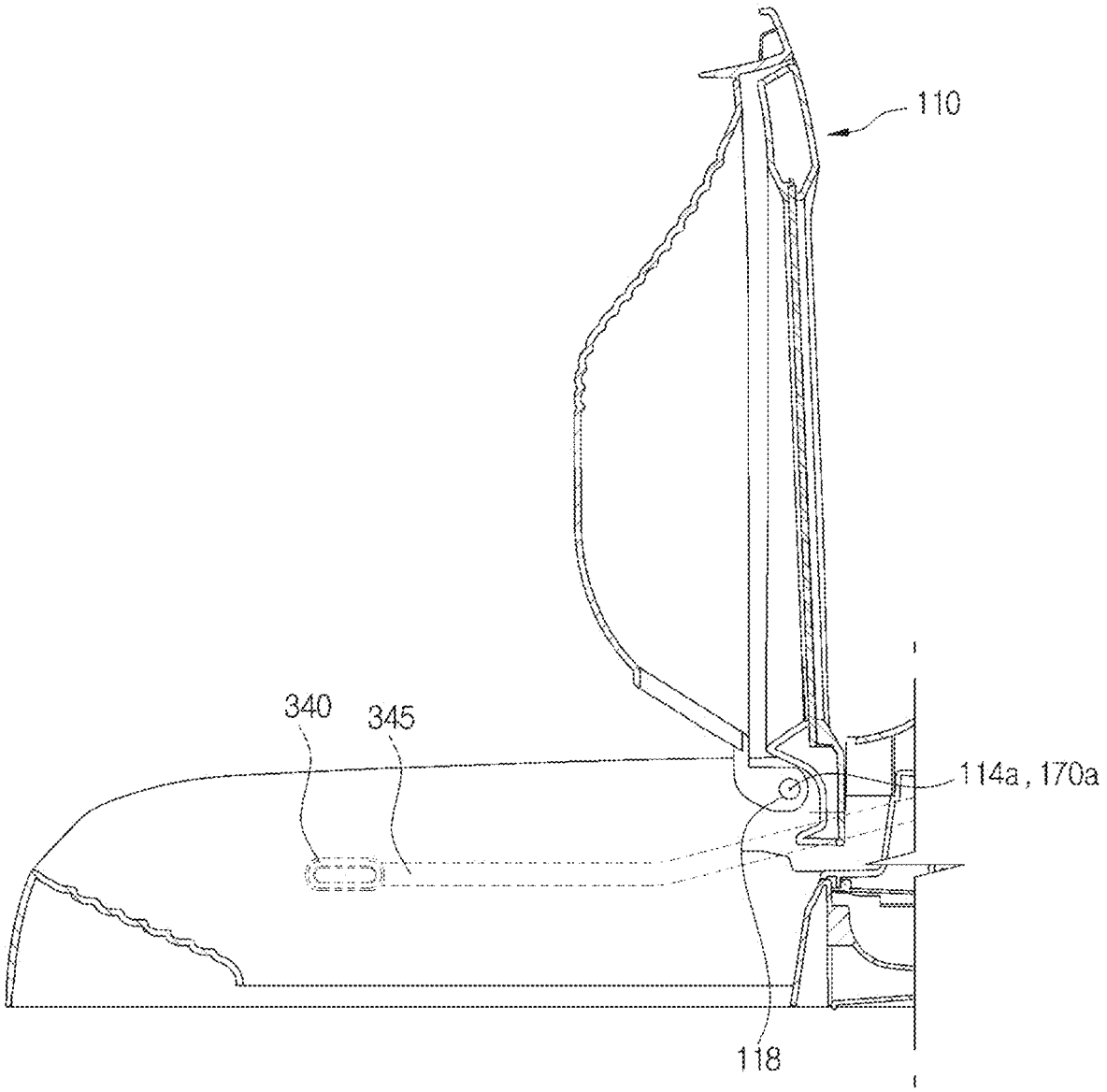
FIG. 15 is a side-sectional view of a state in which the door of the door assembly and the auxiliary door are open.

FIG. 14 is a perspective view of a state in which the door of the door assembly and the auxiliary door are open and FIG. 15 is a side-sectional view of a state in which the door of the door assembly and the auxiliary door are open.

As illustrated in FIG. 13, when the auxiliary door 150 already rotated in the certain angle range is rotated further, the auxiliary door 150 may be completely rotated like the main door 110, as illustrated in FIGS. 14 and 15. Accordingly, the door assembly 100 may be in the open state.

As illustrated in FIGS. 14 and 15, the open state represents a state of opening the opening 90 in which the main door 110 and the auxiliary door 150 may be rotated so that the opening 90 is opened. In this case, the main door 110 and the auxiliary door 150 are disposed adjacent to each other while the normal line of the upper surface of the main door 110 and the auxiliary door 150 is toward the rear side of the washing apparatus 1. In the open state, the main washing space 21*a* inside the rotating tub 22 may be exposed to the outside and thus a user may directly put the laundry into the inside of the rotating tub 22.

During a user rotates the auxiliary door 150 after the auxiliary washing is completed, the washing water 2*a* and the laundry 3 remained in the container 152 may be put into the direction of the rotating tub 22 through the auxiliary discharge port 960 in the open state.

The change in the states; the closed state, the auxiliary washing state, and the open state, may be performed by an operation of the handle portion 190 by a user. Particularly, the switch between the closed state and the auxiliary washing state may be performed by operating the door handle portion 192 and the switch between the closed state and the open state may be performed by operating the auxiliary handle portion 194.

As illustrated in FIG. 2, in the inside of the body assembly 100*a*, the washing unit 20, a driver 800 and a discharge portion 900 may be provided.

The washing unit 20 may perform a main washing cycle with laundry put into the main washing space 21*a* and as illustrated in FIG. 2, the washing unit 20 may include the fixed tub 21, the rotating tub 22, a balancer 24, the pulsator 29 and a suspension 25.

The washing tub 20*a* may be configured to wash laundry put into the main washing space 21*a* and particularly the washing tub 20*a* may be configured to perform a main washing cycle, a rinsing cycle, a spin-dry cycle. According to one embodiment, the washing tub 20*a* may include the fixed tub 21 and the rotating tub 22 for the washing of the laundry.

The fixed tub 21 may be formed in a shape of a cylinder in which an upper portion thereof is open and a lower portion thereof is closed. The fixed tub 21 may be provided in the outside of the rotating tub 22. The fixed tub 21 may retain washing water and detergents to help the washing cycle of the rotating tub 22. The fixed tub 21 may be supported by the body assembly housing 11 through the suspension 25.

The rotating tub 22 may be installed inside of the fixed tub 21 and formed in a shape of a cylinder having an upper portion thereof open. The main washing space 21*a* in which the laundry is placed may be formed inside of the rotating tub 22. A plurality of drainage holes 13 may be provided on the side surface of the rotating tub 22. The plurality of drainage holes 13 may pass through the outer surface of the rotating tub 22 to communicate the inner space of the rotating tub 22 with the inner space of the fixed tub 21. The rotating tub 22 may be configured to be rotated in at least one direction by the driver 800 provided in the lower side thereof.

The pulsator 29 may be installed on the bottom of the rotating tub 22 to be rotatable. A detail description of the pulsator 29 will be described later.

According to another embodiment, an agitator (not shown) having a cylindrical shape and having a blade on a side surface thereof may be installed in the rotating tub 22. In this case, the agitator may be installed such that an upper surface thereof is toward the opening 90 and a lower surface thereof is toward the bottom of the rotating tub 22. The lower surface of the agitator may be fixed to the bottom of the rotating tub 22 to be installed inside of the rotating tub 22. The agitator may be continuously and alternately rotated during the washing cycle and thus the blade formed in the side of the agitator may generate water current inside of the washing water when the agitator is rotated. The laundry inside of the rotating tub 22 may be washed by the water current generated by the blade.

The balancer 24 may be mounted to the upper side of the rotating tub 22 to offset the unbalanced load which is generated when the rotating tub 22 rotates at high speed, so as to ensure that the rotating tub 22 stably rotates.

The pulsator 29 may be installed on the lower portion of the rotating tub 22 to rotate in at least one of the forward direction and the reverse direction to generate water current (w1). "Forward direction" may be defined as any one direction between two directions in which the pulsator 29 is rotated, and "reverse direction" may be defined as an opposite direction to the forward direction. The forward direction and the reverse direction may be randomly determined between the rotation direction of the pulsator 29 according to a designer' selection.

According to one embodiment, the pulsator 29 may be rotated in the forward direction or the reverse direction. The pulsator 29 may be rotated in the forward direction, rotated in the reverse direction after a certain period of time, and then rotated in the forward direction again after a certain period of time. In other word, the pulsator 29 may be rotated by changing the rotation direction.

The laundry in the rotating tub 22 may be alternated with water according to the water current (w1) generated by the rotation of the pulsator 29.

Figure 16:
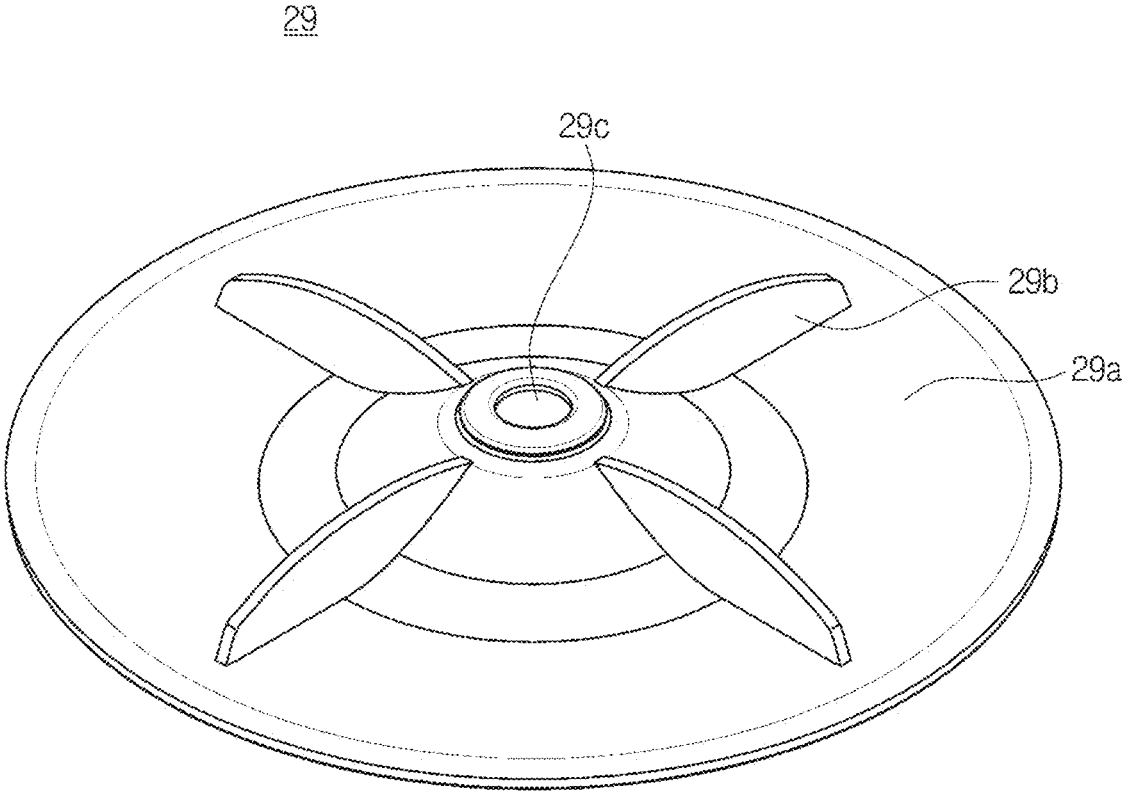
FIG. 16 is a view of an example of a pulsator.
Figure 17:
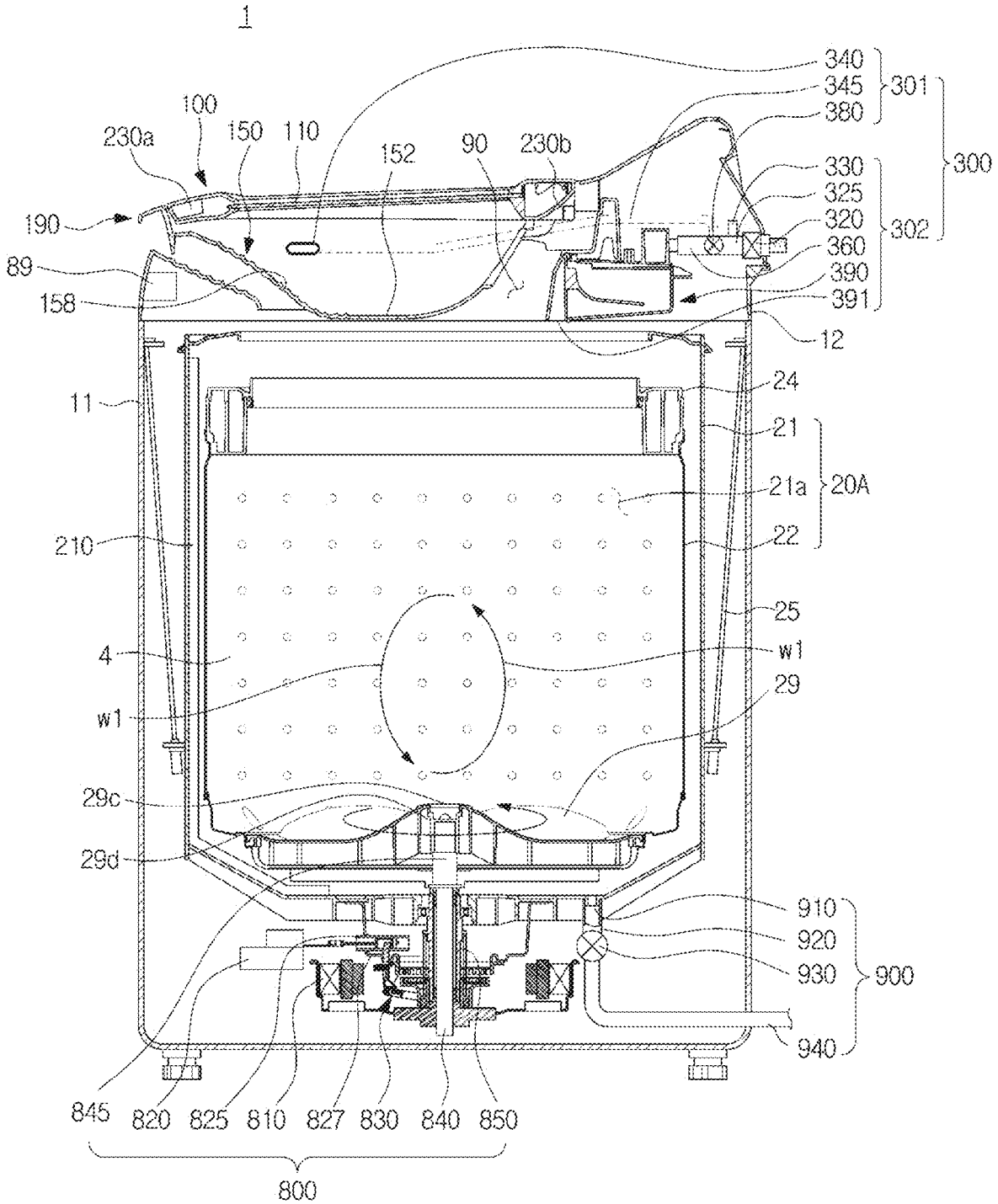
FIG. 17 is a view illustrating a vortex generated inside of a washing tub according to the rotation of the pulsator.

FIG. 16 is a view of an example of a pulsator and FIG. 17 is a view illustrating a vortex generated inside of a washing tub according to the rotation of the pulsator.

As illustrated in FIG. 16, the pulsator 29 may include a rotary plate 29*a*, a rotary fan 29*b*, and a rotary shaft coupling portion 29*c*.

According to one embodiment, the rotary plate 29*a* may have a circular plate to be rotated in at least one direction according to an operation of the driver 800. The rotary plate 29*a* may be rotated in a certain direction or alternately rotated in two directions according to the operation of the driver 800. One surface of the rotary plate 29*a* may be exposed to the main washing space 21*a* inside of the rotating tub 22 and the other surface of the rotary plate 29*a* may be directed to the bottom of the washing apparatus 1. In one surface of the rotary plate 29*a* exposed to the main washing space 21*a*, one or more rotary fan 29*b* may be provided.

The rotary fan 29*b* may be formed on one surface of the rotary plate 29*a* exposed to the main washing space 21*a* and rotated together with the rotary plate 29*a*. The rotary fan 29*b* may be fractionized with washing water in the main washing space 21*a* of the rotating tub 22 to generate the water current (w1) in the washing water, as illustrated in FIG. 17. According to one embodiment, the rotary fan 29*b* may be implemented as a protrusion convexly protruding toward the main washing space 21*a*, wherein the protrusion may be extended from the center of the rotary plate 29*a* to the edge of the rotary plate 29*a*. However, the shape of the rotary fan 29*b* is not limited thereto, and the rotary fan 29*b* may be formed in a variety of shapes according to a designer's selection.

The rotary shaft coupling portion 29*c* may be coupled to a washing shaft coupling portion 845 provided in a washing shaft 840 of the driver 800 and thus the rotary plate 29*a* and the rotary fan 29*b* may be rotated with the washing shaft coupling portion 845 according to the rotation of the washing shaft 840 according to the operation of a motor 810.

The suspension 25 may connect the fixed tub 21 to the inside of the body assembly housing 11 to prevent the fixed tub 21 from being moved above a certain level. The suspension 25 may be implemented using a metal wire.

The driver 800 may generate a driving force to transmit the driving force to the rotating tub 22 and the pulsator 29 so that the main washing cycle is performed in the rotating tub 22.

As illustrated in FIG. 2, the driver 800 may include the motor 810, a power conversion device 830, the washing shaft 840 and a hollow spin dry shaft 850.

The motor 810 and the power conversion device 830 may be installed at the outside of the lower side of the fixed tub 21.

The motor 810 generates the driving force to rotate at least one of the fixed tub 21 and the pulsator 29. The motor 810 may be implemented by an Alternating Current Motor (AC motor), or a Brush-less Direct Current Motor (BLDC Motor).

The power conversion device 830 may simultaneously or selectively transmit the driving force generated by the motor 810 to the rotating tub 22 and the pulsator 29. According to one embodiment, the power conversion device 830 may include an actuator 820 to generate driving force for the power conversion, a rod unit 825 to rectilinearly move according to movement of the actuator 820, and a clutch 827 connected to the rod unit 825 to be rotated according to movement of the rod unit 825. Therefore, the switch unit 380 may simultaneously or selectively transmit the driving force to the rotating tub 22 and the pulsator 29 according to the ascending or descending movement of the switch unit 380.

The washing shaft 840 may be installed in a hollow portion of the spin dry shaft 850 and the washing shaft 840 may be coupled to the pulsator 29 via the washing shaft coupling portion 845. The pulsator 29 may be rotated according to the rotation of the washing shaft 840. The washing shaft 840 may be rotated in a single direction or two directions about the shaft. Accordingly, the pulsator 29 may be rotated in a single direction or two directions.

The hollow spin dry shaft 850 may be coupled to the rotating tub 22 and the rotating tub 22 may be rotated according to the rotation of the hollow spin dry shaft 850. The hollow spin dry shaft 850 may be rotated in a single direction or two directions about the shaft. Accordingly, the rotating tub 22 may be rotated in a single direction or two directions.

The discharge portion 900 is a device to discharge washing water in the fixed tub 21.

As illustrated in FIG. 2, a discharge port 910 is formed at the bottom of the fixed tub 21 to discharge water in the fixed tub 21 to the outside, and one end of a first discharge pipe 920 is connected to the discharge port 910. According to embodiments, an inlet of a discharge valve 930 configured to regulate the discharge may be installed in the other end of the first discharge pipe 920. A second discharge pipe 940 configured to discharge washing water delivered from the first discharge pipe 920 may be installed in an outlet of the second discharge pipe 940.

Hereinafter the user interface 600 will be described in details.

Figure 18:
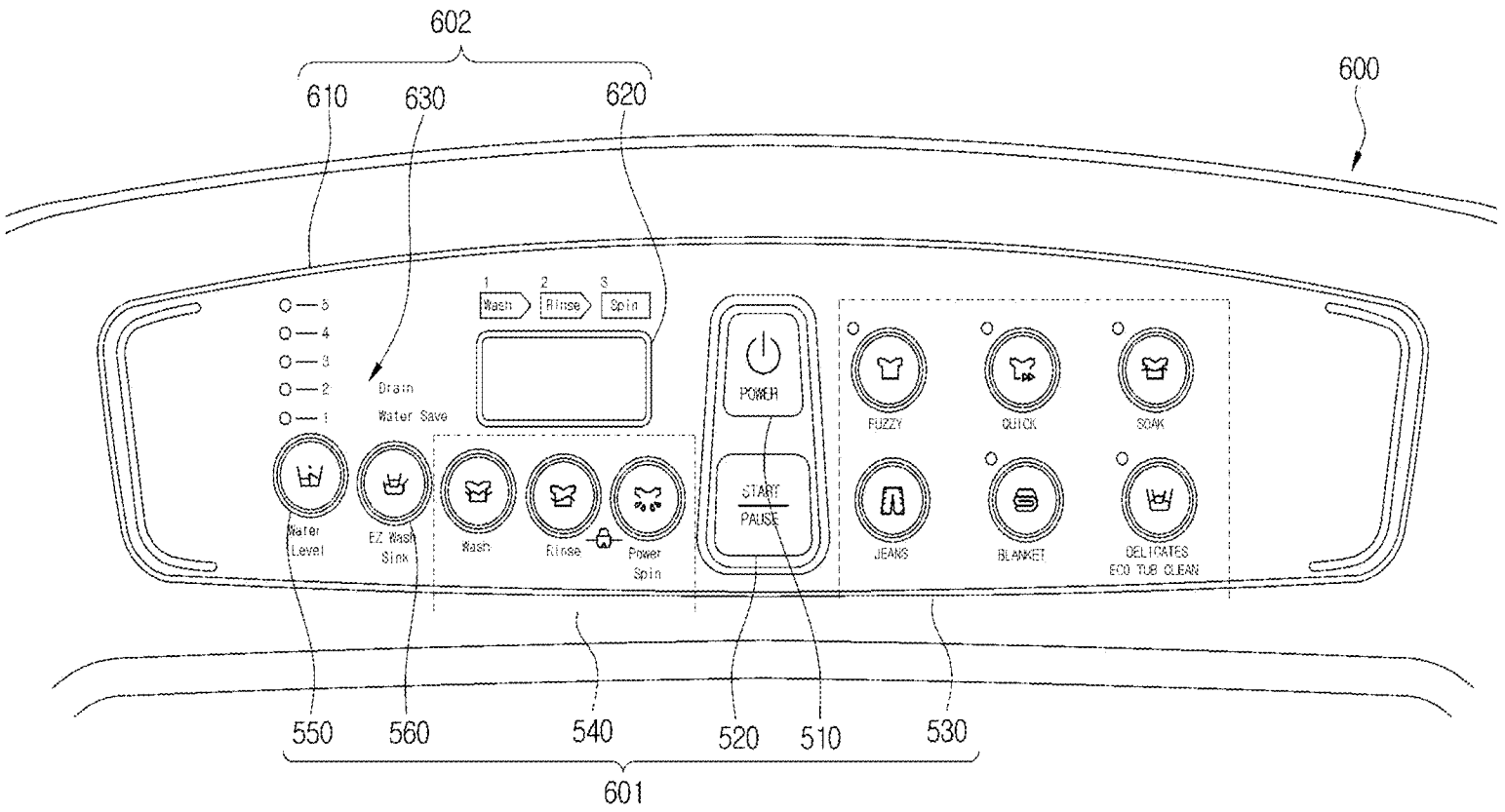
FIG. 18 is a view of a user interface according to one embodiment of the present disclosure.

FIG. 18 is a view of a user interface according to one embodiment of the present disclosure.

The user interface 600 may be disposed in a position e.g., an upper portion of the door assembly 100 of the washing apparatus 1, for the user's ease operation. The user interface 600 may include an input 601 receiving a command by a user and an information provider 602 providing a variety of information to a user.

The input 601 may include a power button 510 receiving a power ON and OFF command, a start/stop button 520 receiving a washing cycle start and pause command, a washing mode selection button 530 receiving a washing mode selection command, a cycle selection button 540 receiving a command for selecting type of washing cycle, a water level selection button 550 a receiving a command related to a water level of supplied washing water and a drain button 560 receiving a drain command.

When the power button 510 is operated, the power may be supplied to the washing apparatus 1 to perform a main function of the washing apparatus 1, and the washing apparatus 1 may be ready to start an operation in response to a user's command. Standby power may be supplied to the washing apparatus 1 before the power button 510 is operated and when a user operates the power button 510, the power button 510 may output an electrical signal corresponding to the power button 510 and transmit the electrical signal to the power source or the controller 400. In this case, the power button 510 may generate the electrical signal by using the standby power supplied to the washing apparatus 1.

When the start/stop button 520 is operated, at least one of a variety of cycles performed inside of the washing tub 20*a* may be started or temporarily stopped. For example, when the start/stop button 520 is operated, the main washing cycle may be performed inside of the washing tub 20*a*. In the stop state, when the start/stop button 520 is operated, the motor 810 may be driven according to the applied power and at least one of the rotating tub 22 and the pulsator 29 may start to rotate according to the drive of the motor 810, thereby starting the washing cycle.

When the washing mode selection button 530 is operated, the washing cycle may be performed according to the selected washing mode. The washing mode may vary according to the type of the laundry.

The cycle selection button 540 may allow a user to manually select any one of a variety of cycles performed by the washing tub 20*a* of the washing apparatus 1, wherein the variety of cycles performed by the washing apparatus 1 may include at least one of the main washing cycle, the rinsing cycle, and the spin-dry cycle.

When the water level selection button 550 is operated, a water level in the washing tub 20*a* of the washing apparatus 1 may be automatically determined and the controller 400 may control the water supply valve 320 and the switch unit 380 so that washing water is supplied to the inside of the washing tub 20*a* according to the determined water level. A water level display 610 may be provided around the water level selection button 550 to display the determined water level.

When the drain button 560 is operated, the discharge portion 900 may be controlled by the controller 400 so that washing water in the washing tub 20*a* is discharged to the outside.

The information provider 602 may visually provide information on the control states or the operation states of the washing apparatus 1 to a user.

Particularly, the information provider 602 may provide various kinds of information related to the washing process of the laundry 3 to a user in a visual or audible output. For example, the information provider 602 may visually display a detection result of a dry laundry weight or a detection result of a wet laundry weight. In this case, an image display 620 may display the weight of the laundry 3 according to the detection result of the dry laundry weight or the weight of the laundry 3 according to the detection result of the wet laundry weight, as the figures so as to visually display the detection result of the dry laundry weight or the detection result of the wet laundry weight.

The information provider 602 may provide the various kind of information related to the operation of the washing apparatus 1, e.g., whether to detect the dry laundry weight, whether to detect the wet laundry weight, or whether to supply washing water 4 to the inside of the washing tub 20*a*, to a user.

The information provider 602 may include the water level display 610 displaying the determined water level, the image display 620 displaying a variety of information using a variety of images, e.g., pictures, graphics, symbols or characters and a drain information display 630 displaying whether the drain command is input or not. The water level display 610, the image display 620 and the drain information display 630 may be omitted depending on embodiments.

The water level display 610 and the drain information display 630 may be implemented using a variety of lights, wherein the luminaire may include a light emitting diode (LED).

The image display 620 may be implemented using various display means. For example, the image display 620 may be implemented using a cathode ray tube (CRT), or a display panel. The display panel may include a variety of display panels configured to display a predetermined character, symbol or picture, e.g., a liquid crystal display (LCD) panel, a light emitting diode (LED) display panel, an organic light emitting diode (OLED) display panel, an active matrix organic light emitting diode display panel or a cold cathode fluorescent lamp.

In addition, the information provider 602 may further include a variety of display means to provide a various information related to the washing, to a user and a sound output unit (not shown) to provide the information in a voice or sound manner.

Hereinafter a control flow of the washing apparatus 1 according to one embodiment will be described with reference to FIG. 19.

Figure 19:
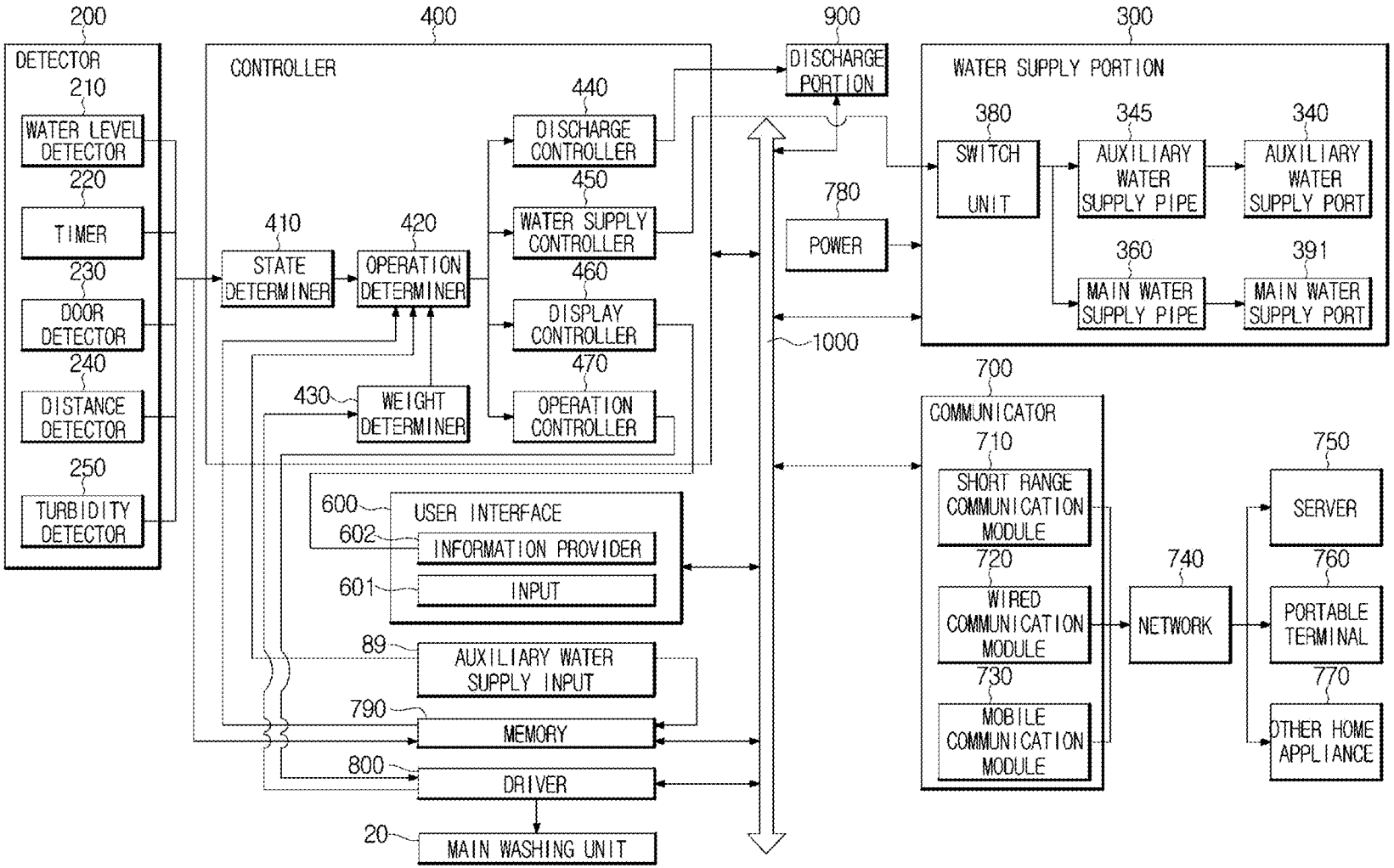
FIG. 19 is a block diagram of the washing apparatus according to one embodiment of the present disclosure.

FIG. 19 is a block diagram of the washing apparatus according to one embodiment of the present disclosure.

According to one embodiment, as illustrated in FIG. 19, the washing apparatus 1 may include a detector 200, the water supply portion 300, the controller 400, the user interface 600, a communicator 700, a power 780, a memory 790, the driver 800 and the discharge portion 900.

The detector 200 is a device to detect operation states or ambient conditions of the washing apparatus 1 to output an electrical signal corresponding to a detection result.

Particularly, the detector 200 may include at least one of a water level detector 210 to detect a water level of remaining water inside of the fixed tub 21, a timer 220 to detect an auxiliary washing input time and an auxiliary water supply time, a door detector 230 to detect whether the main door 110 is opened or closed, a distance detector 240 to detect a distance between users and the washing apparatus 1, and a turbidity detector 250 to detect a turbidity of the washing water.

The water level detector 210 may be provided inside of the fixed tub 21 to detect a water level of remaining water inside of the fixed tub 21. Particularly, the water level detector 210 may include a waterway on the lower surface of the inside of the fixed tub 21 so that remaining water of the fixed tub 21 is introduced. The water level of remaining water of the fixed tub 21 may be the same as the water level of remaining water of the water way. In this case, the pressure of the internal air, which is present above the remaining water in the water way of the water level detector 210, may be measured and thus the water level corresponding to the internal air pressure may be calculated.

The water level detector 210 may detect water level of remaining water inside of the fixed tub 21 by using a mechanical water level detection method, a water level detection method using a semiconductor pressure sensor, a water level detection method using capacitance.

Hereinafter the mechanical water level detection method will be described.

When a water level is raised due to water supplied to the inside of the fixed tub 21 of the washing apparatus 1, an air pressure between a water surface of the waterway and the water level detection apparatus is increased. The increased air pressure pushes a diaphragm of the mechanical water level detection apparatus upward, and then the diaphragm pushes a core upward. A magnetic flux density value is varied by interaction between the core and a bobbin surrounding the core. The magnetic flux density value resonates together with a capacitance value in an operating circuit and is output as an electrical signal of a frequency. An output frequency value is varied due to the magnetic flux density value varied according to the water level, and thus the water level within the fixed tub 21 may be determined. In this case, the determination of the water level of the remaining water in the fixed tub 21 may be performed by a state determiner 410.

Hereinafter the water level detection method using a semiconductor pressure sensor will be described.

The semiconductor pressure sensor includes a diaphragm to which a strain gauge is attached. In the same manner as the mechanical water level detection apparatus, the diaphragm is deformed according to the variation of an air pressure and the strain gauge measures such deformation of the diaphragm, thereby measuring a water level of remaining water in the fixed tub 21. The strain gauge may output an electrical signal corresponding to the measured deformation of the diaphragm and the output electrical signal may be transmitted to the state determiner 410. Accordingly, the state determiner 410 may analyze the output electrical signal and determine the water level of the remaining water in the fixed tub 21.

Hereinafter the water level detection method capacitance will be described.

A plurality of water level sensors may be provided on the side surface of the inside of the fixed tub 21 in a such way that the plurality of water level sensors are disposed in the lower surface of the fixed tub 21 toward the upper surface of the fixed tub 21. The plurality of water level sensors may include a plurality of electrodes. Capacitance among the plurality of electrodes of the water level sensors may be changed according to the water level and thus it may be possible to detect the water level by measuring the changed capacitance. Particularly, a plurality of electrode-dielectrics may be formed of air and water and thus the capacitance of the dielectrics may be changed according to a ratio between air and remaining water. Therefore, it may be possible to determine the water level in the fixed tub 21 using the changed capacitance. As mentioned above, the water level detector 210 may output an electrical signal according to the capacitance among the plurality of electrodes and thus the state determiner 410 may determine the water level of the remaining water of the fixed tub 21 by analyzing the output electrical signal.

In addition, through various water level detection methods, the water level detector 210 may determine the water level of the remaining water of the fixed tub 21, and thus the state determiner 410 may determine the water level of remaining water in the fixed tub 21.

The timer 220 may detect an auxiliary washing start signal input time and an auxiliary water supply time by the input 601. The timer 220 may be a relay, such as a synchronize motor type, and a transistor type, having a contact point in which a circuit is opened or closed by receiving the input signal after setting time is expired.

The door detector 230 is a device to provide a signal, which is used to control an auxiliary water supply, by detecting whether the main door 110 is opened or closed. The door detector 230 may include a reed switch 230*a* and a checker switch 230*b*.

The reed switch 230*a* may detect whether the main door 110 is opened or closed, according to magnetic field intensity detected by the reed switch 230*a* by detecting magnetic provided on the handle portion 190. Particularly, when the magnetic field intensity detected by the reed switch 230*a* is equal to or more than a predetermined value, the main door 110 may be determined to be closed, and when the magnetic field intensity detected by the reed switch 230*a* is less than the predetermined value, the main door 110 may be determined to be opened.

The checker switch 230*b* may include a body unit and a door detection lever to detect opening of the main door 110 by contacting with the main door 110.

The body unit is provided on the door rotational axis 114*a*, and a switch is embedded in the body unit. The switch generates control signals by being turned on or off by the door detection lever. An electrode terminal is installed at one portion of the body unit to deliver the control signal generated on the switch to the controller 400 by being connected to the switch.

The door detection lever is extended from the side surface of the body unit and the end portion of thereof is in contact with one side of the main door 110. The door detection lever turns on or off the switch installed on the body unit by rotating upward and downward when the main door 110 is opened or closed.

The distance detector 240 is provided on the upper portion of the body assembly housing 11 or the door assembly housing 12 to detect a distance between users and the washing apparatus 1. For example, the distance detector 240 may be installed on the right and left side surface, and the front surface of the washing apparatus 1 to detect a distance between users, and the right and left side surface and the front surface of the washing apparatus 1.

Particularly, the distance detector 240 radiates infrared light and ultrasonic waves and detects a return time or the intensity of the reflected light or echo ultrasonic waves, thereby detecting a distance between the user and the washing apparatus 1. The distance detector 240 may employ an ultrasonic sensor and an infrared light sensor. In addition, the distance detector 240 may employ various sensors to measure the distance between the user and the washing apparatus 1.

The turbidity detector 250 may detect the turbidity of the washing water to determine degree of contamination of the washing water. Accordingly, a user may determine whether to use washing water, which is previously used for the auxiliary washing, for the main washing, according to the degree of contamination of the washing water.

The water supply portion 300 may receive a control signal of the controller 400 and supply at least one of the washing water and the detergents to the auxiliary door 150 and the washing unit 20 in response to the received control signal.

As mentioned above, the water supply portion 300 may include the switch unit 380, the auxiliary water supply pipe 345, the auxiliary water supply port 340, the main water supply pipe 360, and the main water supply port 391.

The water supply unit 300 may supply water to the container 152 of the auxiliary door 150 or the main washing unit 20 by driving the switch unit 380 in response to the control signal of the controller 400.

When supplying water to the container 152 of the auxiliary door 150, the water supply portion 300 may supply only the washing water or mixed water in which the washing water and the detergents are mixed.

A description of the water supply portion 300 has been described, and thus a detail description thereof will be omitted.

The controller 400 may control an overall operation of the washing apparatus 1. The controller 400 may receive various information related to the operation of the washing apparatus 1 from the washing unit 200, or read out the various information from the memory 790 and then the controller 400 may control the operation of the washing apparatus 1 based on the received or read information.

The controller 400 may include a processor implemented in a hardware or software manner, wherein the processor may include a central processing unit (CPU) or a micro controller unit (MCU). The processor may be implemented by one or more semiconductor chips or a circuit and a related component connected to a semiconductor.

Referring to FIG. 19, the controller 400 may include a state determiner 410, an operation determiner 420, a weight determiner 430, a discharge controller 440, a water supply controller 450, a display controller 460, and an operation controller 470. According to embodiments, some components among the state determiner 410 to the operation controller 470 may be omitted.

According to one embodiment, the state determiner 410, the operation determiner 420, the weight determiner 430, the discharge controller 440, the water supply controller 450, the display controller 460, and the operation controller 470 may be implemented by a single semiconductor or two or more semiconductors. According to another embodiment, the state determiner 410, the operation determiner 420, the weight determiner 430, the discharge controller 440, the water supply controller 450, the display controller 460, and the operation controller 470 may be implemented by a single semiconductor, respectively. Alternatively, the state determiner 410, the operation determiner 420, the weight determiner 430, the discharge controller 440, the water supply controller 450, the display controller 460, and the operation controller 470 may be implemented by using a variety of method by a designer's selection.

The state determiner 410 may receive information related to a water level of remaining water inside of the fixed tub 21, an input time of an auxiliary washing start signal, an auxiliary water supply time, whether the main door 110 is opened or closed, a distance between a user and the washing apparatus 1, and whether to operate the auxiliary water supply input 89, all of which are detected by the detector 200, and then determine a current state of the washing apparatus 1 based on the received information. In this case, the state determiner 410 may receive an auxiliary washing start signal, an auxiliary washing completion signal, and a cleaning signal the auxiliary door 150 and washing water re-use signal all of which are input through the input 601 from a user, and then determine a current washing state.

The operation determiner 420 may determine an operation to be performed by the washing apparatus 1. In this case, the operation determiner 420 may generate a control signal or data based on the state determined by the state determiner 410 and the weight of the laundry detected by the weight determiner 430 so that at least one of the washing water supply portion 300, the user interface 600, the driver 800 and the discharge portion 900 is controlled. Particularly, the operation determiner 420 generate a control signal or data based on a result determined by the state determiner 410 or the weight determiner 430 and transmit the control signal to at least one of the discharge controller 440, the water supply controller 450, the display controller 460 and the operation controller 470, thereby allowing a variety of components of the above mentioned washing apparatus 1 to perform a certain operation.

Hereinafter detecting or measuring the weight of laundry in the washing tub 20*a* according to one embodiment will be briefly described.

The state determiner 410 may determine whether hand laundry or pre-washing has been performed or not in the container 152 of the auxiliary door 150.

According to one embodiment, the state determiner 410 may receive information related to whether to operate the auxiliary water supply input 89, from the memory 790, and determine whether hand laundry or pre-washing has been performed or not, based on the received information. Particularly, when it is determined that the auxiliary water supply input 89 is operated based on a result of analyzing the information transmitted from the memory 790, the state determiner 410 may determine that the hand laundry or pre-washing has been performed, and when it is determined that the auxiliary water supply input 89 is not operated, the state determiner 410 may determine that the hand laundry or pre-washing has not been performed.

According to another embodiment, the state determiner 410 may determine whether the hand laundry or pre-washing has been performed, using the weight of the auxiliary door 150. In this case, a weight detector (not shown) configured to measure the weight of the auxiliary door 150 may be installed in the auxiliary door 150, wherein the weight detector may include a device configured to measure the weight of the auxiliary door 150 using an electronic method.

According to another embodiment, the state determiner 410 may determine whether the hand laundry or pre-washing has been performed, according to whether the auxiliary water supply port 340 discharges washing water or not. In this case, a sensor (not shown) configured to detect whether the washing water is discharged may be installed in the auxiliary water supply port 340. The sensor may include a pressure sensor detecting a discharge pressure of washing water, a piezoelectric sensor detecting a vibration according to the discharge of washing water, and a moisture sensor detecting whether washing water is currently discharged or is already discharged. In addition, the sensor may include a variety of sensors configured to detect whether washing water is discharged or not.

When the hand laundry or the pre-washing has been performed, the state determiner 410 may determine that wet laundry is put into the inside of the washing tub 20*a* and determine to perform measuring the weight of the wet laundry based on a result of the determination. Accordingly, the state determiner 410 may transmit the result of the determination to the operation determiner 420.

In contrast, when the hand laundry or the pre-washing has not been performed, the state determiner 410 may determine that dry laundry is put into the inside of the washing tub 20*a* and determine to perform measuring the weight of the dry laundry based on a result of the determination. Accordingly, the state determiner 410 may transmit the result of the determination to the operation determiner 420.

Hereinafter for the convenience of description, moisturized laundry in which the hand laundry or the pre-washing is performed in the container 152 of the auxiliary door 150, is referred to as "wet laundry" and laundry which is directly put into the inside of the washing tub 20*a* without the hand laundry or the pre-washing is referred to as "dry laundry".

The wet laundry may be wet since the hand laundry or the pre-washing is performed thereon. The dry laundry may be laundry which is completely dry or laundry which is slightly wet since the hand laundry or the pre-washing is not performed thereon. As needed, the dry laundry may include laundry which is slightly wet caused by daily life.

The operation determiner 420 may determine an operation to be performed by the washing apparatus 1. For example, the operation determiner 420 may determine an operation to be performed by the washing apparatus 1 by using data stored in the memory 790, or according to a state of the washing apparatus 1 determined by the state determiner 410. In addition, the operation determiner 420 may determine an operation to be performed by the washing apparatus 1 according to the weight of the laundry determined by the weight determiner 430.

According to one embodiment, the operation determiner 420 may generate a control signal or related data to detect the wet laundry weight or the dry laundry weight according to whether the hand laundry or the pre-washing has been performed. The detection of the wet laundry weight may represent measuring or detecting the weight of the laundry put into the washing tub 20*a* when the laundry is the wet laundry, and the detection of the dry laundry weight may represent measuring or detecting the weight of the laundry put into the washing tub 20*a* when the laundry is the dry laundry.

When performing of detecting the wet laundry weight, the operation determiner 420 may transmit a control signal or data related to the detection of the wet laundry weight to the water supply controller 450 and then the water supply controller 450 may allow the main water supply port 391 to discharge a small amount of washing water according to the transmitted control signal or data related to the detection of the wet laundry weight.

The operation determiner 420 may transmit the control signal or the data related to the detection of the wet laundry weight to the operation controller 470, and the operation controller 470 may control the driver 800 according to the control signal or the data related to the detection of the wet laundry weight so that at least one of the rotating tub 22 and the pulsator 29 of the washing unit 20 is operated.

The weight determiner 430 may be configured to determine the weight of the laundry in the washing tub 20*a*. For example, the weight determiner 430 may determine the weight of the laundry in the washing tub 20*a* using a variety of information acquired by an operation of at least one of the rotating tub 22 and the pulsator 29. The acquired variety of information may include at least one of the magnitude of current applied to the motor 810, the water level of washing water in the washing tub 20*a*, or a rotational speed of the rotating tub 22. The magnitude of current applied to the motor 810 may be acquired using feedback current output from the motor 810. The feedback current will be described later.

According to one embodiment, the weight determiner 430 may determine the weight of the laundry using the friction load of the laundry against the pulsator 29. Particularly, when the pulsator 29 is rotated, the laundry in the washing tub 20*a* may be collided with the pulsator 29 and thus the weight determiner 430 may determine the weight of the laundry using such a friction load of the laundry. In this case, the weight determiner 430 may acquire the friction load of the laundry against the pulsator 29 using feedback current output from the motor 810, and determine the weight of the laundry using the acquired friction load of the laundry.

According to another embodiment, the weight determiner 430 may determine the weight of the laundry using the rotation inertia of the rotating tub 22 that is generated according to the rotation of the rotating tub 22.

According to another embodiment, the weight determiner 430 may determine the weight of the laundry based one a rotational angular velocity of the rotating tub 22 that is measured by using an electrical signal output according to the rotation of the rotating tub 22 of the washing tub 20*a*.

The weight determiner 430 may transmit the information related to the determined weight to the operation determiner 420.

The operation determiner 420 may determine an operation of each component based on the information related to the weight of the laundry transmitted from the weight determiner 430, and transmit a control signal or data related to the determined operation to at least one of the discharge controller 440, the water supply controller 450, the display controller 460 and the operation controller 470.

The at least one of the discharge controller 440, the water supply controller 450, the display controller 460 and the operation controller 470 may generate a control signal, respectively, in response to the transmitted control signal and data so as to control at least one of the discharge portion 900, the washing water supply portion 300, the user interface 600, and the driver 800. By using the above mentioned method, it may be possible to wash laundry based on the weight of the laundry. For example, the operation determiner 420 may transmit the control signal or data to the water supply controller 450 according to the determined operation and the water supply controller 450 may supply water to the washing tub 20*a* in response to the transmitted control signal or data. Accordingly, the water may be supplied to the washing tub 20*a* based on the weight of the laundry.

When performing of detecting the dry laundry weight, the operation determiner 420 may transmit a control signal or data related to the detection of the dry laundry weight to the operation controller 470 and then the operation controller 470 may rotate at least one of the rotating tub 22 and the pulsator 29 by controlling the driver 800 in response to the control signal or data related to the detection of the dry laundry weight.

The weight determiner 430 may be configured to determine the weight of the laundry in the washing tub 20*a* using a variety of information acquired by an operation of at least one of the rotating tub 22 and the pulsator 29. The acquired information may include at least one of the magnitude of current output from the motor 810, the water level of washing water in the washing tub 20*a*, or a rotational speed of the rotating tub 22. The information related to the weight of the laundry determined by the weight determiner 430 may be transmitted to the operation determiner 420.

The operation determiner 420 may determine at least one setting related to the washing cycle according to the weight of the laundry determined by the weight determiner 430, and determine an operation of each component according to the determined setting. The at least one setting related to the washing cycle may include at least one of an amount of washing water supplied to the washing tub 20*a*, power applied to the motor 810 connected to the pulsator 29 installed in the washing tub 20*a* or in the inside of the washing tub 20*a*, the rotational speed of the motor 810 and the washing time. In addition the setting may include a variety of setting considered by a designer.

The operation determiner 420 may transmit the control signal or date related to the determined operation to at least one of the discharge controller 440, the water supply controller 450, the display controller 460 and the operation controller 470.

The at least one of the discharge controller 440, the water supply controller 450, the display controller 460 and the operation controller 470 may generate a control signal, respectively, in response to the transmitted control signal and data so as to control at least one of the discharge portion 900, the washing water supply portion 300, the user interface 600, and the driver 800. The at least one of the discharge portion 900, the washing water supply portion 300, the user interface 600, and the driver 800 may perform an operation corresponding to the received control signal. By using the above mentioned method, it may be possible to wash laundry based on the weight of the laundry.

The state determiner 410, the operation determiner 420, and the weight determiner 430 may be configured to detect the weight of wet laundry and dry laundry when the user inputs a washing operation command by operating the user interface 600. "Washing operation command" may be input by operating only the start/stop button 520 or operating the start/stop button 520 and the washing mode selection button 530 in order.

As mentioned above, since the weight of the laundry is measured using different methods depending on whether laundry is wet laundry or dry laundry, it may be possible to detect and measure the weight of laundry more precisely and thus it may be possible to properly supply washing water to the washing tub 20*a* or properly drive the motor 810. Accordingly, it may be possible to prevent a case of excessively supplying washing water to the washing tub 20*a* or a case of excessively supplying power to the motor 810, thereby improving the efficiency of the washing apparatus 1.

The detection of the wet laundry weight and the dry laundry weight will be described in details.

The discharge controller 440 may transmit a control signal to the discharge portion 900 to control the discharge portion 900 and the water supply controller 450 may transmit a control signal to the water supply portion 300 to control the washing water supply portion 300. The display controller 460 may transmit a control signal to the user interface 600 to control the user interface 600 and the operation controller 470 may transmit a control signal to the driver 800 to control the washing operation of the washing apparatus 1.

The discharge controller 440, the water supply controller 450, the display controller 460 and the operation controller 470 may be separately or integrally operated.

The driver 800 may generate a driving force and transmit the generated driving force to at least one of the rotating tub 22 and the pulsator 29 so that the main washing is performed inside of the washing tub 20*a*. A detail description of the driver 800 has been described and thus the description thereof will be omitted.

The user interface 600 may receive a command from a user or provide a variety of information to a user in visual or auditory manner. The user interface 600 may be disposed in the door assembly 100 and include the input 601 and the information provider 602. The input 601 may generate an electrical signal by a user's operation and transmit the generated electrical signal to the controller 400. A detail description of the user interface 600 has been described and thus the description thereof will be omitted.

The auxiliary water supply input 89 may be disposed on a part of the door assembly 100. For example the auxiliary water supply input 89 may be disposed on the front surface of the door assembly 100. The auxiliary water supply input 89 may be implemented by a physical button, a lever, a touch pad or a touch screen.

According to the operation of the auxiliary water supply input 89, it may be possible to control whether to discharge washing water via the auxiliary water supply port 340 or an amount of discharged washing water. Particularly, when the auxiliary water supply input 89 is operated, the auxiliary water supply input 89 may output an electrical signal and transmit the electrical signal to the controller 400. The controller 400 may control the water supply valve 320 and the switch unit 380 so that the washing water is discharged from the auxiliary water supply port 340.

According to one embodiment, the electrical signal output from the auxiliary water supply input 89 may be transmitted to the memory 790. The memory 790 may store data corresponding to the electrical signal output from the auxiliary water supply input 89 so as to store information related to whether the auxiliary water supply input 89 is operated or not.

According to another embodiment, the electrical signal output from the auxiliary water supply input 89 may be transmitted to the controller 400. The controller 400 may generate a control signal corresponding to the electrical signal output from the auxiliary water supply input 89 and transmit the generated control signal to the memory 790, wherein the control signal may include a control command for storing information related to whether the auxiliary water supply input 89 is operated or not. The memory 790 may store information related to whether the auxiliary water supply input 89 is operated or not in response to the control signal transmitted from the controller 400.

A detail description of the auxiliary water supply input 89 has been described above and thus an additional description will be omitted.

The communicator 700 may be connected a network 740 in a wired or wireless manner to communicate with an external other home appliance 770, a portable terminal 760, or a server 750. The communicator 700 may communicate with the server 750 or the other home appliance 770 via a home server, and in this case the communicator 700 may perform data communication with the home server according to the standard of the home server.

The communicator 700 may receive a variety of information related to an operation of the other home appliance 770 or transmit a variety of information related to the operation of the washing apparatus 1 to the other home appliance 770. Further, the communicator 700 may receive information related to a user's lifestyle, and use the information for the operation of the washing apparatus 1.

The communicator 700 may send and receive data related to a remote control, via the network 740.

The communicator 700 may be connected to the network 740 in the wired or wireless manner to transmit and receive data with the server 750, a remote controller, the portable terminal 760, or the other home appliance 770. The communicator 700 may include at least one of component communicating with external other home appliance 770. For example, the communicator 700 may include a short-range communication module 710, a wired communication module 720, and a mobile communication module 730.

The short-range communication module 710 may be a module for short range communication within a predetermined distance. Short-range communication technology may include a Wireless LAN, a Wi-Fi, a Bluetooth, a Zigbee, a Wi-Fi Direct (WFD), a ultra wideband (UWB), Infrared communication, an infrared Data Association (IrDA), a Bluetooth Low Energy (BLE) and a Near Field Communication (NFC).

The wired communication module 720 performs a communication using an electrical signal or an optical signal via a cable. The wired communication module 720 may include a pair cable, a coaxial cable, an optical fiber cable, and an Ethernet cable.

The mobile communication module 730 may transmit and receive radio signals with at least one of a base station, an external terminal, and a server on a mobile communication network. The radio signal may include various types of data according to a voice call signal, a video call signal or a text/multimedia message transmission and reception.

The power 780 may supply the electrical energy required for the operation of the washing apparatus 1. The power 780 may include a power supply configured to supply the power to each component of the washing apparatus 1 by converting the commercial power into a voltage that is appropriate for the washing apparatus 1, or a battery, e.g., an electric condenser, configured to store and supply the electrical energy. Although a user turns off the power of the washing apparatus 1, the power 780 may supply power to the controller 400 and the switch unit 380 so that water is supplied to the container 152 of the auxiliary door 150 or supplying water to the container 152 of the auxiliary door 150 is stopped.

The memory 790 may store data detected by the detector 200, control data of the controller 400, input data of the input 601, communication data of the communicator 700, and information related to whether the auxiliary water supply input 89 is operated or not.

The controller 400 may analyze a user's lifestyle by analyzing the use of the washing apparatus 1 and other electrical appliances 770 depending on the data stored in the memory 790, and may store the user's lifestyle on the memory 790 to control the washing apparatus.

Particularly, the controller 400 may determine a predetermined water level, a predetermined limit time, a predetermined first time, a predetermined second time, a predetermined distance, and a predetermined number of washing time based on the user's lifestyle stored in the memory 790.

The controller 400 may read information related to whether the auxiliary water supply input 89 is operated or not, and determine a method for measuring the weight of the laundry. Accordingly, the controller 400 may measure the weight of the laundry according to the determined method.

The memory 790 may be implemented by a magnetic disk storage device storing data using magnetization of the magnetic disk or a semiconductor storage device storing data using a semiconductor. The semiconductor storage device may be implemented by a random access memory (RAM) or a read only memory (ROM). Particularly, the semiconductor storage device may be implemented by an Electrically Erasable PROM (EEPROM) configured to electrically read, write, and delete data.

The discharge portion 900 may discharge the remaining water inside of the washing tub 20*a* to the outside of the washing apparatus 1. A description of the discharge portion 900 has been described and thus the description thereof will be omitted.

Hereinafter a method of controlling the washing apparatus detecting the weight of laundry selectively using the detection of the wet laundry weight or the detection of the dry laundry weight according to whether the hand laundry or the pre-washing is performed using the auxiliary door 150 will be described in detail with reference to FIGS. 20 to 35D.

Figure 20:
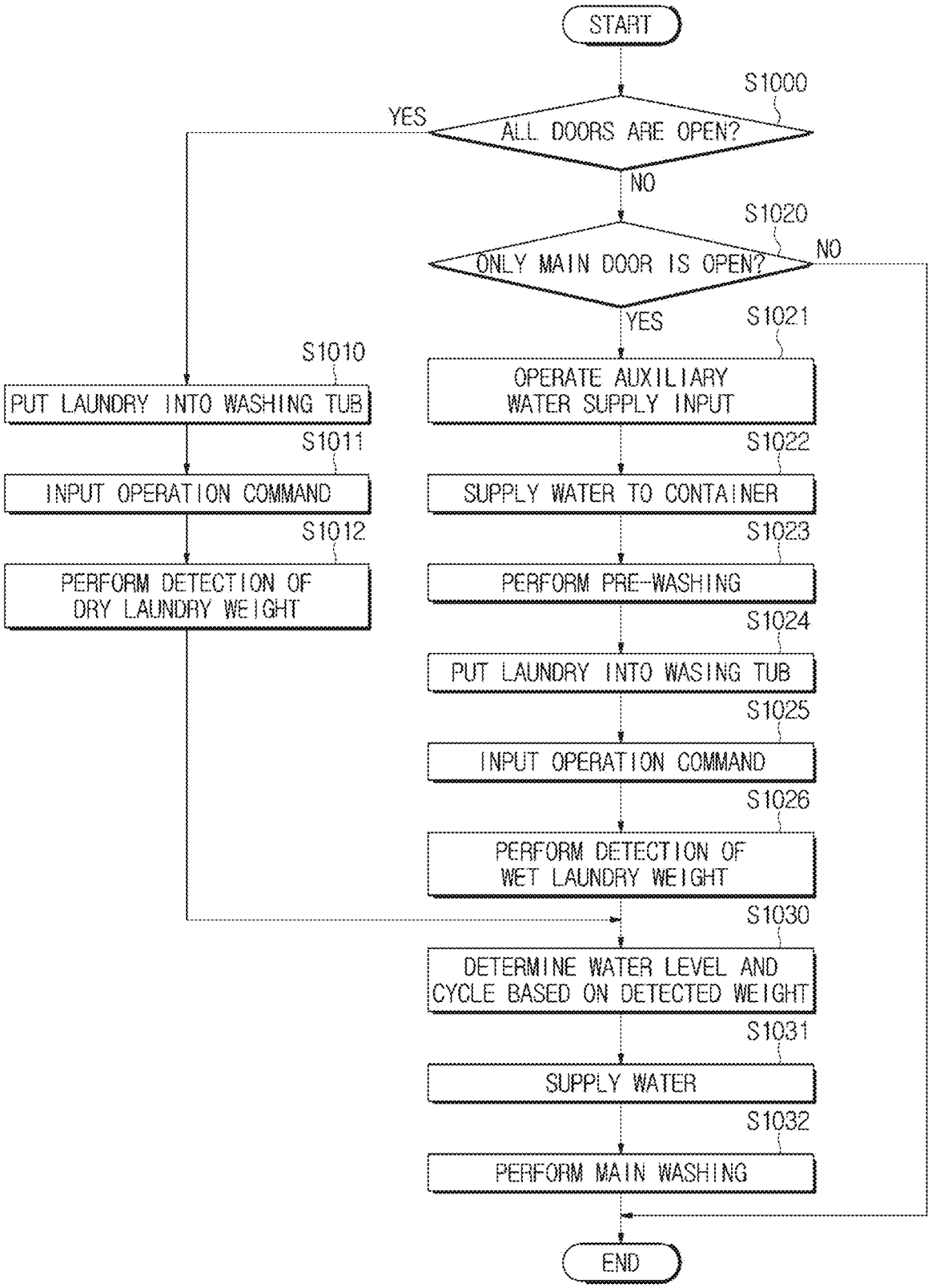
FIG. 20 is a flowchart of a method of controlling the washing apparatus according to one embodiment of the present disclosure.

FIG. 20 is a flowchart of a method of controlling the washing apparatus according to one embodiment of the present disclosure.

Referring to FIG. 20, it is determined whether all doors 110 and 150 are opened or not, after the washing apparatus 1 is operated (1000). In other word, it is determined whether only main door 110 is opened or both of the main door 110 and the auxiliary door 150 are opened.

When both of the main door 110 and the auxiliary door 150 are opened (Yes in 1000), a user may directly put laundry into the washing tub 20*a*. In this case, the laundry put into the washing tub 20*a* may be dry laundry.

A user may input a command for driving the washing apparatus 1 that is the washing operation command (1011). When the washing operation command is input, the washing apparatus 1 may detect the weight of the laundry by performing the detection of the dry laundry weight (1012).

In other words, in a state in which all doors 110 and 150 are opened, when the auxiliary water supply input 89 is not operated, the controller 400 of the washing apparatus 1 may determine that the dry laundry is put into the washing tub 20*a* and detect the weigh to the laundry by performing the detection of the dry laundry weight.

Hereinafter the detection of the dry laundry weight will be described in detail.

The detection of the dry laundry weight may be performed using the pulsator 29 or the rotating tub 22.

A method using the pulsator 29 is a method by using the friction load between the dry laundry and the pulsator 29, and thus a weight detection time may be relatively short and resolution may be appropriate in the small load.

Figure 21:
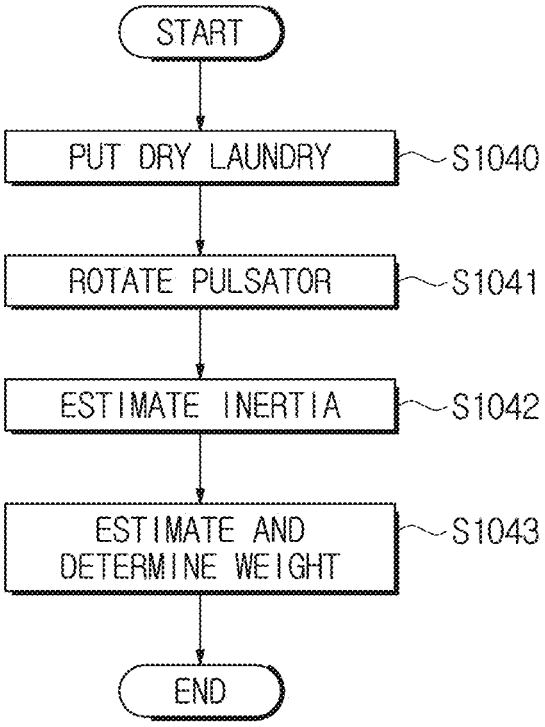
FIG. 21 is a flowchart illustrating an example of a method of measuring the weight of dry laundry by using a pulsator by the washing apparatus.
Figure 22:
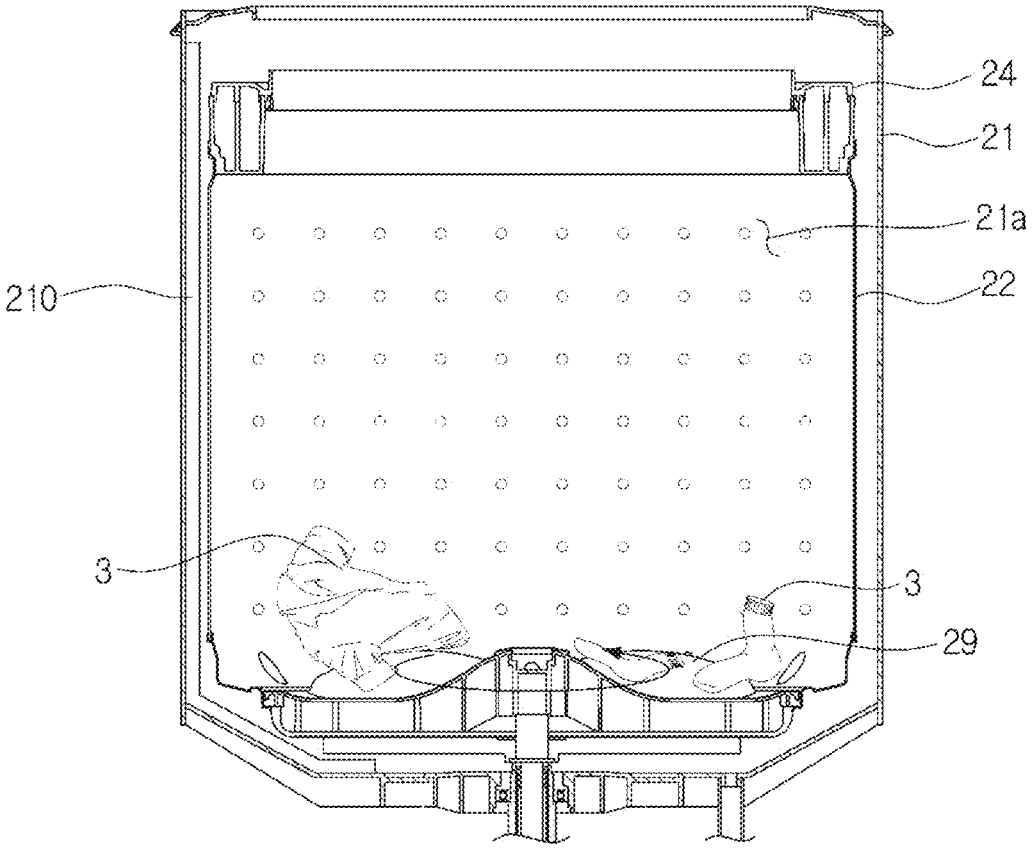
FIG. 22 is a view of a rotation of the pulsator in a process of measuring the weight of the dry laundry.

FIG. 21 is a flowchart illustrating an example of a method of measuring the weight of dry laundry by using a pulsator by the washing apparatus and FIG. 22 is a view of a rotation of the pulsator in a process of measuring the weight of the dry laundry.

Figure 23:
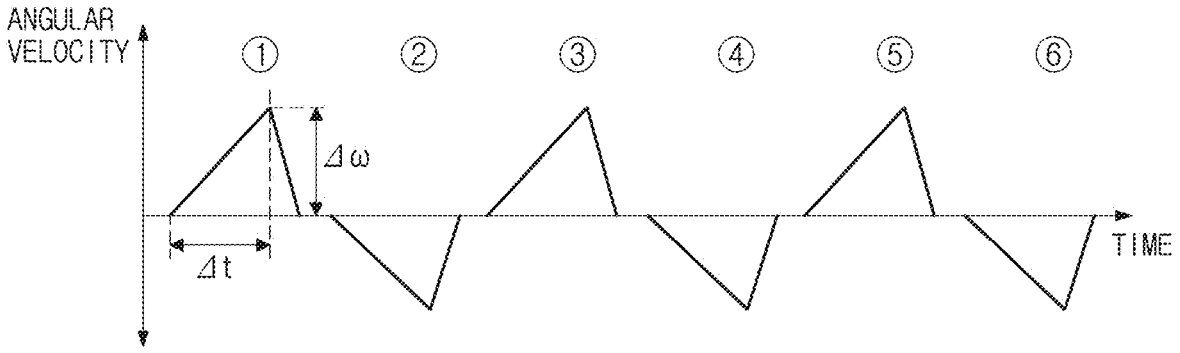
FIG. 23 is a graph illustrating a relationship between a time and a rotational angular velocity of the pulsator.
Figure 24:
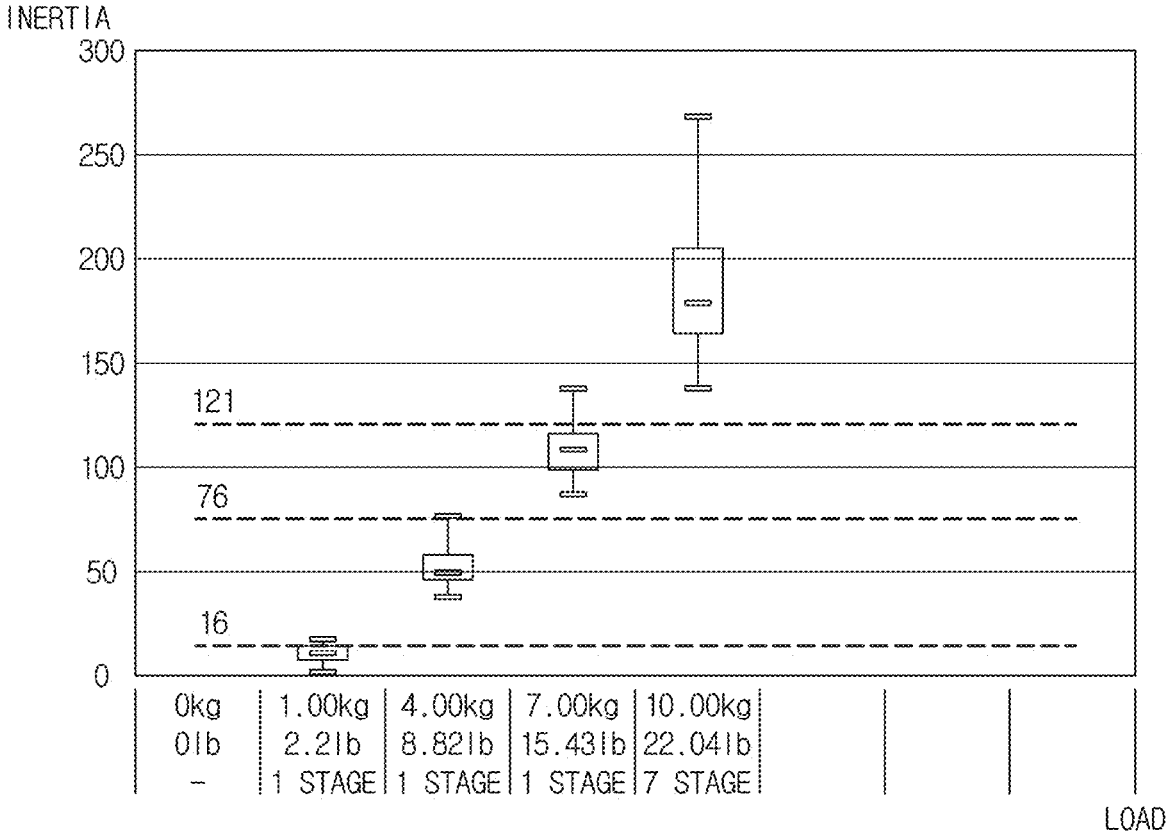
FIG. 24 is a graph illustrating a relationship between the inertia and the weight of the laundry.

FIG. 23 is a graph illustrating a relationship between a time and a rotational angular velocity of the pulsator. In FIG. 23, an X axis represents a time and a Y axis represents a rotational angular velocity. FIG. 24 is a graph illustrating a relationship between the inertia and the weight of the laundry. In FIG. 24, an X axis represents the size of load and a Y axis represents moment of inertia. In FIG. 24, a rectangular and a line segment briefly illustrate the distribution of the moment of inertia, wherein the rectangular indicates a point measured in a certain load and in which the moment of inertia is frequently distributed, and a small rectangular in the rectangular indicates the mode of the moment of inertia which is the most frequently measured value in a certain load. A line segment extending from the rectangular represents a point in which the moment of inertia measured at a certain load is distributed.

Referring to FIGS. 21 and 22, for the detection of the dry laundry weight by using the pulsator 29, the dry laundry 3 is put into the washing tub 20*a* (1040; the same as 1010 of FIG. 20), and in a state in which the dry laundry 3 is put, the pulsator 29 is rotated, as illustrated in FIG. 22 (1041).

The rotation of the pulsator 29 may be performed according to the following process. The driving force may be delivered to the pulsator 29 through the switch unit 380 and the power may be supplied to the motor 810. According to the power supply of the motor 810, the washing shaft 840 connected to the motor 810 is rotated and then the pulsator 29 connected to the washing shaft 840 is also rotated according to the rotation of the washing shaft 840.

The pulsator 29 may be alternately rotated in a certain direction and a direction opposite to the certain direction, wherein the rotation in the certain direction and the opposite direction may be performed by at least one time. For example, the pulsator 29 may be rotated in the certain direction and the opposite direction by three times, respectively.

Particularly, referring to FIG. 23, the pulsator 29 may be rotated in a certain direction (①). In this case, an angular velocity of the pulsator 29 starts to increase. After the pulsator 29 is rotated for a certain period of time or after a certain period of time is expired, the rotational speed of the pulsator 29 is reduced and then finally the pulsator 29 is stopped after a certain period of time is expired. The stopped pulsator 29 starts to rotate in the direction opposite to the certain direction (②). An angular velocity of the pulsator 29 rotating in the opposite direction starts to increase and then the angular velocity of the pulsator 29 is reduced after the certain rotation or after a certain period of time is expired. Finally, the pulsator 29 is stopped. Sequentially, the pulsator 29 starts to rotate in the certain direction again (③). The operation of the pulsator 29 is repeatedly performed (① to ⑥)

When the rotation of the pulsator 29 is started, the moment of inertia may be estimated (1042).

Estimation of the moment of inertia may be performed as the following equation 1 by using a motor-torque equation.

$$T = J\frac{d\omega}{dt} + B\omega + T_L \qquad \text{Equation 1}$$

In the equation 1, T represents motor torque, J represents the moment of inertia, ω represents an angular velocity and t represents time. dω/dt represents a variation of the angular velocity due to changes in time, and thus dω/dt may be the angular acceleration. B represents coefficient of friction of the motor, and TL represents load torque.

Referring to the equation 1, the motor torque (T) is proportional to the product of the moment of inertia (J) and the angular acceleration (dω/dt). When it is assumed that frictional force (Bω) and the load torque (TL) of the motor are constant, it may be allowed that the frictional force (Bω) and the load torque (TL) of the motor are ignored. In this case, the moment of inertia (J) is proportional to the product of the motor torque (T) and the angular acceleration (dω/dt), as illustrated in equation 2 in the following.

$$J = T \cdot \frac{dt}{d\omega} \quad \text{Equation 2}$$

In the same way, it may be possible to estimate the moment of inertia (J) by using the variation in time (dt) about the speed variation (dω) in a state in which certain motor torque (T) is applied to the motor 810.

The angular velocity variation (Δω in FIG. 23) for a certain period of time (Δt in FIG. 23) may be estimated by the rotational speed of the motor 810 or the speed detector provided in the pulsator 29. The controller 400 may estimate the moment of inertia (J) by using the measured the angular velocity variation for a certain period of time (Δω/Δt) and the motor torque (T) known in advance.

As illustrated in FIG. 23, when the pulsator 29 is rotated in the certain direction and the opposite direction (① to ⑥) by multiple times, the controller 400 may acquire the angular velocity variation for the certain period of time (Δω/Δt) and calculate an average value (m) of the absolute values of the acquired angular speed variation (Δω/Δt). The controller 400 may estimate the moment of inertia (J) by the calculated average value (m) and the motor torque (T).

According to embodiments, the controller 400 may calculate the average value (m) using the angular velocity variation (Δω/Δt) measured in the all rotations (① to ⑥), or using the angular velocity variation (Δω/Δt) measured in some rotation among the all rotations (①) to ⑥). In this case, the controller 400 may calculate the average value (m) using the angular velocity variation (Δω/Δt) from the rotation (② to ⑥) in which a first rotation (①) is excluded, to remove an errors.

When the moment of inertia (J) is measured, the controller 400 may determine a load corresponding to the estimated moment of inertia (J) that is the controller 400 may estimate and determine the weight of laundry (1043).

According to one embodiment, the controller 400 may determine the weight of laundry corresponding to the estimated moment of inertia (J) by reading a pre-stored database in the memory 790. For example, when the inertia moment is measured to be 200, the controller 400 may determine that the weight of laundry is about 10 kg with reference to a graph of FIG. 24. As illustrated in FIG. 24, the database may be obtained by experiences or experiments to establish data related to the relationship between the load and the moment of inertia.

Figure 25:
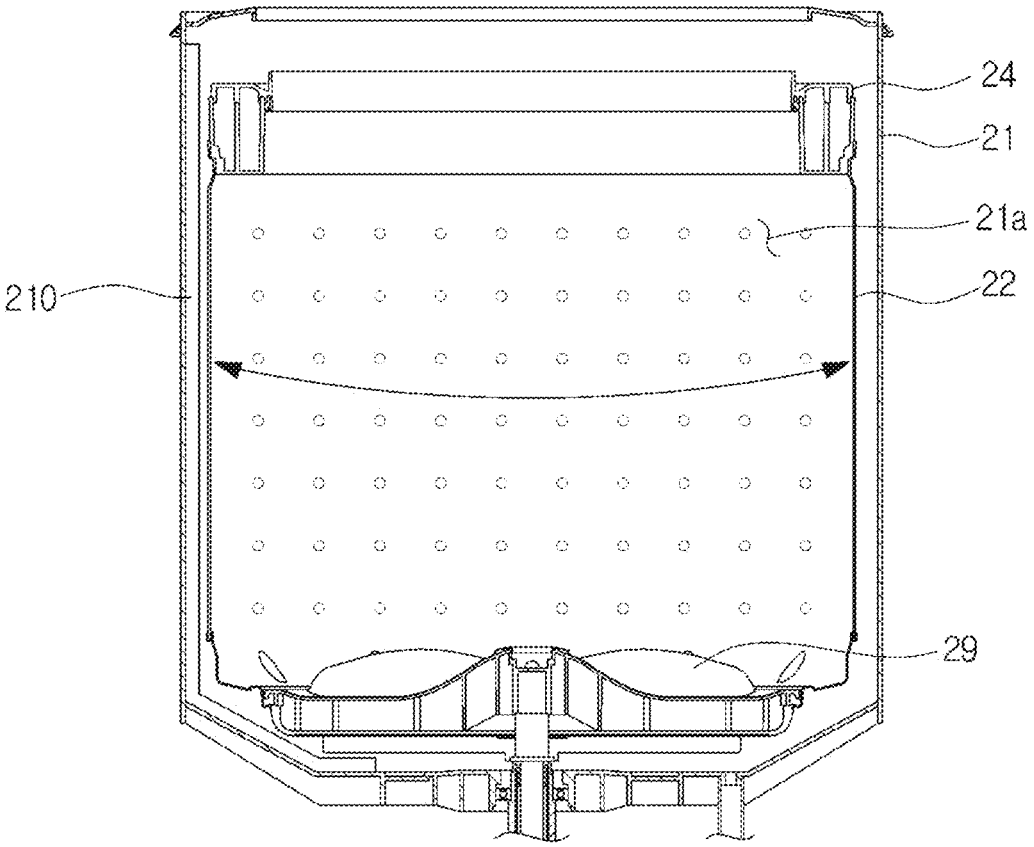
FIG. 25 is a view illustrating a method of measuring the weight of dry laundry by rotating the washing tub, which is another example of the method of measuring the weight of dry laundry.
Figure 26:
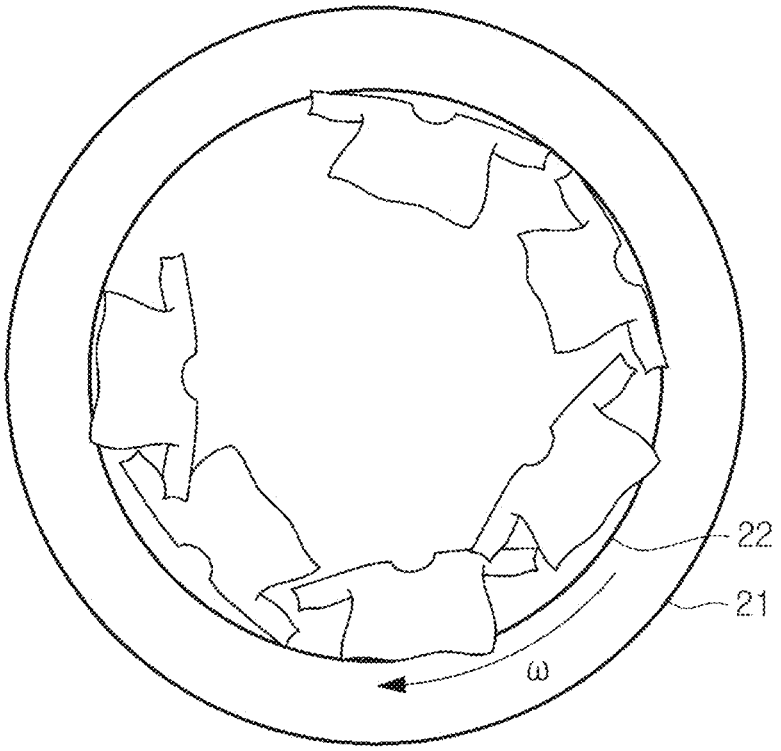
FIG. 26 is a view of laundry inside the washing tub when the washing tub is rotated.

FIG. 25 is a view illustrating a method of measuring the weight of dry laundry by rotating the washing tub, which is another example of the method of measuring the weight of dry laundry and FIG. 26 is a view of laundry inside the washing tub when the washing tub is rotated.

The method using the rotating tub 22 is referred to as spin drum rotation method. Particularly, by measuring the rotational inertia of the rotating tub 22 by rotating the rotating tub 22, the weight of the dry laundry may be measured or by measuring the current applied to the driver 800 during the rotation of the rotating tub 22, the weight of the dry laundry may be measured. The method using the rotating tub 22 may have the linearity for each load and there is a strong advantage in the laundry texture and loading distribution.

As illustrated in FIGS. 25 and 26, when the rotating tub 22 is rotated at a predetermined speed (ω), the laundry 3 in the rotating tub 22 may be moved to the edge of the rotating tub 22 due to the centrifugal force, and thus certain torque may be applied to the rotating tub 22 and the motor 810 driving the rotating tub 22. The rotational inertia may be measured by using the applied torque and thus the weight of laundry may be estimated and measured by using the rotational inertia. It may be possible to estimate and measure the weight of laundry using the current which is applied to the motor 810 during the rotating tub 22 is rotated. The measured current may include a feedback current.

When the weight of the laundry 3 is measured, the controller 400 may determine at least one setting related to the washing cycle using the result of the measurement, wherein the at least one setting may include at least one of an amount of water to be supplied to the inside of the washing tub 20*a*, power applied to the motor 810 connected to the washing tub 20*a* or the pulsator 29 installed in the washing tub 20*a*, a rotational speed of the motor 810, and a washing time. However, the setting is not limited thereto, and thus it may vary according to a designer's selection.

For example, the controller 400 may determine a water level of water and the washing cycle (1030), and control the washing apparatus 1 so that the washing apparatus 1 supplies water and performs the washing according to the determined water level and the washing cycle (1031 and 1032).

Particularly, when the weight of the laundry is determined based on a result of the detection of the dry laundry weight, the controller 400 of the washing apparatus 1 may determine a water level of washing water and a washing cycle based on the detected weight (1030).

Figure 27:
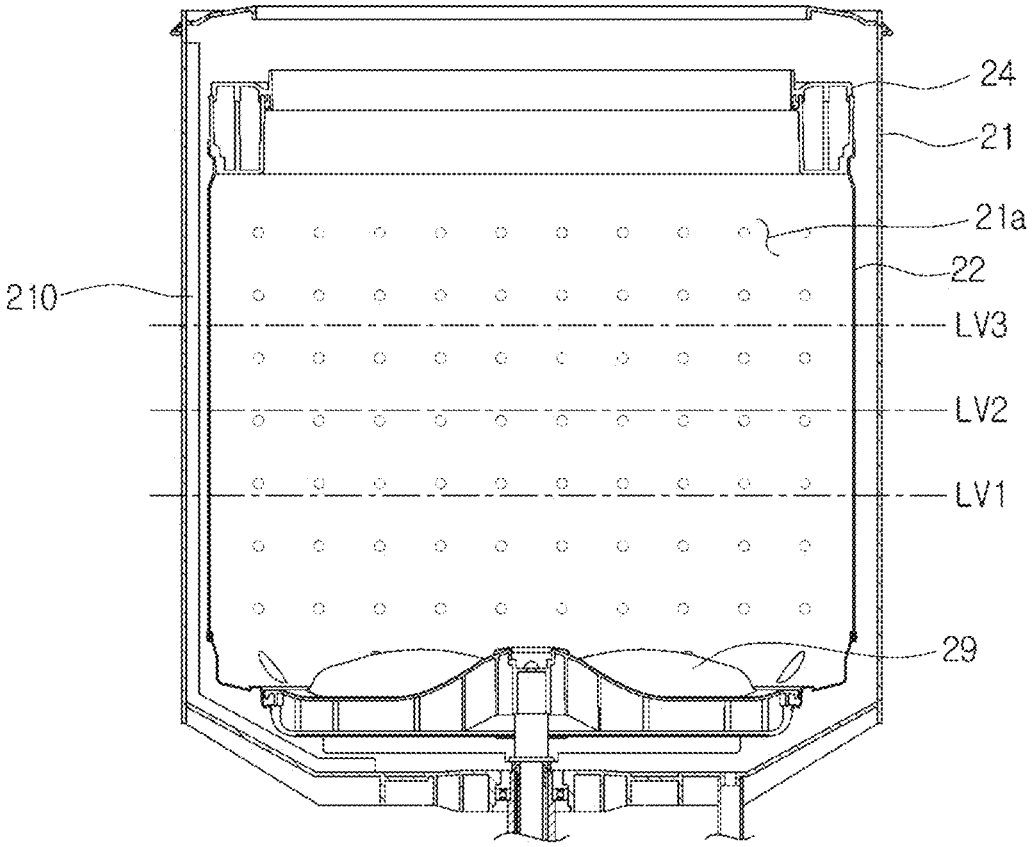
FIG. 27 is a view of a water level of washing water supplied to the washing tub.
Figure 28:
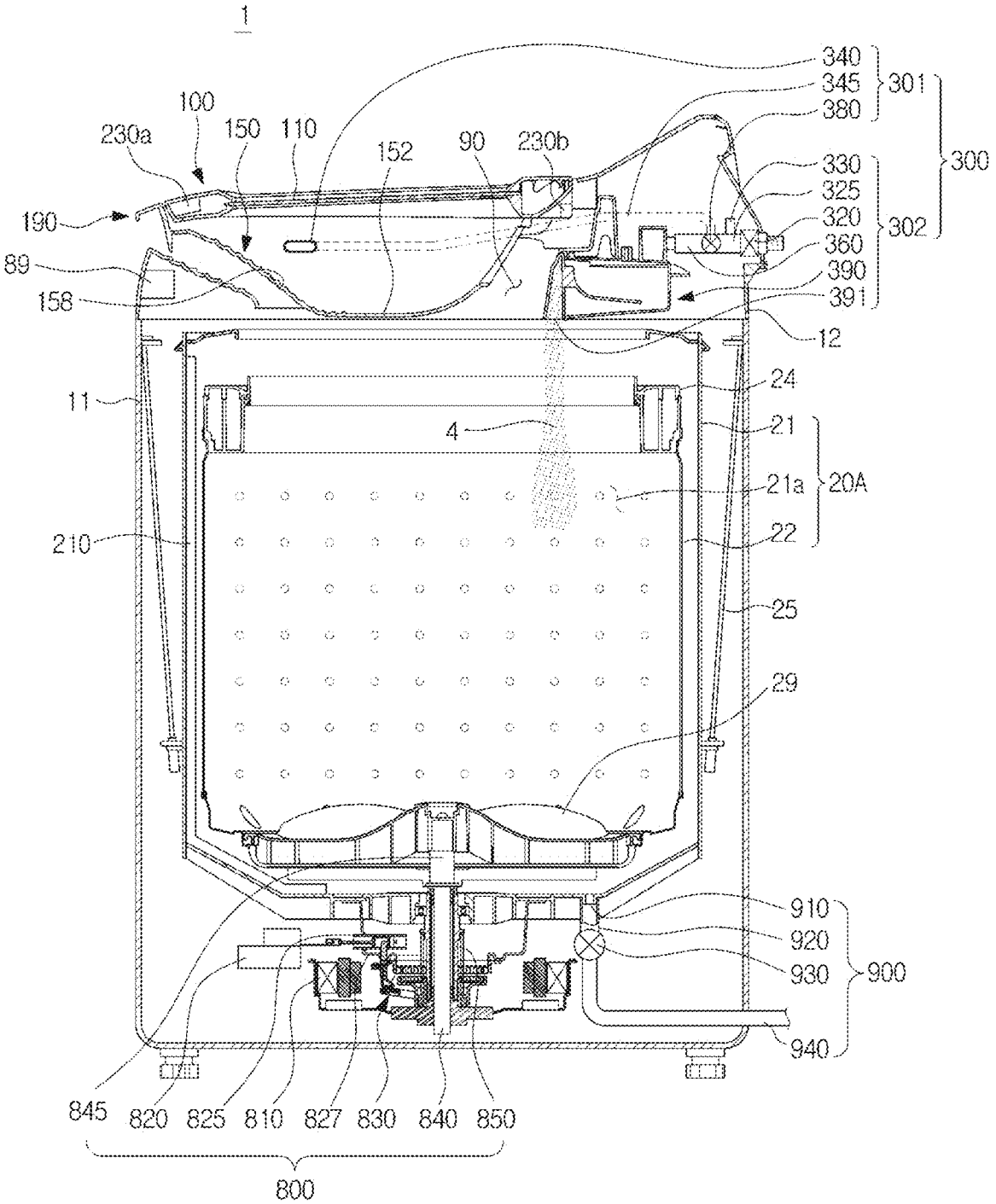
FIG. 28 is a view of a state in which washing water is supplied to the washing tub after the weight of the laundry is determined.

FIG. 27 is a view of a water level of washing water supplied to the washing tub and FIG. 28 is a view of a state in which washing water is supplied to the washing tub after the weight of the laundry is determined.

Referring to FIG. 27, a water level of washing water may include at least one water level (LV1 to LV3), wherein each of water level (LV1 to LV3) may be determined according to the type and amount of laundry. The controller 400 may select at least one of the water levels (LV1 to LV3) based on the weight of laundry, and determine the selected water level as the water level of washing water. For example, as the weight of laundry is heavier, the controller 400 may determine the higher water level, i.e., a third water level (LV3), as a water level of washing water. As the weight of laundry is lighter, the controller 400 may determine the lower water level, i.e., a first water level (LV1), as a water level of washing water.

When the water level of washing water and the washing cycle are determined, as illustrated in FIG. 28, washing water 4 may be supplied to the washing tub 20*a* according to the determined water level of washing water (1031) and when the washing water 4 is supplied, the main washing may be performed in the washing tub 20*a* (1032). The washing water 4 may be supplied by the water supply portion 300 and particularly the washing water 4 may be supplied to the washing tub 20*a* by the second washing water supply portion 302. In this case, the switch unit 380 may be configured to connect the water supply pipe 325 to the main water supply pipe 360 so that the washing water may be discharged through the main water supply port 391.

According to one embodiment, the weight of the dry laundry may be determined by detecting the weight of the dry laundry and then the washing cycle may be performed based on the weight of the dry laundry. In addition, after the washing cycle is completed, errors may be corrected or the increase in the load caused by the moisture in the laundry may be applied by estimating and determining the weight of the laundry. In this case, the measurement and determination of the weight may be performed using the same method as the detection of the wet laundry weight which is described later.

Referring again to FIG. 20, when neither of the main door 110 and the auxiliary door 150 is opened (No in 1000), the main door 110 may be opened but the auxiliary door 150 may be not opened (Yes in 1020). When only the auxiliary door 150 is opened, the hand laundry or the pre-washing may be performed (1021 to 1023). In this case, the controller 400 of the washing apparatus 1 may estimate and measure the weight of laundry by performing the detection of the wet laundry weight prior to the main washing.

Figure 29:
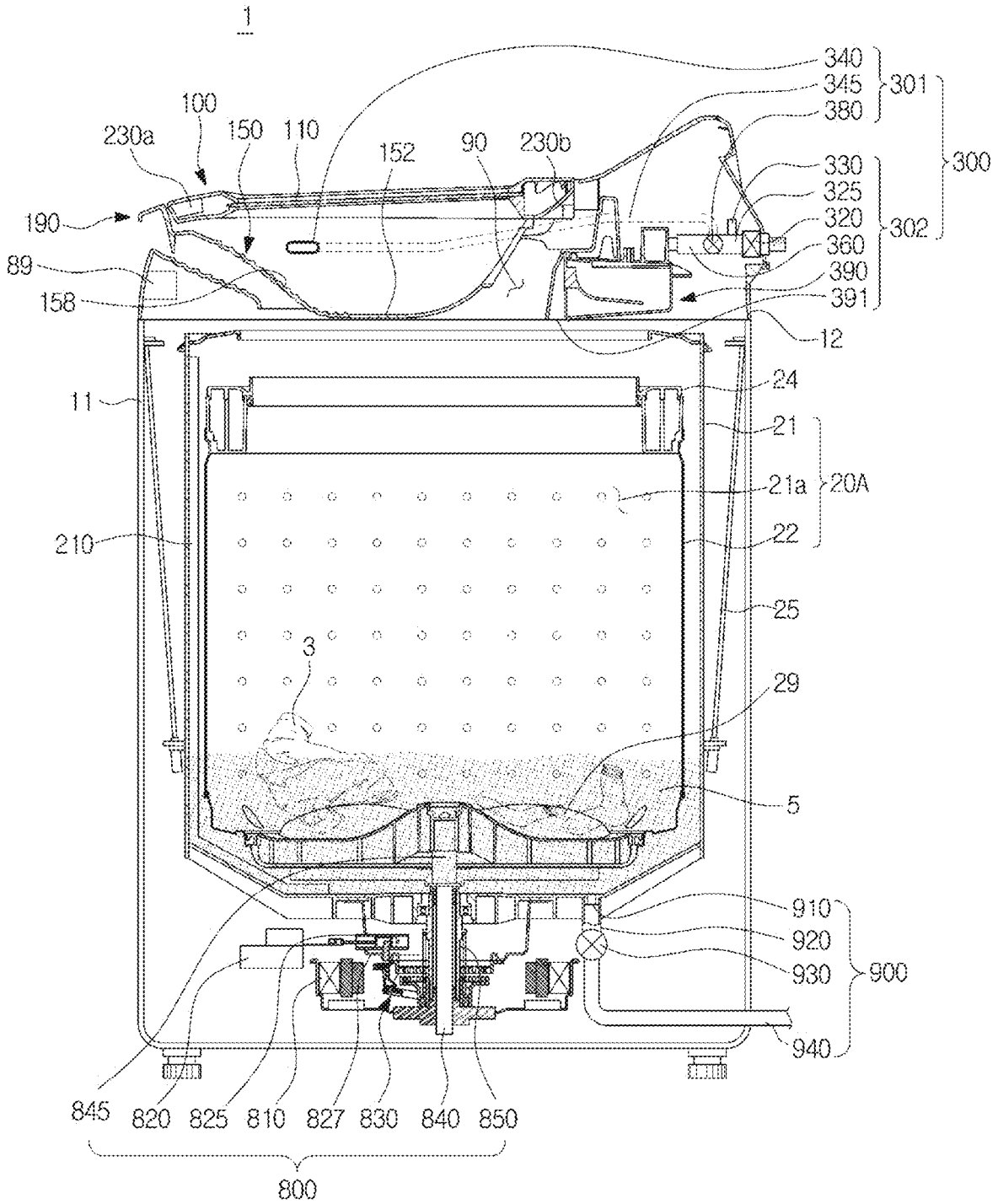
FIG. 29 is a view of a state in which washing water and laundry are put into the washing tub.

FIG. 29 is a view of a state in which washing water and laundry are put into the washing tub.

Particularly, when the main door 110 is opened and the auxiliary door 150 closes the opening 90 (1021), a user may put the laundry into the container 152 of the auxiliary door 150 and operate the auxiliary water supply input 89 (1021) and thus the washing water may be discharged from the auxiliary water supply port 340 to the container 152 (1022). When the auxiliary water supply input 89 is operated, the auxiliary water supply input 89 may output an electrical signal and then the electrical signal may be transmitted to the memory 790 or the controller 400. The memory 790 may store information related to a fact that the auxiliary water supply input 89 is operated, in response to the transmitted electrical signal. The controller 400 may generate information related to a fact that the auxiliary water supply input 89 is operated, in response to the transmitted electrical signal and transmit the generated information to the memory 790 so that the memory stores the information related to a fact that the auxiliary water supply input 89 is operated.

A user may perform the hand laundry or the pre-washing using the washing water discharged to the container 152, and the container 152 (1023), and the user may rotate the auxiliary door 150. In this case, at least one of the washing water or the laundry may be moved downward via the auxiliary discharge port 960 and put into the inside of the washing tub 20*a* (1024). Accordingly, as illustrated in FIG. 29, the wet laundry that is the laundry is soaked may be placed with the washing water in the washing tub 20*a*.

Sequentially, the user may operate the input 601 of the user interface 600 to input an operation command of the washing apparatus 1 that is a washing operation command (1025) and when the washing operation command is input, the washing apparatus 1 may perform the detection of the wet laundry weight to detect the weight of the laundry (1026).

The wet laundry is relatively heavier than the dry laundry or some of the washing water is introduced into the inside of the washing tub 20*a*. Therefore, in a state in which it is assumed that the laundry is dry laundry as mentioned above, when the washing apparatus 1 performs the detection of the dry laundry weight, the weight of the laundry may be estimated or measured to be heavier than an actual weight. Accordingly, a large amount of washing water may be put into the washing tub 20*a* or a large amount of power may be applied to the motor 810 and thus it may cause the waste of the washing water and the power. Therefore, the controller 400 of the washing apparatus 1 may detect the weight of the laundry through the detection of the wet laundry weight when the hand laundry or the pre-washing is performed.

Hereinafter the detection of the wet laundry weight will be described in detail.

Figure 30:
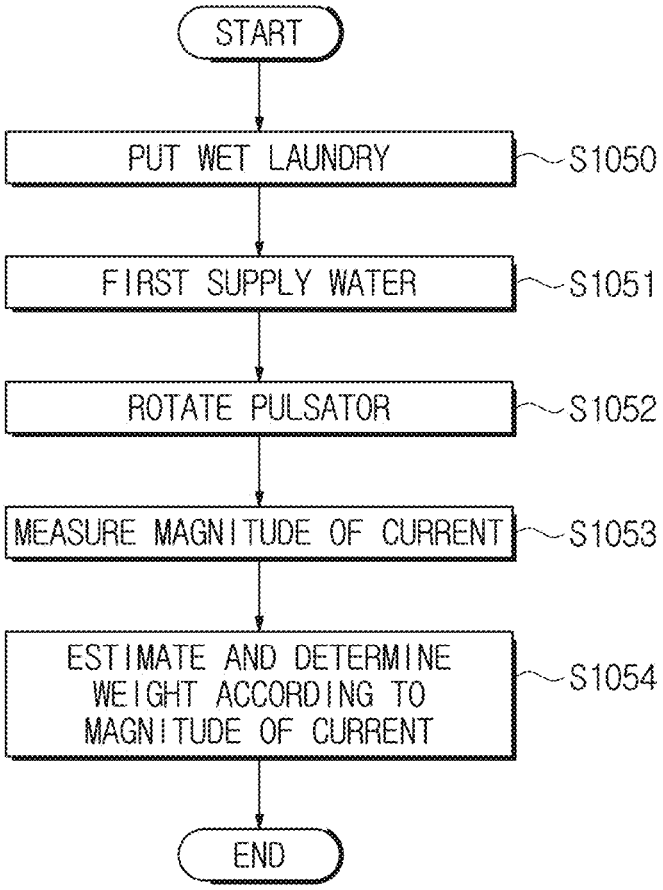
FIG. 30 is a flowchart illustrating an example of a method of measuring the weight of wet laundry by the washing apparatus.
Figure 31:
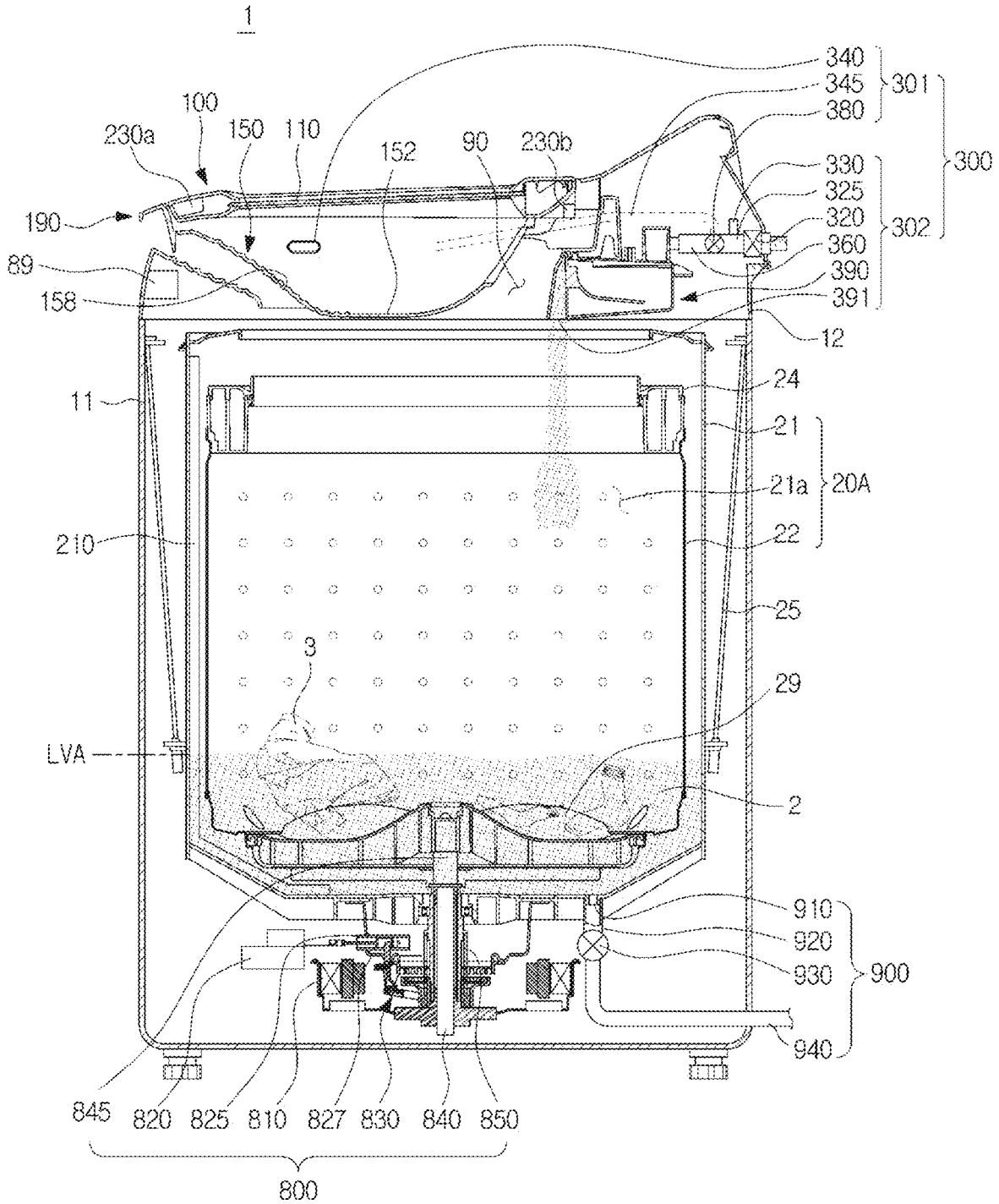
FIG. 31 is a view illustrating a state in which washing water is additionally supplied to the washing tub.
Figure 32:
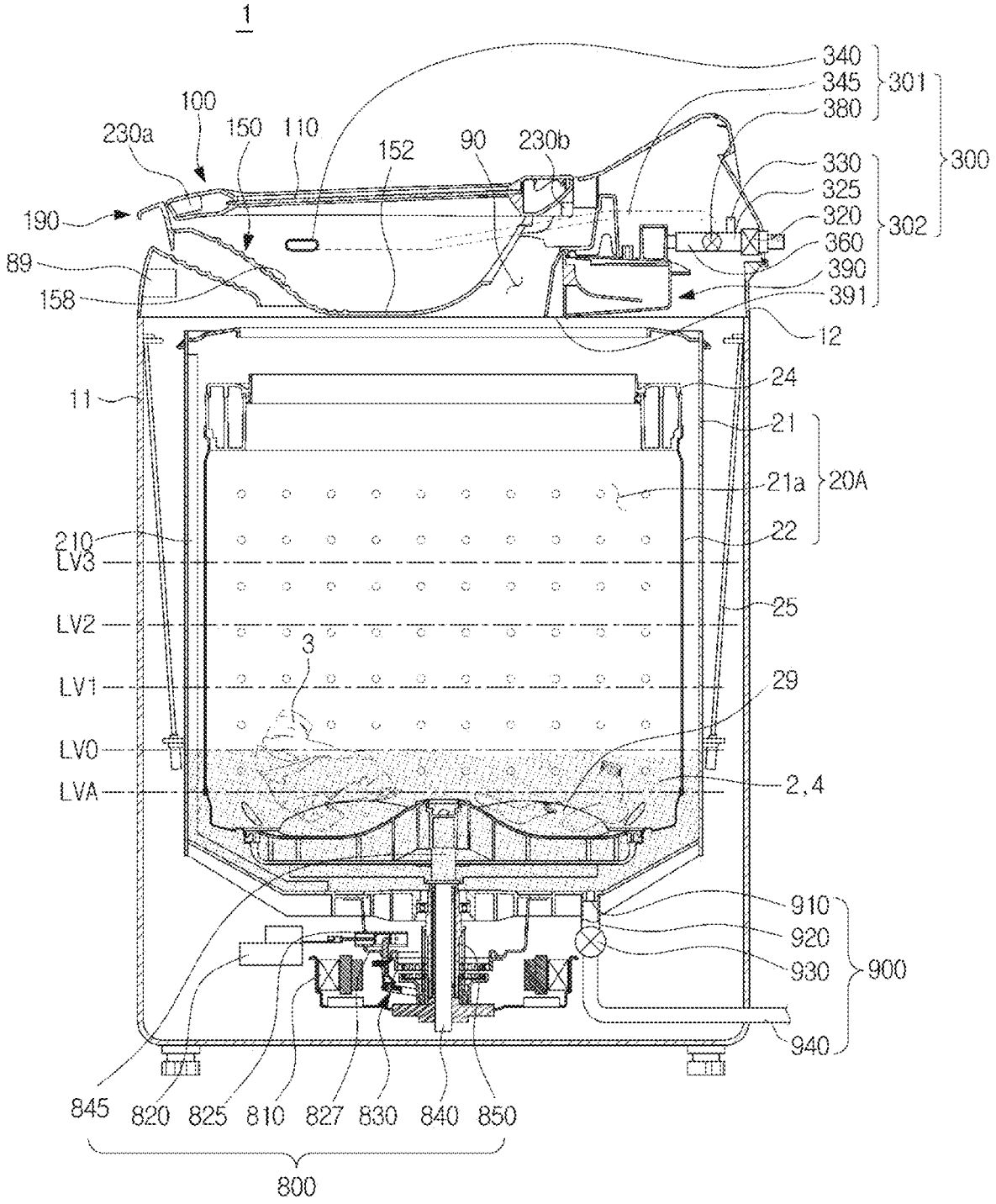
FIG. 32 is a view illustrating a water level of the washing water supplied to the washing tub.

FIG. 30 is a flowchart illustrating an example of a method of measuring the weight of wet laundry by the washing apparatus. FIG. 31 is a view illustrating a state in which washing water is additionally supplied to the washing tub and FIG. 32 is a view illustrating a water level of the washing water supplied to the washing tub.

The detection of the wet laundry weight may be performed using the pulsator 29 or the rotating tub 22. Hereinafter the detection of the wet laundry weight using the pulsator 29 will be described as an example.

When the hand laundry or the pre-washing is performed (1023), the wet laundry may be put into the washing tub 20*a* (1050). In this case, the washing water may be also put into the washing tub 20*a* and thus the washing water may be filled in the washing tub 20*a* to a first water level (LVA), as illustrated in FIG. 31. In other words, the first water level (LVA) of the washing water is supplied to the container 152 not through the main water supply port 391 but through the auxiliary water supply port 340.

Meanwhile, the controller 400 may check whether the wet laundry is put into the washing tub 20*a* or not by reading the memory 790. Particularly, the controller 400 may read the memory 790 to determine whether the hand laundry or the pre-washing is performed, and more particularly, the controller 400 may determine whether the hand laundry or the pre-washing is performed, by using information related to that the auxiliary water supply input 89 is operated or not, stored in the memory 790.

When the wet laundry is put into the washing tub 20*a*, the controller 400 may control the water supply valve 320 of the water supply portion 300 so that a certain amount of the washing water is discharged to the washing tub 20*a* (a first water supply), as illustrated in FIG. 31. The first water supply may be performed to set reference data which is a reference for measuring the weight of wet laundry.

Referring to FIG. 32, since washing water is additionally supplied to the washing tub 20*a* in which the first water level (LVA) of the washing water is already provided, the water level of the washing water may be increased to a second water level (LVO) higher than the first water level (LVA).

When the first water supply is completed (1051), the power may be applied to the motor 810 and the motor may drive the pulsator 29. Accordingly, the pulsator 29 may start to rotate (1052).

The water current may be generated in the washing water in the washing tub 20*a* according to the rotation of the pulsator 29. Load may be applied to the pulsator 29 due to the presence of the wet laundry or the friction caused by the wet laundry, and the load applied to the pulsator 29 may be applied to the motor 810. Therefore, the current may be applied to the motor 810, wherein the amount of the current may be larger than a case in which the laundry and the washing water is not present, and the current having the magnitude corresponding to the weight of the laundry may be applied to the motor 810.

When the magnitude of the current applied to the motor 810 is measured (1053), it may be possible to estimate and determine the weight of the laundry based on the magnitude of the current (1054). The controller 400 may perform the estimation and determination of the weight of the laundry based on the magnitude of the current, and thus the controller 400 may determine the weight of the laundry using the friction load of the laundry against the pulsator. A method for measuring the current to detect the weigh will be described later.

When the weight of the laundry is estimated and determined according to a result of the detection of the wet laundry weight, the controller 400 of the washing apparatus 1 may determine a water level of washing water and a washing cycle based on the detected weight (1030).

Sequentially, the controller 400 may control the washing apparatus 1 so that the washing apparatus 1 performs supplying water and the washing according to the determined water level and the washing cycle (1031 and 1032).

For example, the controller 400 may determine at least one of the water levels (LV1 to LV3) based on the weight of the wet laundry, and determine an amount of washing water to be supplied according to the selected water level (LV1 to LV3), and the water supply portion 300 may supply washing water to the washing tub 20*a* according to the determined amount of washing water.

In this case, the controller 400 may determine the higher water level, as the weight of laundry is heavier, that is the controller 400 may control the water supply of the washing water so that the water level reaches the third water level (LV3). The controller 400 may determine the lower water level, as the weight of laundry is lighter, that is the controller 400 may control the water supply of the washing water so that the water level reaches the first water level (LV1).

Figure 33:
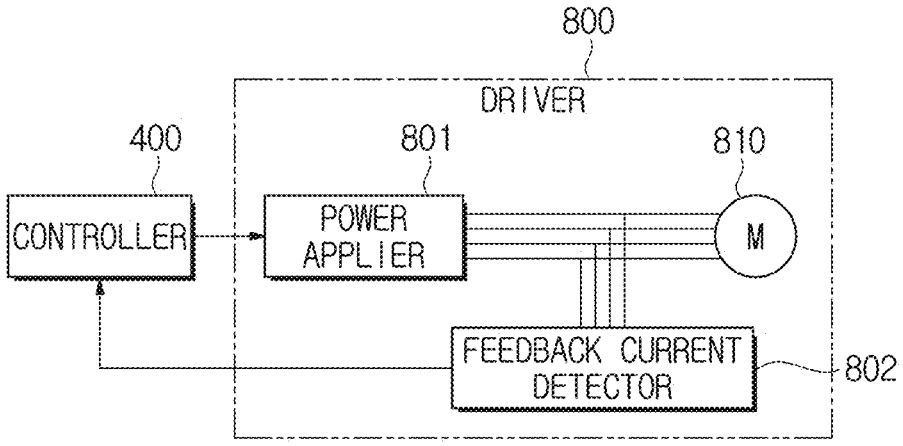
FIG. 33 is a block diagram of a method of measuring the weight of the laundry by measuring current and then using the measured current.

FIG. 33 is a block diagram of a method of measuring the weight of the laundry by measuring current and then using the measured current.

As illustrated in FIG. 33, according to one embodiment, the washing apparatus 1 may include the controller 400 and the driver 800, wherein the driver 800 may include the motor 810, a power applier 801 applying the power to the motor 810, and a feedback current detector 802 detecting a feedback current between the power applier 801 and the motor 810.

Particularly, a control signal transmitted from the controller 400 may be transmitted to the power applier 801 and the power applier 801 may change a rotational speed of the motor 810 by supplying the power to the motor 810 in response to the control signal. The power applier 801 may be implemented by various kinds of inverters.

The feedback current detector 802 may be provided as a circuit connecting the power applier 801 to the motor 810 or as a wire diverged between the power applier 801 and the motor 810. The feedback current detector 802 may detect the current or the feedback current flowing between the power applier 801 and the motor 810.

The feedback current may vary according to the load applied to the motor 810.

Figure 34A:
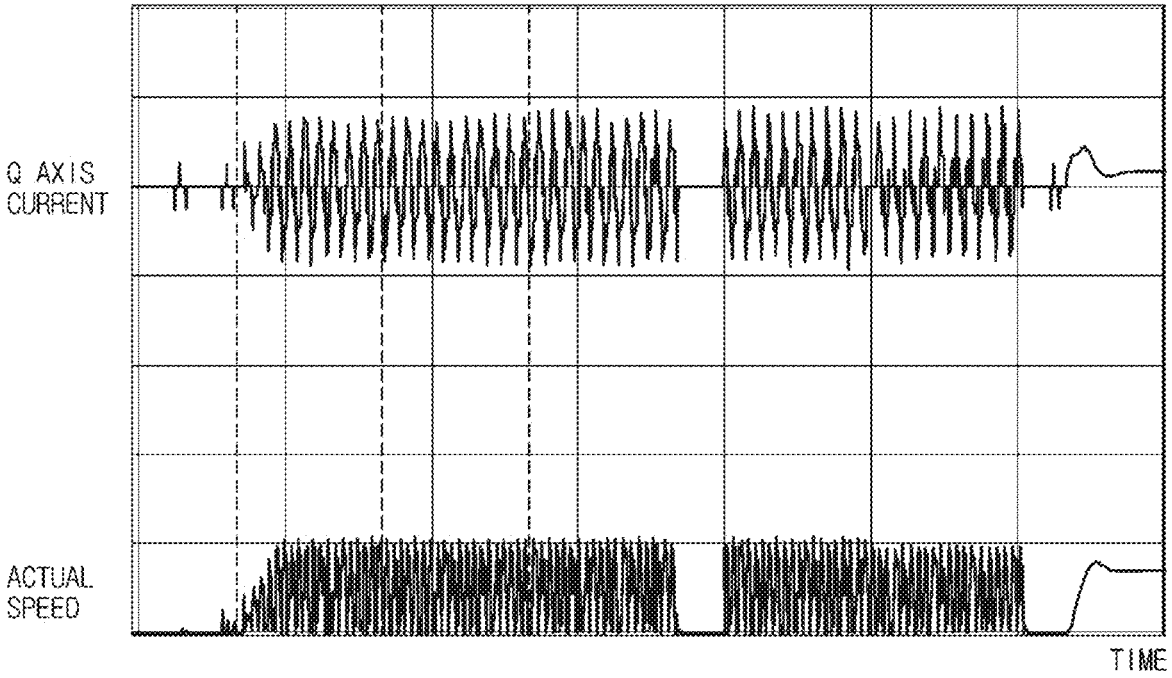
FIG. 34A is a view of a current output at low load.
Figure 34B:
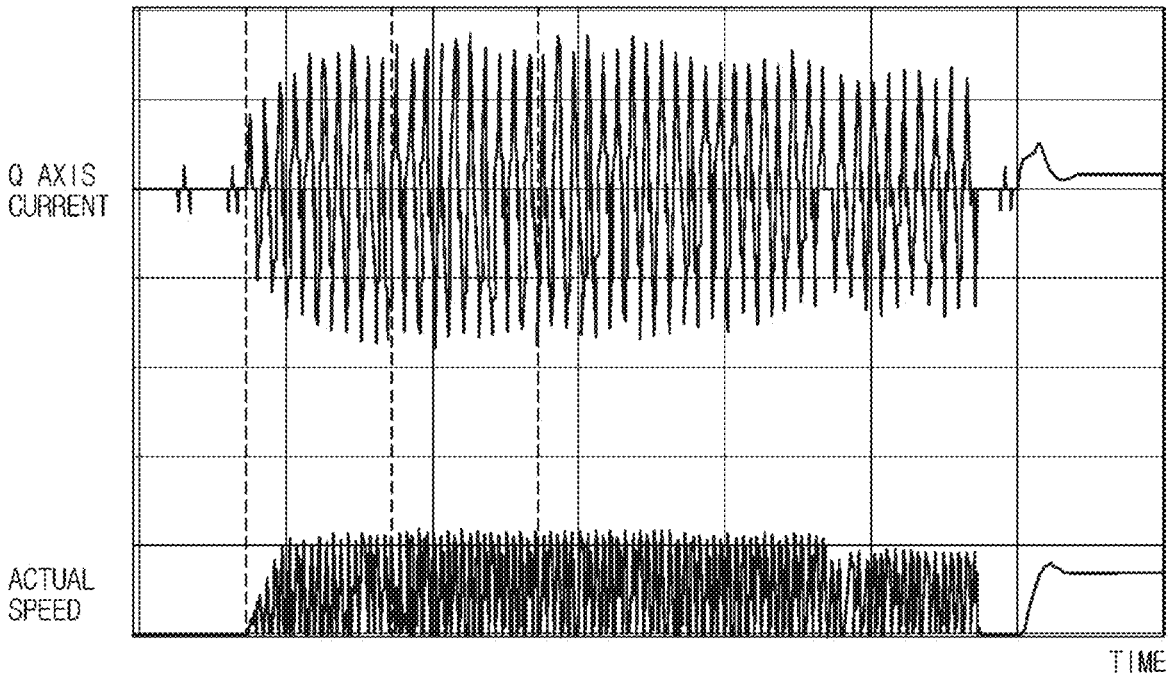
FIG. 34B is a view of a current output at middle load.

FIG. 34A is a view of a current output at low load and FIG. 34B is a view of a current output at middle load.

FIGS. 34A and 34B illustrate the measurement result of the current output from motor 810 according to the flow of the time when the pulsator 29 is rotated in the forward direction and the reverse direction. In this case, a brushless direct current (BLDC) motor configured to rotate the pulsator 29 in at least one of the forward direction and the reverse direction may be employed as the motor 810. However, the motor 810 is not limited to the BLDC motor, and thus a variety of motor may be employed as the motor 810 according to a designer's selection. In addition, when various kinds of motor are used for the motor 810, it may be possible to obtain the same or similar results shown in in FIGS. 34A and 34B.

Although the rotational speed of the motor 810 when load applied to the motor 810 is low, and the rotational speed of the motor 810, when load applied to the motor 810 is middle are the same or similar with each other, an amplitude of Q axis current measured when load applied to the motor 810 is low as illustrated in FIG. 34A, is relatively smaller than an amplitude of Q axis current measured when load applied to the motor 810 is middle, as illustrated in FIG. 34B.

Therefore, when detecting the magnitude of feedback current, it may be possible to detect the load applied to the motor 810 and since the load applied to the motor 810 is changed in proportion to the weight of the wet laundry, it may be possible to detect the weight of the wet laundry in the washing tub 20*a*.

In other words, when the feedback current is detected by the feedback current detector 802, as illustrated in FIG. 34A, the weight of the wet laundry may be determined to be relatively light since the load is small and, as illustrated in FIG. 34B, the weight of the wet laundry may be determined to be relatively heavy since the load is large. Therefore, it may be possible to estimate and detect the weight of the wet laundry in the washing tub 20*a*.

Referring to FIG. 33, the controller 400 may receive the magnitude of the current detected by the feedback current detector 802. As mentioned above, the controller 400 may measure the weight of the wet laundry based on the feedback current transmitted from the feedback current detector 802. Particularly, as illustrated in FIG. 19, the weight determiner 430 may receive the magnitude of the current detected by the feedback current detector 802 and measure the weight of the wet laundry based on the received magnitude of the current.

According to one embodiment, the controller 400 may perform the detection of the wet laundry weight using the magnitude of the current detected by the feedback current detector 802 or according to another embodiment, the controller 400 may calculate an average value of the magnitude of the current detected by the feedback current detector 802 and perform the detection of the wet laundry weight using the calculated average value of the magnitude of the feedback current.

According to one embodiment, the controller 400 may acquire an absolute value of the received magnitude of the feedback current and perform the detection of the wet laundry weight using the acquired absolute value of the magnitude of the feedback current. According to another embodiment, the controller 400 may calculate an average value of the absolute value of the magnitude of the current and perform the detection of the wet laundry weight using the calculated average value of the absolute value of the magnitude of the feedback current.

Since the magnitude of the feedback current is changed according to the distribution or the wetting property of the wet laundry for an initial period of time, e.g., 30 seconds, after supplying the washing water, the controller 400 may exclude the feedback current transmitted for the initial period of time and perform the detection of the wet laundry weight using only the feedback current transmitted after the certain period time is expired. In other words, the controller 400 may calculate an average value of the magnitude of the feedback current transmitted after the initial period time is expired, and perform the detection of the wet laundry weight using the calculated average value of the magnitude of the feedback current.

The controller 400 may pre-define a period of time for calculating the average value of the magnitude of the feedback current, and calculate the average value of the magnitude of the feedback current transmitted for the determined period of time. Sequentially, the controller 400 may perform the detection of the wet laundry weight using the calculated average value of the magnitude of the feedback current. For example, the controller 400 may average the magnitude of feedback current transmitted for a certain period of time, e.g., 30 seconds, after the initial period of time is expired, and perform the detection of the wet laundry weight using the acquired magnitude of the feedback current.

Hereinafter the magnitude of the feedback current or the average value of the magnitude of the feedback current acquired by the controller 400 will be described in detail with reference to FIGS. 35A to 35C.

Figure 35A:
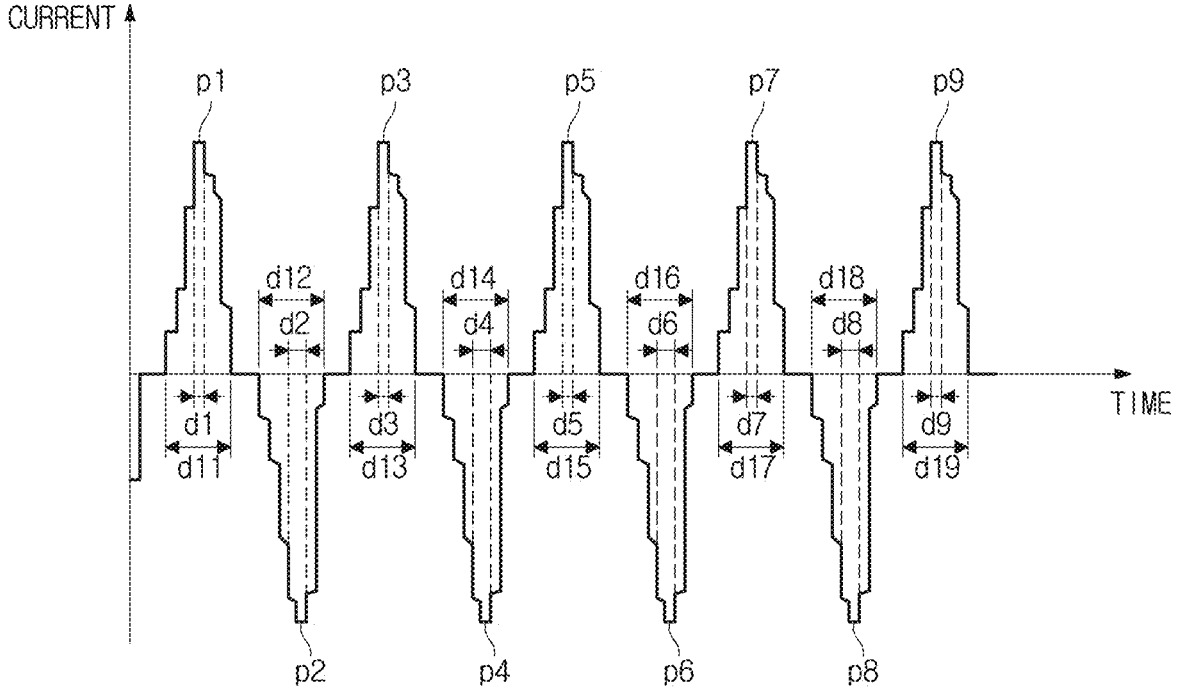
FIG. 35A is a view of an output current in details.

FIG. 35A is a view of an output current in details. FIG. 35B is a graph by connecting the magnitude of the current in the Q axis with respect to the time and FIG. 35C is a graph by connecting an average value of the magnitude of the current with respect to the time. FIGS. 35A to 35C illustrate the measurement result of the current output from motor 810 according to the flow of the time when the pulsator 29 is rotated in the forward direction and the reverse direction, as the same as FIGS. 34A and 34B. In this case, the BLDC motor may be employed as the motor 810.

Referring to FIG. 35A, the feedback current may be output in a sine wave from the motor 810 by the rotation of the pulsator 29 in the forward direction and the reverse direction. Particularly, the feedback current may include a plurality of pulses (p1 to p9), wherein the plurality of pulses (p1 to p9) may include a positive value or a negative value according to the rotation direction of the pulsator 29. For example, when the pulsator 29 is rotated in the forward direction, pulses (p1, p3, p5, p7 and p9) having a positive value may be detected, and in contrast, when the pulsator 29 is rotated in the reverse direction, pulses (p2, p4, p6 and p8) having a negative value may be detected. Alternatively, when the pulsator 29 is rotated in the reverse direction, pulses (p1, p3, p5, p7 and p9) having a positive value may be detected, and in contrast, when the pulsator 29 is rotated in the forward direction, pulses (p2, p4, p6 and p8) having a negative value may be detected, according to a designer's selection.

Figure 35B:
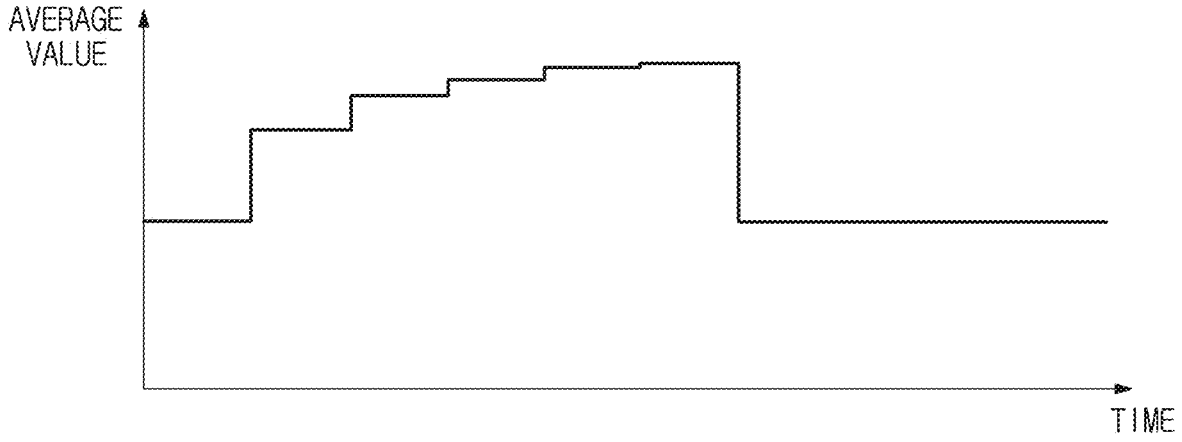
FIG. 35B is a graph by connecting the magnitude of the current in the Q axis with respect to the time.
Figure 35C:
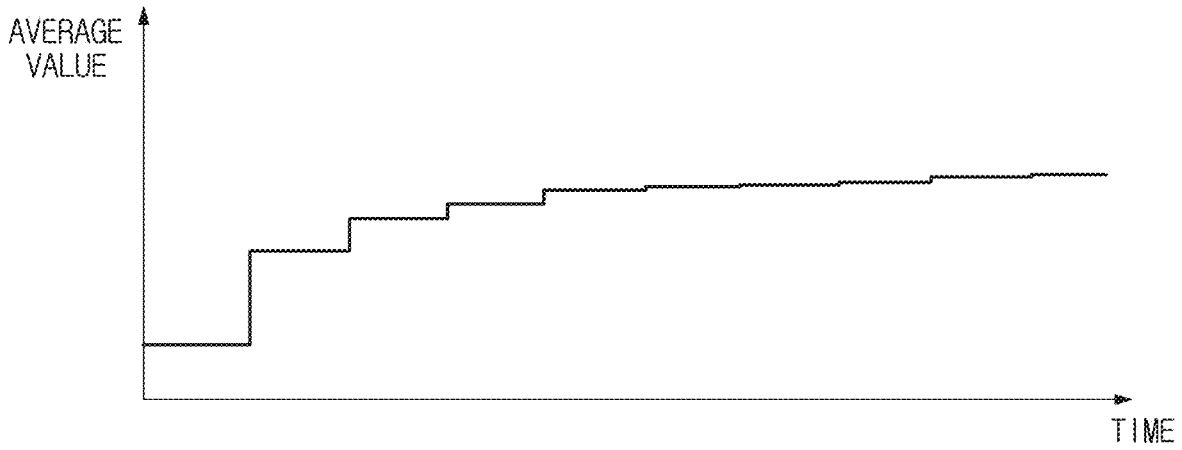
FIG. 35C is a graph by connecting an average value of the magnitude of the current with respect to the time.

The controller 400 may obtain the magnitude of the current from the pulses (p1 to p9), as illustrated in FIG. 35B, and obtain an average of the magnitude of the current, as illustrated in FIG. 35C.

For example, the controller 400, e.g., the weight determiner 430 (refer to FIG. 19) may obtain the magnitude of the current by measuring a peak current value in each pulse (p1 to p9). For another example, the controller 400 may measure the size of the pulses that is the magnitude of the current, for a certain duration (d1 to d9) and average the measured current. Sequentially, the controller 400 may obtain an absolute value of the average value to obtain the magnitude of the measured current, as illustrated in FIG. 35B. For another example, the controller 400 may obtain an absolute value of the measured current and obtain an average of the absolute value of the current measured for the certain duration (d1 to d9). Sequentially, the controller 400 may obtain the magnitude of the current, as illustrated in FIG. 35B. Alternatively, the controller 400 may obtain the magnitude of the current through a variety of methods.

For example, according to one embodiment, the controller 400 may measure a current of a first pulse (p1) for a certain duration, i.e., a first duration (d1), during the first pulse (p1) is output and calculate an average value of the current of the first pulse (p1) for the first duration (d1), thereby obtaining the magnitude of the current needed for measuring the weight. The first duration (d1) may represent a short duration from when a certain time before the first pulse (p1) reaches a peak until a certain time after the first pulse (p1) reaches a peak, and the first duration (d1) may be set to be shorter than a duration (d11), e.g. a width of the first pulse (p1), from when the first pulse (p1) is generated until the first pulse (p1) dissipates. In this case, the first duration (d1) may be set to be equal to or less than half the width of the first pulse (p1).

After the magnitude of the current in the first pulse (p1) is obtained, the controller 400 may measure the current of a second pulse (p2) for a certain duration i.e., a second duration (d2), during the second pulse (p2) is output, as mentioned above. The controller 400 may calculate an average of the current of the second pulse (p2) for the second duration (d2). In this case, the controller 400 may calculate an average of the current of the second pulse (p2) after obtaining an absolute value of the current of the second pulse (p2) or the controller 400 may calculate an absolute value of the current of the second pulse (p2) after obtaining an average of the current of the second pulse (p2). In the same manner as the first duration (d1), the second duration (d2) may represent a short duration from when a certain time before the second pulse (p2) reaches a peak until a certain time after the second pulse (p2) reaches a peak, and the second duration (d2) may be set to be shorter than a duration (d12), e.g. a width of the second pulse (p2), from when the second pulse (p2) is generated until the second pulse (p2) dissipates.

The controller 400 may calculate an average of the current of a third pulse (p3), a fifth pulse (p5), a seventh pulse (p7) and a ninth pulse (p9) in the same manner as the first pulse (p1), and calculate an average value of an absolute value or an absolute value of an average value the current of a fourth pulse (p4), a sixth pulse (p6), and an eighth pulse (p8) in the same manner as the second pulse (p2). The controller 400 may connect the calculated average value of the current to the calculated average value of the absolute value and obtain the magnitude of the current, as illustrated in FIG. 35B.

Referring to FIG. 35B, the magnitude of the current obtained by the controller 400 may be gradually increased at an early stage and then maintained as a certain value after a certain duration is expired. The controller 400 may detect a friction load of laundry using the certain value which is maintained after the certain duration is expired, and determine the weight of the laundry using the obtained friction load of laundry.

According to another embodiment, the controller 400 may obtain the magnitude of the current needed for measuring the weight by calculating an average value of the current for an entire duration (d11) in which the first pulse (p1) is output. The duration (d11) in which the first pulse (p1) is output may correspond to the width of the first pulse (p1).

After the magnitude of the current in the first pulse (p1) is obtained, as mentioned above, the controller 400 may calculate an average of the current of the second pulse (p2) for an entire duration (d12) in which the second pulse (p2) is output, and obtain an absolute value of the current of the second pulse (p2) or the controller 400 may calculate an average of the current of the second pulse (p2) after obtaining an absolute value of the current of the second pulse (p2). The duration (d12) in which the second pulse (p2) is output may correspond to the width of the second pulse (p2).

The controller 400 may calculate an average of the current of the third pulse (p3), the fifth pulse (p5), the seventh pulse (p7) and the ninth pulse (p9) in the same manner as the first pulse (p1), and calculate an average value of an absolute value or an absolute value of an average value the current of the fourth pulse (p4), the sixth pulse (p6), and the eighth pulse (p8) in the same manner as the second pulse (p2). The controller 400 may connect the calculated average value of the current to the calculated average value of the absolute value and obtain the magnitude of the current, as illustrated in FIG. 35C.

Referring to FIG. 35C, the average value of the absolute value or the absolute value of the average value of the magnitude of the current obtained by the controller 400 may be gradually increased at an early stage and then maintained as a certain value after a certain duration is expired. The controller 400 may detect a friction load of laundry using the certain value which is maintained after the certain duration is expired, and determine the weight of the laundry using the obtained friction load of laundry.

As mentioned above, when the magnitude of the feedback current or the average value of the magnitude of the feedback current is obtained, the weight determiner 430 of the controller 400 may detect the weight of the wet laundry using the magnitude of the feedback current or the average value of the magnitude of the feedback current, and for this the controller 400 may use additional data base or a certain equation.

Hereinbefore an example of the detection of the wet laundry weight using the pulsator 29 and the magnitude of the current has been described, but the method is not limited thereto. For example, the detection of the wet laundry weight may be measured using a variety of methods, e.g., the rotational speed of the pulsator 29, the water level of the washing water in the washing tub 20*a*, or the rotational speed of the rotating tub 22.

A control flow of the washing apparatus 1 according to another embodiment will be described with reference to FIG. 36.

Figure 36:
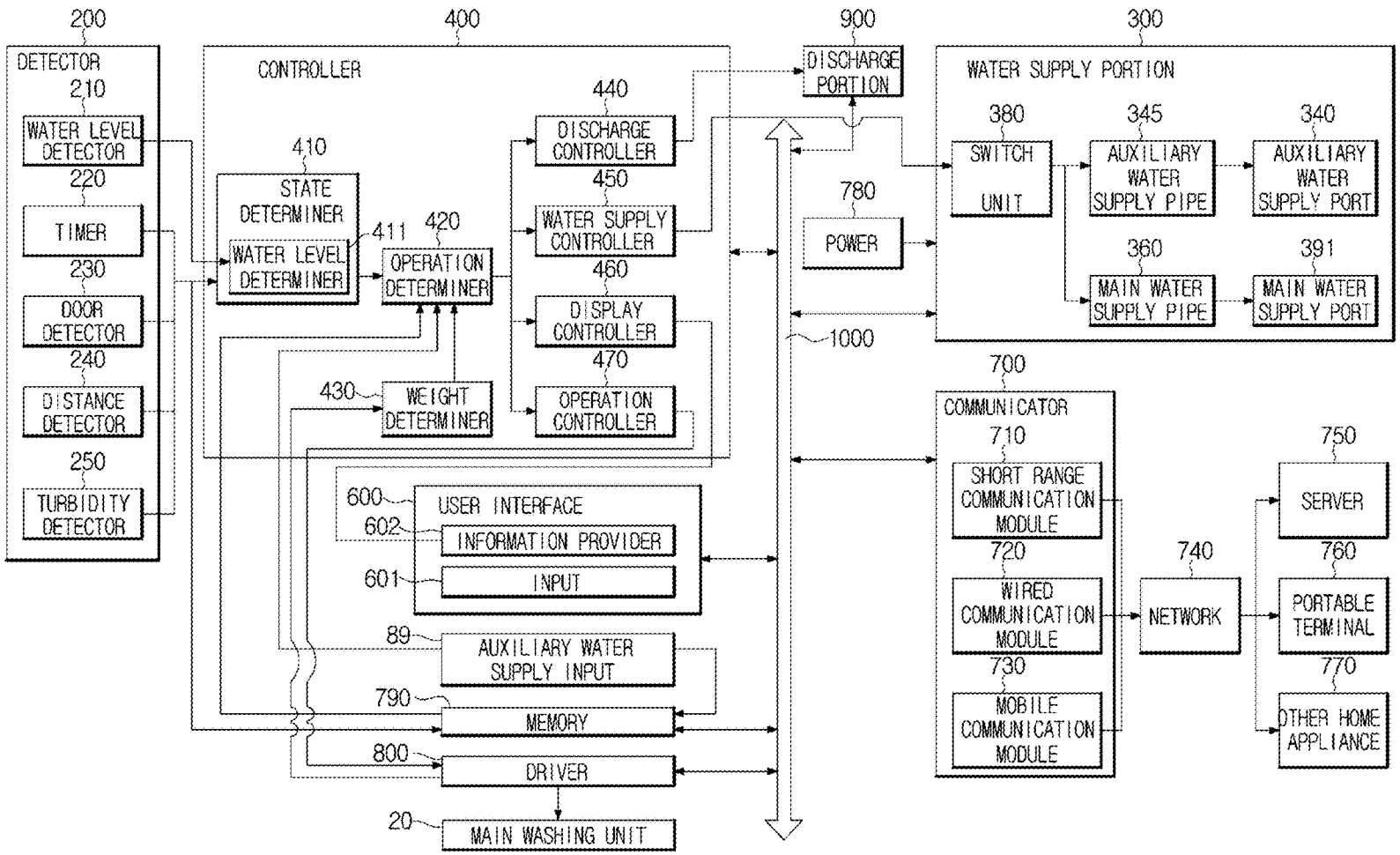
FIG. 36 is a block diagram of a washing apparatus according to another embodiment of the present disclosure.

FIG. 36 is a block diagram of a washing apparatus according to another embodiment of the present disclosure.

According to another embodiment, as illustrated in FIG. 36, the washing apparatus 1 may include a detector 200, a washing water supply portion 300, a controller 400, a user interface 600, a communicator 700, a power 780, a memory 790, a driver 800 and a discharge portion 900.

The detector 200 is a device to detect operation states or ambient conditions of the washing apparatus 1 to output an electrical signal corresponding to a detection result.

Particularly, the detector 200 may include at least one of a water level detector 210 to detect a water level of remaining water inside of the fixed tub 21, a timer 220 to detect an auxiliary washing input time and an auxiliary water supply time, a door detector 230 to detect whether a main door 110 is opened or closed, a distance detector 240 to detect a distance between users and the washing apparatus 1, and a turbidity detector 250 to detect a turbidity of the washing water.

The water level detector 210 may be provided inside of the fixed tub 21 to detect a water level of remaining water inside of the fixed tub 21. The water level detector 210 may generate an electrical signal corresponding to the result of the detection and transmit the electrical signal to a water level determiner 411 of a state determiner 410.

According to one embodiment, the water level detector 210 may detect a water level of remaining water inside of the fixed tub 21 by using a mechanical water level detection method, a water level detection method using a semiconductor pressure sensor, a water level detection method using capacitance. The water level detection method of the water level detector 210 has been described and thus a description thereof will be omitted.

An operation of the timer 220, the door detector 230 and the distance detector 240 has been described with reference to FIG. 19 and thus a description thereof will be omitted.

The water supply portion 300 may receive a control signal of the controller 400, particularly the water supply controller 450, and supply at least one of the washing water and the detergent to the auxiliary door 150 and the washing unit 20 in response to the received control signal. A description of the water supply portion 300 has been described and thus a detail description thereof will be omitted.

The controller 400 may control the entire operation of the washing apparatus 1. According to one embodiment, the controller 400 may perform at least one of the detection of the dry laundry weight or the detection of the wet laundry weight based on the water level detected by the water level detector 210, and as needed, the controller 400 may allow at least one of the washing water supply portion 300, the information provider 602, the driver 800 and the discharge portion 900 to be operated to perform at least one of the detection of the dry laundry weight or the detection of the wet laundry weight.

As illustrated in FIG. 36, the controller 400 may include the state determiner 410, a weight determiner 430, a discharge controller 440, a water supply controller 450, a display controller 460 and an operation controller 470. According to embodiments, some of the components from the state determiner 410 to the operation controller 470 may be omitted.

The state determiner 410 may receive an electrical signal output as a result of the detection by the detector 200, and then the state determiner 410 may determine a current state of the washing apparatus based on the received information.

According to another embodiment, the state determiner 410 may include the water level determiner 411. The water level determiner 411 may analyze the electrical signal transmitted from the water level detector 210 to determine a water level of washing water 5 put into the washing tub 20*a*. The determined water level may be transmitted to the operation determiner 420.

In addition, the state determiner 410 may receive information related an input time of an auxiliary washing start signal, an auxiliary water supply time, whether the main door 110 is opened or closed, a distance between a user and the washing apparatus 1, and whether to operate the auxiliary water supply input 89 all of which are detected by the detector 200 and then determine a current state of the washing apparatus 1 based on the received information.

The operation determiner 420 may determine an operation that is to be performed by the washing apparatus 1.

According to another embodiment, the operation determiner 420 may determine an operation of the washing apparatus 1 based on the water level of the washing water 5 transmitted from the water level determiner 411. Particularly, the operation determiner 420 may compare predetermined at least one water level (RLV1 to RLV10 in FIG. 37) with the water level of the washing water 5 transmitted from the water level determiner 411 and determine an operation of each component of the washing apparatus 1 according to a result of the comparison. For example, according to the result of the comparison, the operation determiner 420 may determine whether the detection of the dry laundry weight is performed or the detection of the wet laundry weight is performed, whether to more supply the washing water to the washing tub 20*a*, or whether to perform the washing operation.

Figure 37:
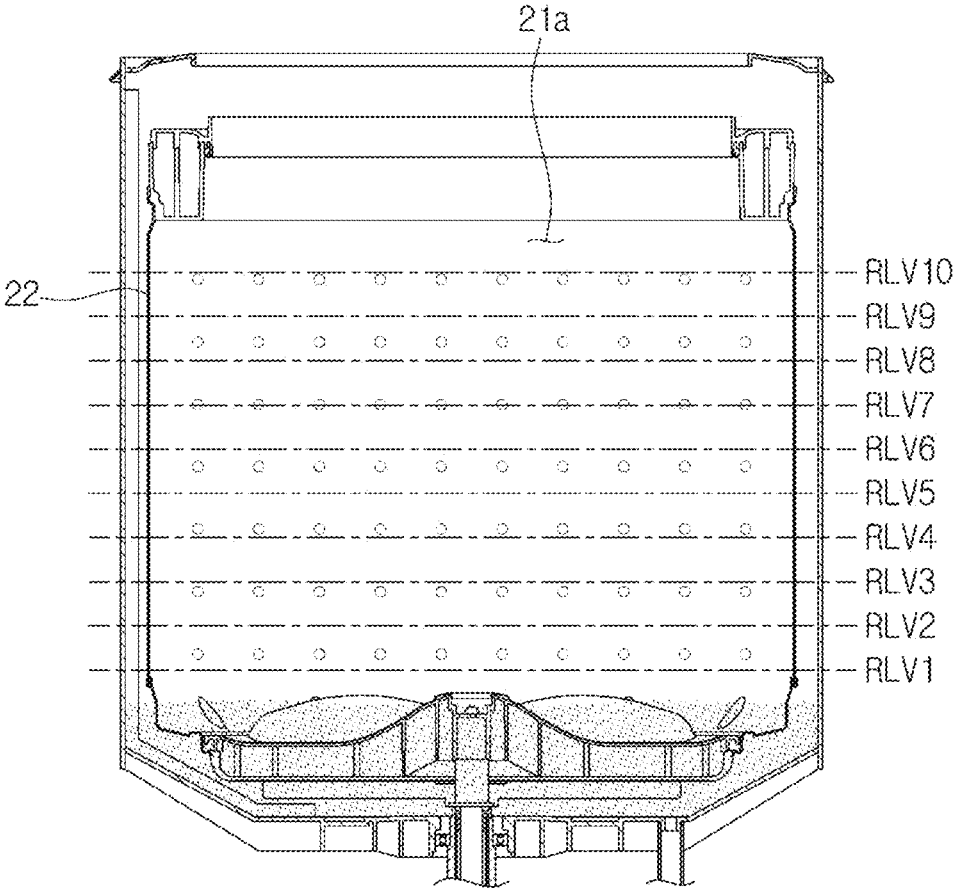
FIG. 37 is a view of an example of at least one predetermined water level.

FIG. 37 is a view of an example of at least one predetermined water level.

As mentioned above, the operation determiner 420 may compare at least one predetermined water level (RLV1 to RLV10) with the water level of the washing water 5 transmitted from the water level determiner 411.

At least one water level (RLV1 to RLV10) may be defined to indicate or to compare a water level of washing water put into the main washing space 21*a*. For example, the at least one water level (RLV1 to RLV10) may be defined as a virtual surface configured to divide the main washing space 21*a* inside of the washing tub 20*a*, as illustrated in FIG. 37.

Particularly, in the main washing space 21*a* inside of the washing tub 20*a*, at least one virtual surface may be defined to divide the main washing space 21*a* into at least one region. Each virtual surface may be configured to divide the height from the bottom of the washing tub 20*a* to the upper end of the washing tub 20*a* into a plurality of regions. The virtual surface dividing the main washing space 21*a* into the plurality of regions may be horizontal about a water surface of the washing water in a state in which the washing water is put into the main washing space 21*a*. In other words, a normal line of the water surface may coincide with a normal line of the virtual surface. The virtual surface may be defined as at least one water level (RLV1 to RLV10).

As illustrated in FIG. 37, the at least one predetermined water level (RLV1 to RLV10) may be configured to divide the main washing space 21*a* in the washing tub 20*a* into eleven regions. In other words, in the main washing space 21*a* in the washing tub 20*a*, ten water levels (RLV1 to RLV10) may be defined. Hereinafter each water level (RLV1 to RLV10) may be referred to as a first water level to a tenth water level in which the first water level is the closest to the bottom of the washing tub 20*a* and the tenth water level is the furthest from the bottom of the washing tub 20*a*. When the water levels (RLV1 to RLV10) divides the main washing space 21*a* in the washing tub 20*a* into eleven regions, the lowest water level, i.e., the first water level (RLV1) may be defined as a reference surface passing through the pulsator 29 or a reference surface just above the pulsator 29. In addition, the upper most water level, i.e., the tenth water level (RLV10) may be defined as a reference surface passing through an upper end of the washing tub 20*a* or a reference surface just below the upper end of the washing tub 20*a*. Alternatively, the water level (RLV1 to RLV10) may be defined in a variety of manners, according to a designer's selection.

A distance among each water level (RLV1 to RLV10), i.e., a difference in the height between the virtual surfaces may be identical to each other. For example, a distance between the first water level (RLV1) and the second water level (RLV2), a distance between the second water level (RLV2) and the third water level (RLV3), and a distance between a kth water level and a kth+1 water level may be identical to each other. According to embodiments, a distance between some water levels may be identical to each other or a distance between other water levels may be different from each other. Alternatively, each distance between water levels (RLV1 to RLV10) may be different from each other, and a distance between water levels (RLV1 to RLV10) may be determined according to a designer's selection.

The reference water level may be determined as at least one of the at least one water level (RLV1 to RLV10) defined as mentioned above. In this case, according to a designer's selection, a plurality of reference water levels may be defined, wherein the plurality of reference water levels may be different from each other. For example, a first reference water level is defined as the first water level (RLV1), a second reference water level is defined as the second water level (RLV2), and a third reference water level is defined as the sixth water level (RLV6). Alternatively, different reference water levels may be defined as the same water level. For example, the first reference water level and the second reference water level may be defined as the first water level (RLV1). In addition, the reference water level may be defined in a variety of manner according to a designer's selection.

The operation determiner 420 may compare a current water level of the washing water 5 put into the washing tub 20*a* with at least one reference water level which is defined as mentioned above, and transmit a result of the comparison to at least one of the discharge controller 440, the water supply controller 450, the display controller 460 and the operation controller 470. Accordingly, each component of the washing apparatus 1, e.g., at least one of the water supply portion 300 and the washing unit 20, may be allowed to operate.

For example, in a state in which the first reference water level is defined as the first water level (RLV1), when the current water level of the washing water 5 is lower than the first reference water level, i.e., the first water level (RLV1), the operation determiner 420 may determine the detection of the dry laundry weight and transmit a result of the determination to the operation controller 470 and the weight determiner 430 so that the detection of the dry laundry weight is performed. In this case, the operation determiner 420 may transmit the result of the determination about whether to perform the detection of the dry laundry weight, to the display controller 460 so that the information provider 602 may display the result of the determination about whether to perform the detection of the dry laundry weight to a user.

In addition, when the current water level of the washing water 5 is higher than the first reference water level, i.e., the first water level (RLV1), the operation determiner 420 may determine the detection of the wet laundry weight and transmit a result of the determination to the water supply controller 450 so that washing water is supplied to a certain target water level. In addition, the operation determiner 420 may transmit the result of the determination to the operation controller 470 so that the detection of the wet laundry weight may be performed as mentioned above.

The certain water level may represent that washing water is supplied to which level. In other words, when the certain water level is determined, the washing water may be supplied to the washing tub 20*a* until a water level of the washing water reaches a certain target water level.

According to one embodiment, the target water level may be defined as any one of the plurality of water levels (RLV1 to RLV10) provided in the washing tub 20*a*, in the same manner as the reference water level. For example, a first target water level and a second target water level are defined as the second water level (RLV2) and a third target water level is defined as the sixth water level (RLV6). A fourth target water level may be defined as the tenth water level (RLV 10). In this case, each target water level may be defined as different water levels, and as mentioned above, the plurality of target water levels, i.e., the first target water level and the second target water level, may be defined as the same water level, e.g., the second water level (RLV2). According to another embodiment, the target water level may be defined as a water level which is set different from the above-mentioned water level (RLV1 to RLV10). That is, the target water level may be defined using a water level defined differently from FIG. 37. In addition, the target water level may be defined in a variety of manner according to a designer's selection. Hereinafter for convenience of description, a case in which the target water level is defined by using the first water level to the tenth water level (RLV1 to RLV10) as illustrated in FIG. 37 will be described as an example.

According to one embodiment, when a water level of the washing water 5 is higher than the first reference water level, i.e., the first water level (RLV1), the operation determiner 420 may transmit a result of the determination to the water supply controller 450 and the water supply controller 450 may control the water supply portion 300 in response to the transmitted electrical signal so that the washing water may be supplied to the second target water level or the third target water level.

When the water level of the washing water 5 is between the first reference water level and the second reference water level, i.e., between the first water level (RLV1) and the second water level (RLV2), the operation determiner 420 may transmit a result of the determination about the current water level to the water supply controller 450 and the water supply controller 450 may control the water supply portion 300 so that the washing water may be supplied to the second target water level, e.g., the second water level (RLV2). When the water level of the washing water 5 is between the second reference water level and the third reference water level, i.e., between the second water level (RLV2) and the sixth water level (RLV6), the operation determiner 420 may control the water supply portion 300 so that the washing water may be supplied to the third target water level, e.g., the sixth water level (RLV6). When the water level of the washing water 5 is higher than the third reference water level, i.e., between the sixth water level (RLV6) and the tenth water level (RLV10), the operation determiner 420 may control the water supply portion 300 so that the washing water may be supplied to the fourth target water level, e.g., the tenth water level (RLV10).

As mentioned above, when the washing water is supplied to the second, third, and fourth target water level, the operation controller 470 may control the driver 800 according to the result of the determination of the operation determiner 420 so that the detection of the wet laundry weight is performed.

As mentioned above, the weight determiner 430 may be configured to determine the weight of the laundry in the washing tub 20*a*. For example, the weight determiner 430 may determine the weight of the laundry in the washing tub 20*a* using a variety of information acquired by an operation of at least one of the rotating tub 22 and the pulsator 29. The weight determiner 430 may determine the weight of the laundry 3 using the friction load of the pulsator 29 of the driver 800 operated by the control of the operation controller 470 or the rotation inertia of the rotating tub 22, and then the weight determiner 430 may transmit the result of the determination to the operation determiner 420.

According to one embodiment, the weight determiner 430 may temporarily or non-temporarily store the determined weight in the memory 790. In addition, when the weight determiner 430 determines the weight of the laundry by a plurality of times using a variety of methods, the weight determiner 430 may individually store the determined weight to determine the weight of the laundry 3 by comparing the stored weight.

For example, the weight determiner 430 may store the weight of the laundry 3 by performing the detection of the dry laundry weight and then store the weight of the laundry 3 by performing the detection of the wet laundry weight. When the obtained weight by the detection of the wet laundry weight is heavier than a certain weight, the weight determiner 430 may determine that the result of the detection of the dry laundry weight is correct, and transmit the determined result of the detection of the dry laundry weight to the operation determiner 420. In contrast, the weight determiner 430 may store the weight of the laundry 3 by performing the detection of the dry laundry weight and then store the weight of the laundry 3 by performing the detection of the wet laundry weight. When the obtained weight by the detection of the wet laundry weight is lighter than a certain weight, the weight determiner 430 may determine that the result of the detection of the wet laundry weight is correct, and transmit the determined result of the detection of the wet laundry weight to the operation determiner 420.

The operation determiner 420 may determine how to operate the washing operation according to the result of the determination of the weight by the weight determiner 430, and transmit a result of the determination to at least one of the discharge controller 440, the water supply controller 450, the display controller 460 and the operation controller 470 thereby performing a certain washing operation.

A method of controlling the washing apparatus according to another embodiment of the present disclosure will be described with reference to FIGS. 38 to 47.

Figure 38:
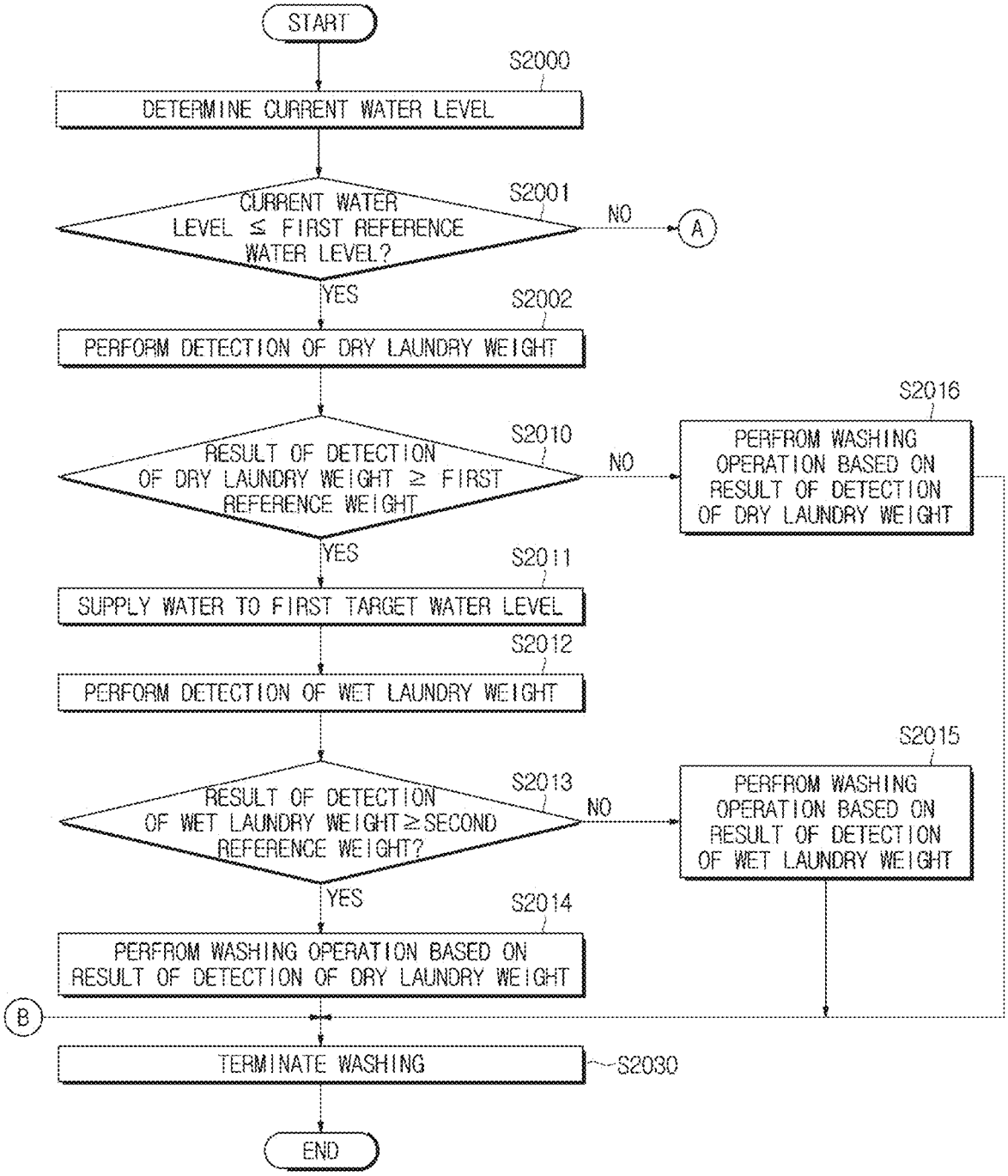
FIG. 38 is a first flowchart of a method of controlling of the washing apparatus according to another embodiment of the present disclosure.
Figure 39:
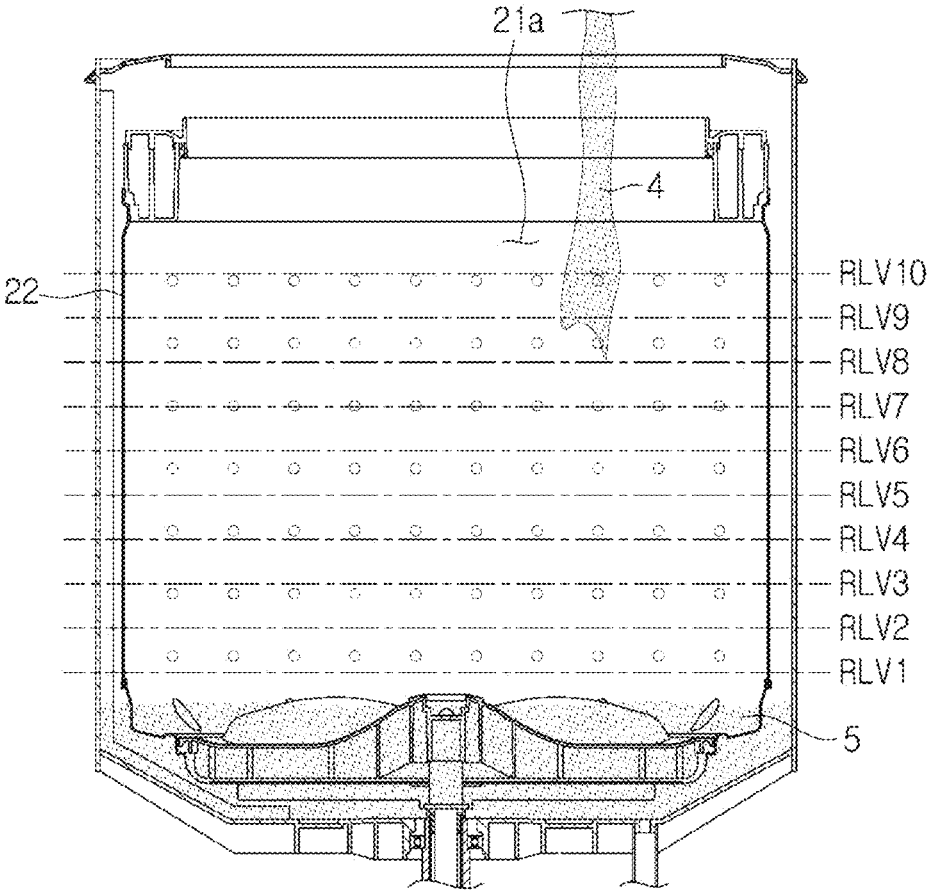
FIG. 39 is a view illustrating a state in which a water level of the washing water is lower than a first reference water level.
Figure 40:
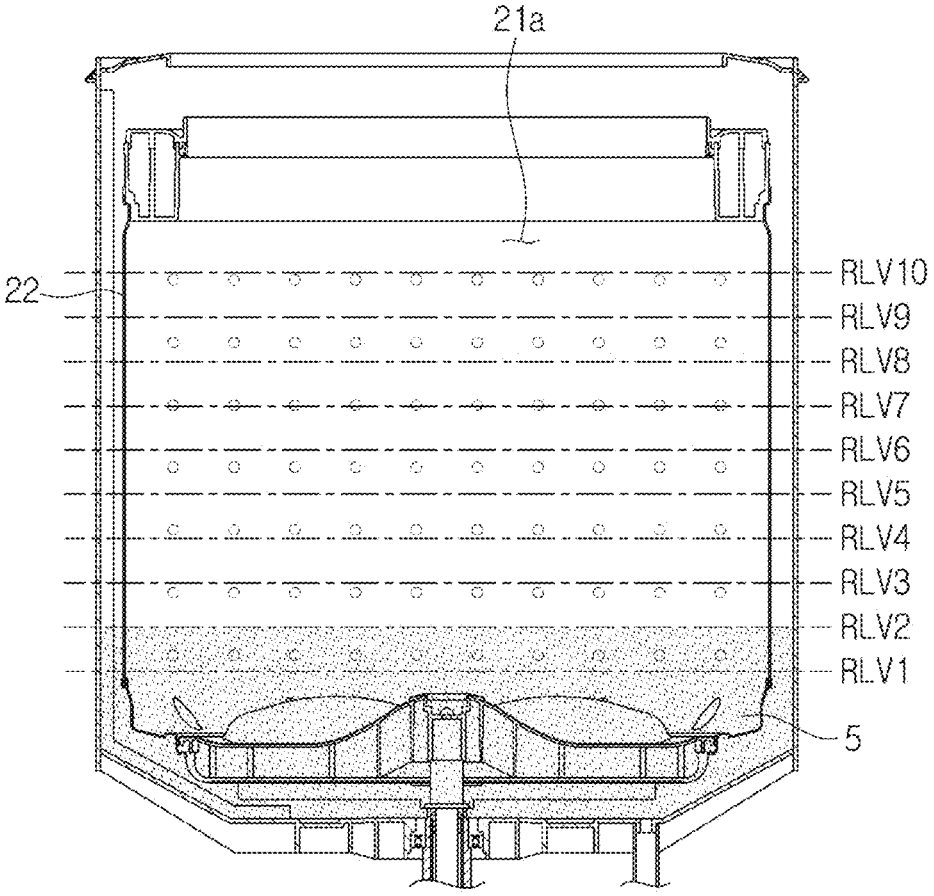
FIG. 40 is a view of an example of supplying the washing water to a first target water level.

FIG. 38 is a first flowchart of a method of controlling of the washing apparatus according to another embodiment of the present disclosure. FIG. 39 is a view illustrating a state in which a water level of the washing water is lower than a first reference water level and FIG. 40 is a view of an example of supplying the washing water to a first target water level.

As illustrated in FIG. 38, the state determiner 410 of the controller 400 determines a water level in the inside of the washing tub 20*a* (2000). The state determiner 410 may analyze an electrical signal transmitted from the water level detector 210 and determine the water level of the washing water 5 put into the washing tub 20*a*. The water level detector 210 may detect the water level of the inside of the washing tub 20*a* by using at least one of the mechanical water level detection method, the water level detection method using a semiconductor pressure sensor, and the water level detection method using capacitance.

The controller 400 may compare the current water level with a first reference water level (2001). As illustrated in FIG. 39, when the current water level is lower than the first reference water level (Yes in 2001), the controller 400 may perform the detection of the dry laundry weight (2002). The first reference water level may be randomly determined by a designer's selection, i.e., the first reference water level may be a first water level (RLV1).

As mentioned in FIGS. 21 to 26, the detection of the dry laundry weight may be performed using the pulsator 29 or the rotating tub 22. The weight of the laundry 3 obtained by the detection of the dry laundry weight (2002) may be temporarily or non-temporarily stored in the memory 790.

When the weight of the laundry 3 is measured by the detection of the dry laundry weight, the controller 400 may compare a first reference weight (2010). The first reference weight may be randomly defined by a designer's selection. For example, the first reference weight may be defined as the weight of washing water supplied to a sixth water level (RLV6).

Based on the result of the comparison between the first reference weight and the weight obtained by the detection of the dry laundry weight, when the weight of the laundry obtained by the detection of the dry laundry weight, is heavier than the first reference weight (Yes in 2010), the controller 400 may control the water supply portion 300 so that the water supply portion 300 supplies the washing water 4 to the inside of the main washing space 21*a* until the water level of the washing water 5 reaches the first target water level, as illustrated in FIGS. 39 and 40. The first target water level may be randomly determined by a designer's selection, i.e., the first target water level may be a second water level (RLV2).

According to one embodiment, when the weight of the laundry obtained by the detection of the dry laundry weight, is heavier than the first reference weight (Yes in 2010), the controller 400 may control the information provider 602 of the user interface 600 so that the information provider 602 displays the result of the detection of the dry laundry weight or the information provider 602 displays information related to whether to supply the washing water 4. Therefore, a user may recognize that the washing water 4 is additionally supplied to the inside of the rotating tub 22. The result of the detection of the dry laundry weight or the supply of the washing water 4 may be displayed prior to the supply of the water (2011).

When the washing water 4 is supplied to the first target water level, the controller 400 may perform the detection of the wet laundry weight (2012).

As mentioned in FIGS. 30 to 35C, the detection of the wet laundry weight may be performed using the pulsator 29 or the rotating tub 22.

According to embodiments, when the detection of the wet laundry weight is performed, the controller 400 may correct the weight of the laundry 3 by considering the washing water 5 that is put into the main washing space 21*a*. For example, the controller 400 may determine the weight of the laundry 3 by subtracting the weight of the weight of the washing water 5, which is supplied to the first target water level, from the weigh obtained by the detection of the wet laundry weight.

When the weight of the laundry 3 is obtained by the detection of the wet laundry weight, the controller 400 may compare a second reference weight with the obtained weight of the laundry 3 (2013). The second reference weight may be randomly defined according to a designer's selection. According to embodiments, the second reference weight may be defined to be the same as the first reference weight. For example, the second reference weight may be defined to be the same as the weight of the washing water supplied to the sixth water level (RLV6). According to embodiments, the second reference weight may be defined to be heavier or lighter than the first reference weight.

Based on the result of the comparison between the second reference weight and the weight obtained by the detection of the wet laundry weight, when the weight of the laundry obtained by the detection of the wet laundry weight, is heavier than the second reference weight (Yes in 2013), the controller 400 may allow the washing operation to be performed (2014) by using the weight of the laundry 3 obtained by the detection of the dry laundry weight (2002).

In other words, the washing apparatus 1 may perform the washing operation by using the weight of the laundry 3 obtained by the detection of the dry laundry weight (2002), instead of the weight of the laundry 3 obtained by the detection of the wet laundry weight. In this case, for example, the washing apparatus 1 may perform the washing operation that is pre-defined according to the weight corresponding to the second water level to the fifth water level (RLV2 to RLV 5).

In this case, by the control of the controller 400, the information provider 602 of the washing apparatus 1 may display a content indicating that the washing operation is performed by using the weight of the laundry 3 obtained by the detection of the dry laundry weight (2002), and provide the content to a user.

Based on the result of the comparison between the second reference weight and the weight obtained by the detection of the wet laundry weight, when the weight of the laundry obtained by the detection of the wet laundry weight, is lighter than the second reference weight (No in 2013), the controller 400 may control each component of the washing apparatus 1 so that the washing apparatus 1 performs the washing operation (2015) based on the weight of the laundry 3 obtained by the detection of the wet laundry weight (2012).

In other words, the washing apparatus 1 may perform the washing operation by using the weight of the laundry 3 obtained by the detection of the wet laundry weight (2012), instead of the weight of the laundry 3 obtained by the detection of the dry laundry weight (2002). In this case, for example, the washing apparatus 1 may perform the washing operation based on the weight corresponding to the sixth water level to the tenth water level (RLV6 to RLV 10).

In this case, by the control of the controller 400, the information provider 602 of the washing apparatus 1 may provide a content indicating that the washing operation is performed by using the weight of the laundry 3 obtained by the detection of the wet laundry weight (2012), to a user.

Based on the result of the comparison between the first reference weight and the weight obtained by the detection of the dry laundry weight, when the weight of the laundry obtained by the detection of the dry laundry weight, is lighter than the first reference weight (No in 2010), the controller 400 may control each component of the washing apparatus 1 to perform the washing operation by using the weight of the laundry 3 obtained by the detection of the dry laundry weight (2002) without supplying additional washing water (2016). Accordingly, the washing apparatus 1 may perform the washing operation by using the weight of the laundry 3 obtained by the detection of the dry laundry weight (2002).

In the same manner as mentioned above, by the control of the controller 400, the information provider 602 of the washing apparatus 1 may provide a content indicating that the washing operation is performed by using the weight of the laundry 3 obtained by the detection of the dry laundry weight (2002), to a user.

The washing operation may be operated based on the weight of the laundry 3 obtained by the detection of the dry laundry weight (2002) or the weight of the laundry 3 obtained by the detection of the wet laundry weight (2012), and then the washing operation may be completed (2030).

When the washing operation is completed, the information provider 602 of the washing apparatus 1 may display the completion of the washing operation to provide the completion of the washing operation to a user. As needed, the information provider 602 may further display information related to how to perform the washing operation, e.g., whether the washing operation is operated based on the result of the detection of the dry laundry weight or the result of the detection of the wet laundry weight.

Figure 41:
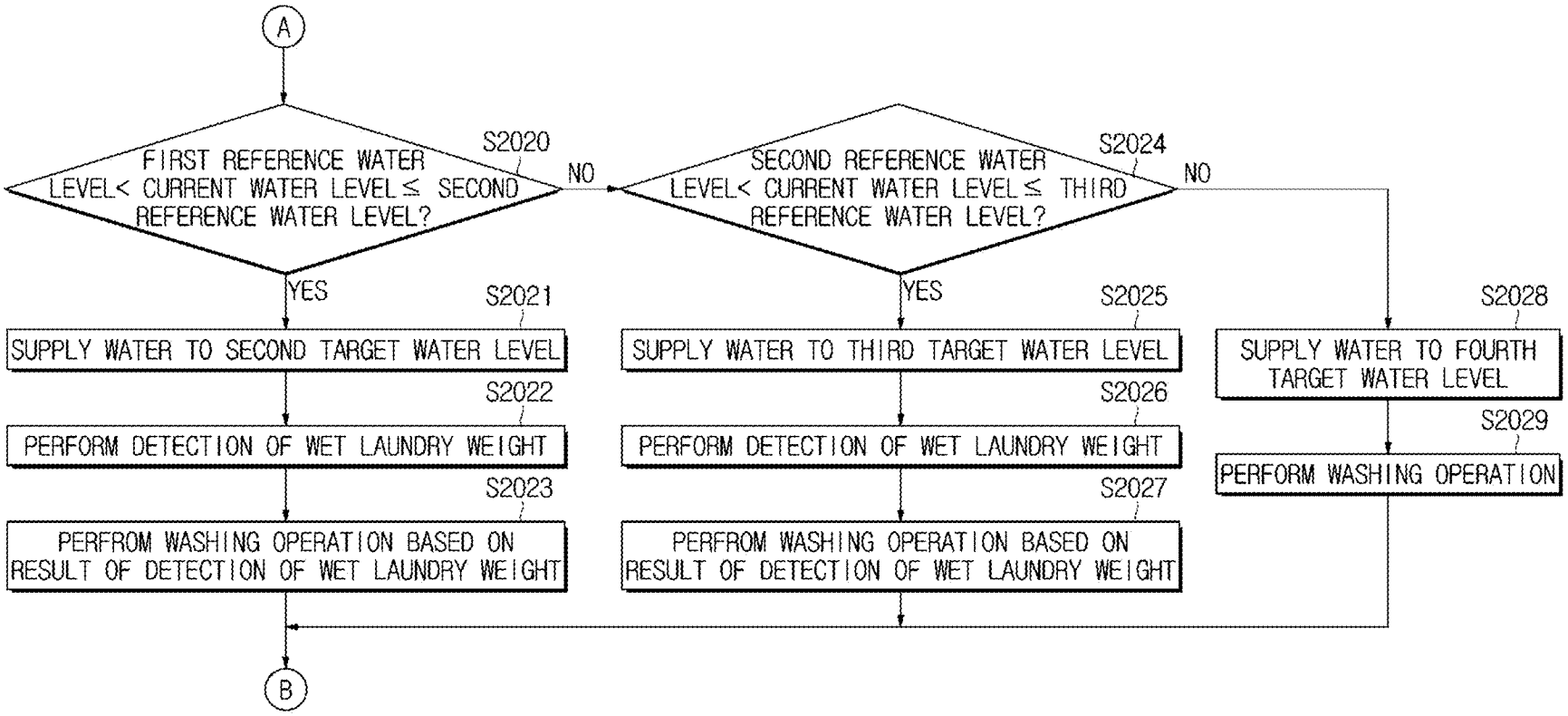
FIG. 41 is a second flowchart of another example of a method of controlling of the washing apparatus.
Figure 42:
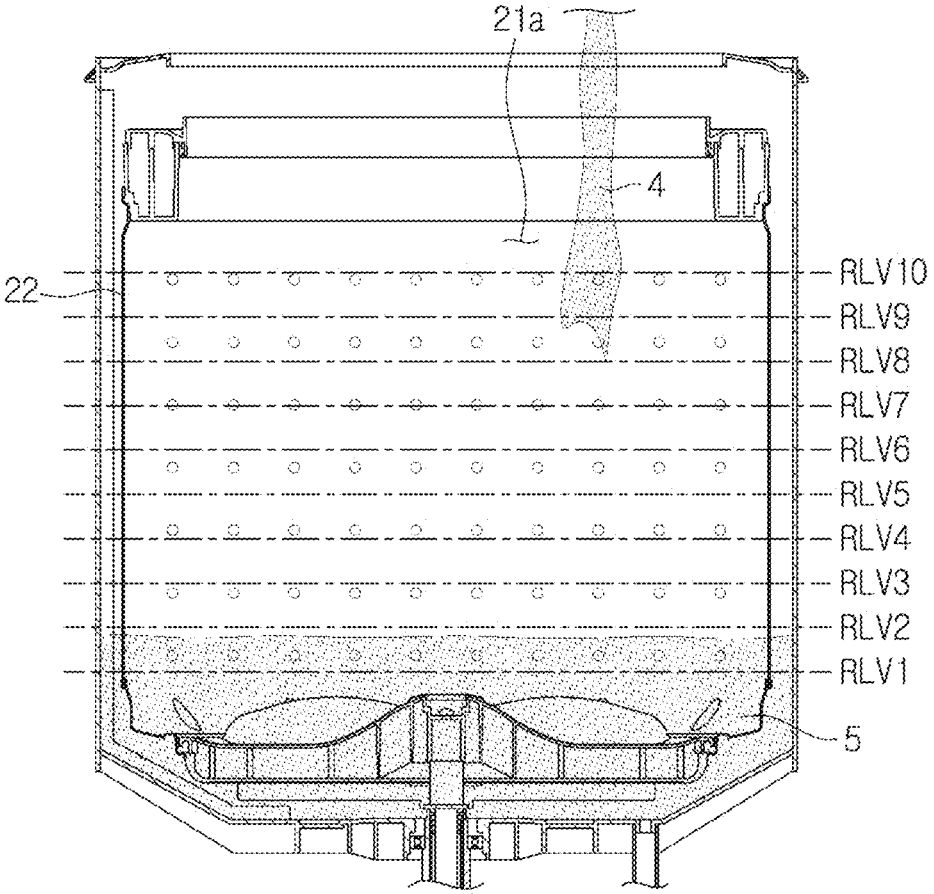
FIG. 42 is a view illustrating a state in which a water level of the washing water is lower than a second reference water level.
Figure 43:
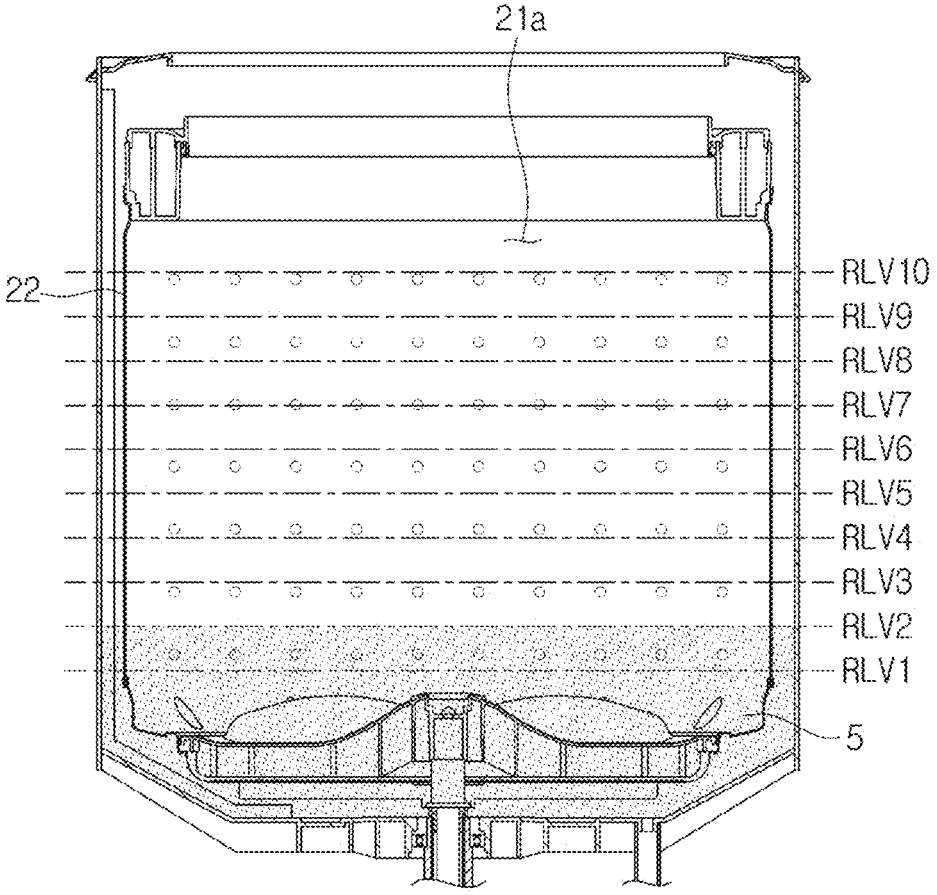
FIG. 43 is a view of an example of supplying the washing water to a second target water level.
Figure 44:
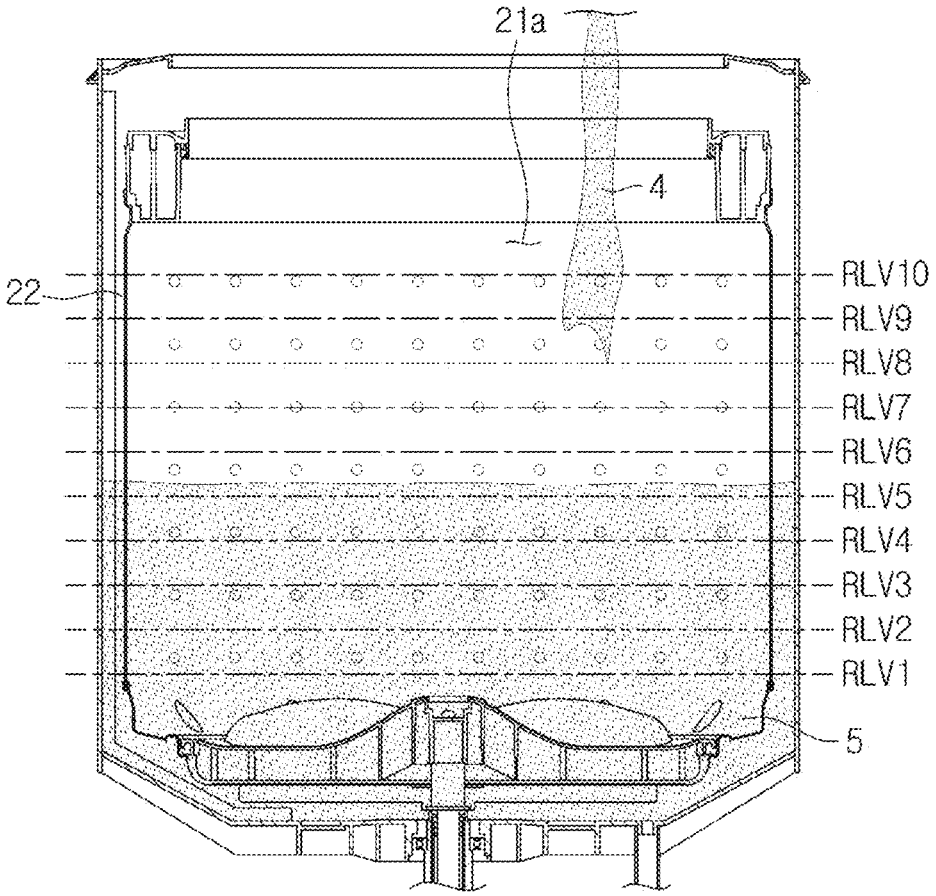
FIG. 44 is a view illustrating a state in which a water level of the washing water is lower than a third reference water level.
Figure 45:
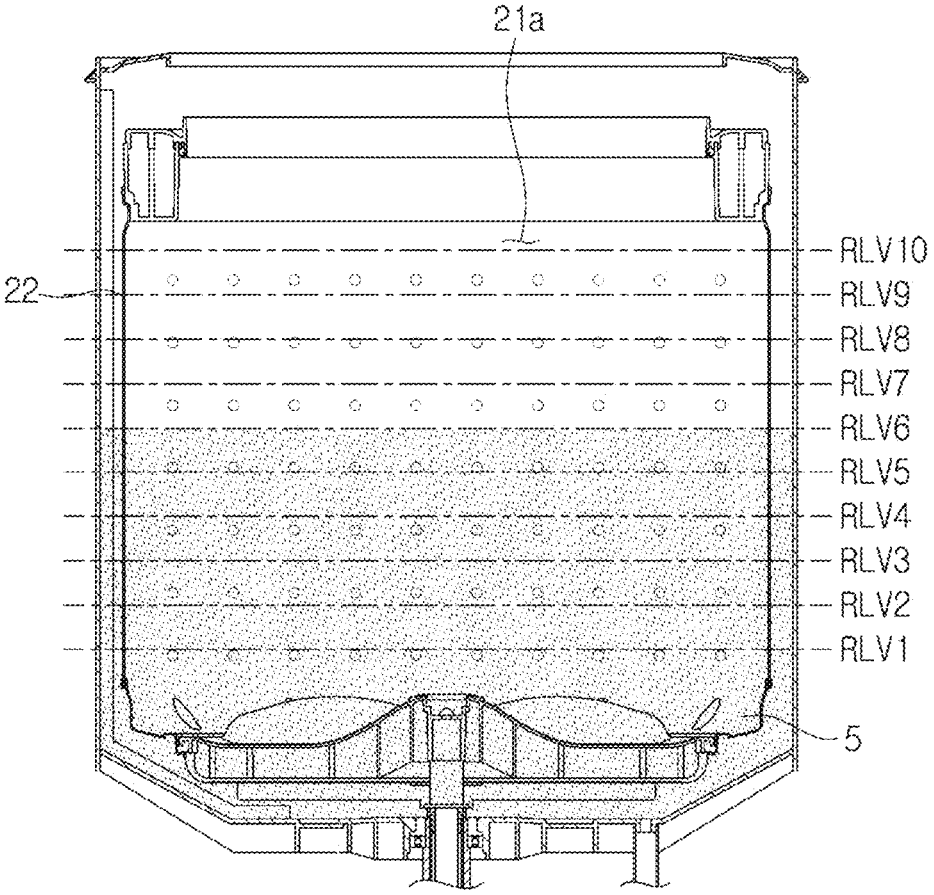
FIG. 45 is a view of an example of supplying the washing water to a third target water level.
Figure 46:
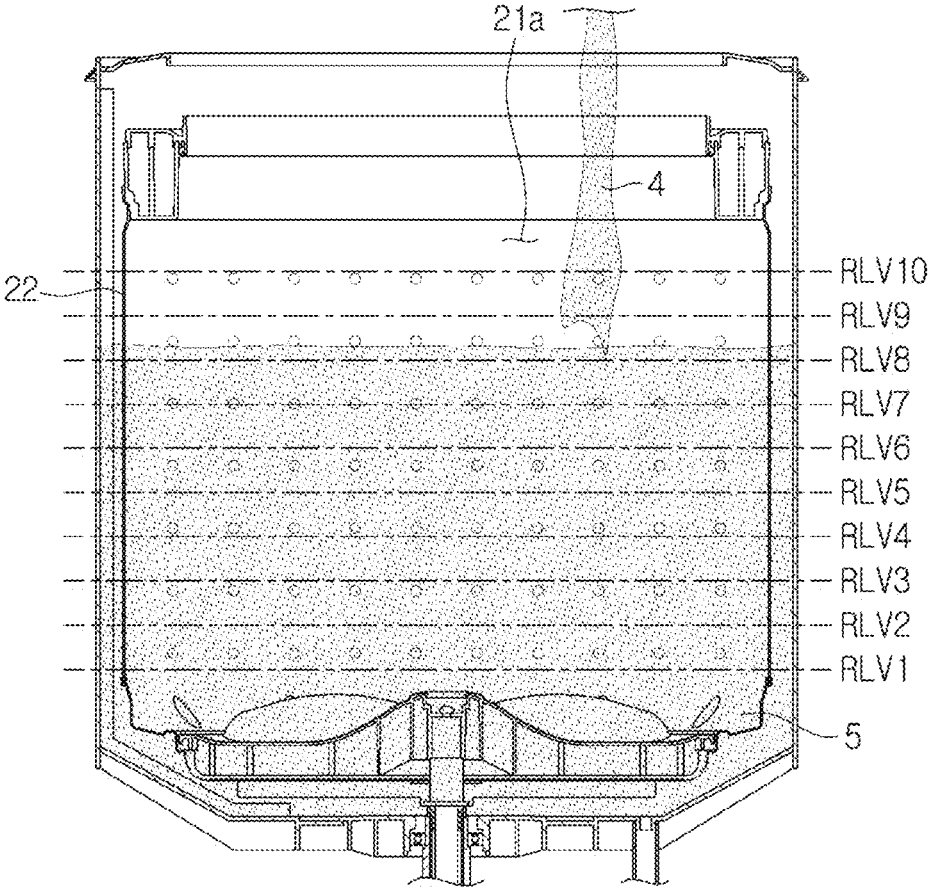
FIG. 46 is a view illustrating a state in which a water level of the washing water is higher than the third reference water level.
Figure 47:
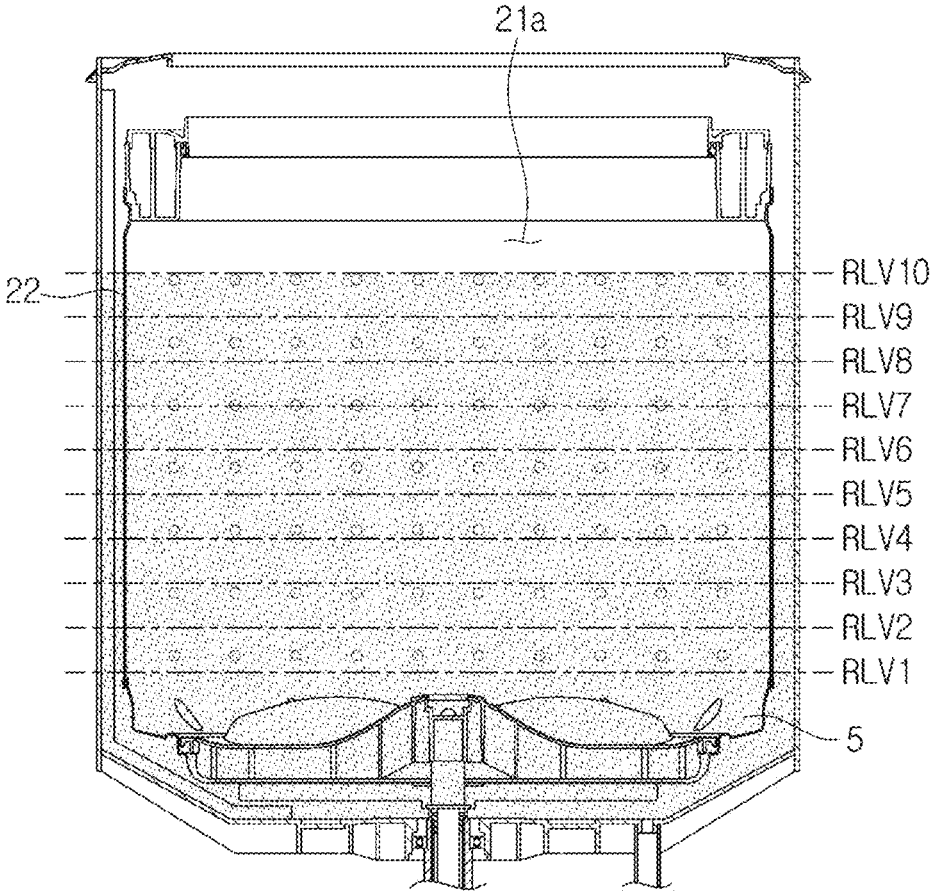
FIG. 47 is a view of an example of supplying the washing water to a fourth target water level.

FIG. 41 is a second flowchart of another example of a method of controlling of the washing apparatus. FIG. 42 is a view illustrating a state in which a water level of the washing water is lower than a second reference water level and FIG. 43 is a view of an example of supplying the washing water to a second target water level. FIG. 44 is a view illustrating a state in which a water level of the washing water is lower than a third reference water level and FIG. 45 is a view of an example of supplying the washing water to a third target water level. FIG. 46 is a view illustrating a state in which a water level of the washing water is higher than the third reference water level and FIG. 47 is a view of an example of supplying the washing water to a fourth target water level.

According to one embodiment, when the current water level is higher than the first reference water level (Yes in 2001 in FIG. 38), the controller 400 may determine whether the current water level is higher than the first reference water level and lower than the second reference water level (2020), i.e., whether the current water level is between the first reference water level and the second reference water level. The first reference water level and the second reference water level may be randomly determined by a designer's selection. For example, the first reference water level may be defined as the first water level (RLV1) and the second reference water level may be defined as the second water level (RLV2).

As illustrated in FIG. 42, when the current water level is higher than the first reference water level and lower than the second reference water level (Yes in 2020), the controller 400 may control the water supply portion 300 so that the water supply portion 300 supplies the washing water 4 to the inside of the main washing space 21*a* of the rotating tub 22 until the water level of the washing water 5 reaches the second target water level, as illustrated in FIGS. 42 and 43 (2021). In other words, the washing water may be supplied until the water level of the washing tub 20*a* reaches the second target water level.

The second target water level may be randomly determined by a designer's selection, i.e., the second target water level may be defined to be the same as the second reference water level. When the second reference water level is defined to be the same as the second water level (RLV2), the second target water level may be defined to be the same as the second water level (RLV2). According to embodiments, the second target water level may be the same as or different from the first target water level in the step of 2011.

When the washing water is supplied to the second target water level, the controller 400 may control each component of the washing apparatus 1 to perform the detection of the wet laundry weight (2022). The detection of the wet laundry weight may be performed using the pulsator 29 or the rotating tub 22, as illustrated in FIGS. 30 to 35C.

According to embodiments, when the detection of the wet laundry weight is performed, the controller 400 may correct the weight of the laundry 3 by considering the weight of the washing water 5. For example, the controller 400 may determine the weight of the laundry 3 by subtracting the weight of the washing water 5, which is supplied to the second target water level, from the weigh obtained by the detection of the wet laundry weight.

When the detection of the wet laundry weight is performed, the washing apparatus 1 may control each component of the washing apparatus 1 to perform the washing operation based on the result of the detection of the wet laundry weight (2023). In other words, the washing apparatus 1 may perform the washing operation based on the result of the detection of the wet laundry weight. In this case, for example, the washing apparatus 1 may perform a certain washing operation based on the weight corresponding to the second water level to the tenth water level (RLV2 to RLV 10).

According to one embodiment, by the control of the controller 400, the information provider 602 of the washing apparatus 1 may provide a content indicating that the washing operation is performed by using the weight of the laundry 3 obtained by the detection of the wet laundry weight (2022), to a user.

When the current water level is higher than the first reference water level (No in 2001 in FIG. 38) and higher than the second reference water level (No in 2020), the controller 400 may determine whether the current water level is higher than the second reference water level and lower than the third reference water level (2024). The second reference water level and the third reference water level may be randomly determined by a designer's selection. For example, the second reference water level may be defined as the second water level (RLV2) and the third reference water level may be defined as the sixth water level (RLV6).

As illustrated in FIG. 44, when the current water level is higher than the second reference water level and lower than the third reference water level (Yes in 2024), the controller 400 may control the water supply portion 300 so that the water supply portion 300 additionally supplies the washing water 4 to the inside of the main washing space 21*a* of the rotating tub 22 (2025). In this case, as illustrated in FIG. 45, the water supply portion 300 may additionally supply water until the water level of the washing water 5 reaches the third target water level. In other words, the washing water may be supplied until the water level of the washing tub 20*a* reaches the third target water level.

The third target water level may be defined to be higher than the second reference water level. A detail water level of the third target water level may be randomly determined by a designer's selection. For example, the third target water level may be defined to be the same as the third reference water level. When the third reference water level is defined as the sixth water level (RLV6), the third target water level may be defined as the sixth water level (RLV6). According to embodiments, the third target water level may be the same as or different from the sixth water level (RLV6).

When the washing water is supplied to the third target water level (2025), the controller 400 may control each component of the washing apparatus 1 to perform the detection of the wet laundry weight (2026). The detection of the wet laundry weight may be performed using the pulsator 29 or the rotating tub 22, as mentioned above.

When the detection of the wet laundry weight is performed, the controller 400 may correct the weight of the laundry 3 by considering the weight of the washing water 5 that is additionally supplied. For example, the controller 400 may determine the weight of the laundry 3 by subtracting the weight of the washing water 5, which is supplied to the third target water level, from the weigh obtained by the detection of the wet laundry weight.

When the detection of the wet laundry weight is performed, the controller 400 may control each component of the washing apparatus 1 to perform the washing operation based on the result of the detection of the wet laundry weight (2027). In other words, the washing apparatus 1 may perform the washing operation based on the result of the detection of the wet laundry weight. In this case, for example, the washing apparatus 1 may perform the washing operation based on the weight of the laundry 3 corresponding to the sixth water level to the tenth water level (RLV6 to RLV 10).

According to one embodiment, by the control of the controller 400, the information provider 602 of the washing apparatus 1 may provide a content indicating that the washing operation is performed by using the weight of the laundry 3 obtained by the detection of the dry laundry weight (2026), to a user. In this case, the information provider 602 may display the weight of the laundry 3 obtained by the detection of the wet laundry weight (2026). The information related to performing the washing operation using the weight of the laundry 3 obtained by the detection of the wet laundry weight (2026) may be provided to a user prior to the supply of the water (2025) or in the middle of the supply of the water (2025).

When the current water level is higher than the third reference water level, e.g., the sixth water level (RLV6) (No in 2024), the water supply portion 300 may additionally supply the washing water 4 to the inside of the main washing space 21*a* of the rotating tub 22 until the water level of the washing water 5 reaches the fourth target water level, as illustrated in FIGS. 46 and 47 (2028). In this case, the water supply portion 300 may keep supplying water until the water level of the washing water 5 reaches the fourth target water level by the control of the controller 400.

The fourth target water level may be randomly determined by a designer's selection. The fourth target water level may be selected among water levels higher than the first, second, and third target water level. For example, the fourth target water level may be the tenth water level (RLV10). According to one embodiment, the fourth target water level may be defined as the highest water level of the washing water 4 in which the washing operation is smoothly performed.

Prior to the supply of the water or in the middle of the supply of the water, the information provider 602 of the washing apparatus 1 may provide information related to supplying water to the fourth target water level or performing the washing operation in the fourth target water level, to a user.

When the washing water is supplied to the fourth target water level, the washing operation may be performed (2029). In this case, the washing operation may be performed based on the weight of the laundry 3 corresponding to the tenth water level (RLV6 to RLV 10). Since the detection of the dry laundry weight or the detection of the wet laundry weight is not performed, a result of the detection of the dry laundry weight or the detection of the wet laundry weight may be not used for the washing operation. In other words, when the water level of the washing apparatus 1 is higher than the third reference water level, the washing operation may be performed regardless of the result of the detection of the laundry weight.

Hereinbefore, the method of controlling the washing apparatus 1 according to another embodiment has been described, but a part of the process may be omitted by a designer's selection or an additional part may be added. For example, the washing operation steps 2020 to 2023, which are performed after comparing the current water level with the second reference water level, may be omitted.

A control method of the washing apparatus according the above-described embodiment may be implemented in the form of a program executed by a variety of computer means. The program may include program instructions, data files, and data structures as itself or a combination therewith. The program may be designed or manufactured by using higher level code executed by the computer by using an interpreter, as well as by using a machine code that is produced by a compiler. In addition, the program may be particularly designed to implement the control method of the above mentioned washing apparatus or may be implemented by using various functions or definition that are well-known and available to a group of ordinary skill in the computer software field.

Programs for implementing the control method of the above-mentioned washing apparatus may be recorded on a recording medium readable by a computer. The recording medium readable by a computer may include various types of hardware devices capable of storing a particular program executed in response to a call from a computer, e.g. magnetic disk storage media such as a hard disk or a floppy disk, optical media such as a magnetic tape, a compact disc (CD) or a DVD, magneto-optical media such as a floptical disk, and semiconductor memory devices such as ROM, RAM, or flash memory.

Hereinbefore a variety of embodiments of the washing apparatus and the control method of the washing apparatus are described, but is not limited thereto. A variety of embodiments which is implementable by those skilled in the art by correcting and modifying based on the above mentioned embodiment may correspond to the above mentioned washing apparatus and the control method of the washing apparatus. For example, when the above-mentioned techniques is executed in a different order from the above-mentioned method, and/or the above-mentioned components such as system, structure, device and circuit is coupled or combined in a manner different from the above-mentioned method or is replaced or substituted by other components or equivalents, the same or the similar result as the above-mentioned washing apparatus and control method of the washing apparatus may be achieved and those may correspond to an example of the above-mentioned washing apparatus and control method of the washing apparatus.

What is claimed is:

1. A method of controlling a washing apparatus provided with a washing tub into which laundry is put, comprising:

determining whether the laundry is wet laundry or dry laundry; and determining a weight of the laundry in the washing tub using different methods depending on whether the laundry is wet laundry or dry laundry, wherein the washing apparatus comprises an auxiliary door forming an auxiliary washing space separate from the washing tub, and wherein the determining whether the laundry is wet laundry or dry laundry comprises determining that the laundry put into the washing tub is wet laundry when washing water is supplied to the auxiliary door.

2. The method according to claim 1, further comprising:

rotating, by a motor, a pulsator installed in a bottom of the washing tub in at least one direction, when washing water is supplied to the washing tub to a target water level.

3. The method according to claim 2, wherein the determining the weight of the laundry comprises using a friction load of the laundry during rotation of the pulsator.

4. The method according to claim 1, wherein the determining the weight of the laundry comprises using at least one of a current applied to a motor connected to a pulsator or a rotating tub, a rotational speed of the pulsator, and a water level of washing water in the washing tub.

5. The method according to claim 2, wherein the determining the weight of the laundry comprises:

detecting a current applied to the motor, determining a load corresponding to a magnitude of the detected current, and determining the weight of the laundry using a result of the determination.

6. The method according to claim 1, further comprising:

storing, in a memory, information related to whether washing water is supplied to the auxiliary door, wherein the determining whether the laundry is wet laundry or dry laundry comprises determining whether washing water is supplied to the auxiliary door based on information stored in the memory.

7. The method according to claim 6, wherein:

the storing of the information comprises storing information related to whether an auxiliary input, which receives a washing water supply command about the auxiliary door, is operated or not, and the determining whether the laundry is wet laundry or dry laundry comprises determining whether washing water is supplied to the auxiliary door based on the information related to whether the auxiliary input is operated or not.

8. The method according to claim 1, wherein the determining whether the laundry is wet laundry or dry laundry comprises determining that the laundry put into the washing tub is dry laundry when washing water is not supplied to the auxiliary door.

9. The method according to claim 8, wherein the determining the weight of the laundry comprises determining the weight of the laundry using a friction load of the laundry about a pulsator by rotating the pulsator installed in a bottom of the washing tub, or using a rotational inertia caused by rotation of a rotating tub or a current output during the rotation of the rotating tub.

10. The method according to claim 8, further comprising:

after the weight of the laundry is determined and a washing cycle is performed based on the determined weight, determining that the laundry in the washing tub is wet laundry and determines the weight of the laundry through detection of wet laundry weight, again.

11. The method according to claim 1, further comprising:

determining at least one setting related to a washing cycle, according to the determined weight of the laundry.

12. The method according to claim 11, wherein the at least one setting related to the washing cycle comprises at least one of an amount of washing water supplied to the washing tub, a power applied to a motor connected to the washing tub or a pulsator installed in the washing tub, a rotational speed of the motor, and a washing time.

13. The method according to claim 1, further comprising:

supplying washing water to the washing tub to a target water level that is determined based on a current water level of the washing tub when the laundry put into the washing tub is determined to be wet laundry.

* * * * *